US008567156B2

(12) United States Patent
Horiuchi

(10) Patent No.: US 8,567,156 B2
(45) Date of Patent: Oct. 29, 2013

(54) PAPER SHEET PROCESSING SYSTEM

(75) Inventor: Haruhiko Horiuchi, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 504 days.

(21) Appl. No.: 12/793,889

(22) Filed: Jun. 4, 2010

(65) Prior Publication Data

US 2010/0313521 A1 Dec. 16, 2010

(30) Foreign Application Priority Data

| | | |
|---|---|---|
| Jun. 15, 2009 | (JP) | P2009-142424 |
| Jul. 21, 2009 | (JP) | P2009-169981 |
| Aug. 19, 2009 | (JP) | P2009-190524 |
| Oct. 7, 2009 | (JP) | P2009-233082 |
| Nov. 13, 2009 | (JP) | P2009-259550 |

(51) Int. Cl.
*B65B 35/10* (2006.01)

(52) U.S. Cl.
USPC ..... 53/52; 53/54; 53/176; 53/582

(58) Field of Classification Search
USPC ..... 53/176, 589, 582, 53, 213, 52, 54; 209/534
See application file for complete search history.

(56) References Cited

U.S. PATENT DOCUMENTS

| | | | | |
|---|---|---|---|---|
| 3,939,621 | A * | 2/1976 | Giori | 53/435 |
| 4,090,441 | A * | 5/1978 | Muller | 100/7 |
| 4,376,364 | A * | 3/1983 | Horino et al. | 53/54 |
| 4,483,124 | A * | 11/1984 | Ohba et al. | 53/54 |
| 4,845,917 | A * | 7/1989 | Omura et al. | 53/53 |
| 5,096,067 | A * | 3/1992 | Tutamune et al. | 209/551 |
| 5,199,697 | A * | 4/1993 | Yamada et al. | 271/122 |
| 5,233,816 | A * | 8/1993 | Moriya et al. | 53/588 |
| 5,878,999 | A * | 3/1999 | Neri et al. | 270/58.08 |
| 6,234,474 | B1 * | 5/2001 | Horii et al. | 271/288 |
| 6,659,258 | B2 * | 12/2003 | Otsuka | 194/206 |
| 7,386,964 | B2 * | 6/2008 | Kuru et al. | 53/54 |
| 7,469,890 | B2 * | 12/2008 | Aoki | 271/157 |
| 7,516,601 | B2 | 4/2009 | Horiuchi | |
| 2008/0236101 | A1 * | 10/2008 | Horiuchi | 53/399 |

FOREIGN PATENT DOCUMENTS

JP 2008-276751 11/2008

* cited by examiner

*Primary Examiner* — Alexandra Elve
*Assistant Examiner* — Adam Moon
(74) *Attorney, Agent, or Firm* — Pillsbury Winthrop Shaw Pittman, LLP

(57) ABSTRACT

A paper sheet processing system has a paper sheet processing apparatus and a paper sheet bundle wrapping apparatus. The paper sheet processing apparatus sends category information of a bundle of 100 paper sheets to the paper sheet bundle wrapping apparatus when discharging the bundle of 100 paper sheets. The paper sheet bundle wrapping apparatus classifies and accumulates the bundle of 100 paper sheets based on the category information when receiving the bundle of 100 paper sheets. The paper sheet bundle wrapping apparatus bands ten bundles of 100 paper sheets as a bundle of 1000 paper sheets. Since the paper sheet bundle wrapping apparatus receives the bundle of 100 paper sheets of different category from the paper sheet processing apparatus and accumulates the bundle of 100 paper sheets for every category to form the bundle of 1000 paper sheets, the usage rate of the paper sheet bundle wrapping apparatus becomes high.

18 Claims, 44 Drawing Sheets

PAPER SHEET PROCESSING SYSTEM

CROSS REFERENCE TO RELATED APPLICATION

This application is based upon and claims the benefit of priority from Japanese Patent Applications No. 2009-142424, filed on Jun. 15, 2009, No. 2009-169981, filed on Jul. 19, 2009, No. 2009-190524, filed on Aug. 19, 2009, No. 2009-233082, filed on Oct. 7, 2009, and No. 2009-259550, filed on Nov. 13, 2009, the entire contents of which are incorporated herein by reference.

FIELD

The embodiment described herein relates to a paper sheet processing system which has a paper sheet processing apparatus and a paper sheet bundle wrapping apparatus. The paper sheet processing apparatus classifies paper sheets, such as securities, forms a bundle of 100 paper sheet, and discharges the bundle of 100 paper sheets. The paper sheet bundle wrapping apparatus takes in ten bundles of 100 paper sheets discharged from the paper sheet processing apparatus, binds ten bundles of 100 paper sheets together as a bundle of 1000 paper sheet, and shrink-wraps the bundle of 1000 paper sheets.

BACKGROUND

A paper sheet processing apparatus classifies paper sheets, such as securities, into a kind or quality, and accumulates the paper sheet for every classification. The kind of paper sheet is a ticket type, and the quality of paper sheet is a normal ticket, a damaged ticket and a rejectable ticket, for example. Whenever accumulated paper sheets amount to 100 sheets, the paper sheet processing apparatus binds 100 paper sheets together with a band to form a bundle of 100 paper sheets, and discharges the bundle of 100 paper sheets.

Ten bundles of 100 paper sheets classified to the same kind are supplied to a paper sheet bundle wrapping apparatus, the paper sheet bundle wrapping apparatus binds ten bundles of 100 paper sheets together to form a bundle of 1000 paper sheets, and shrink-wraps the bundle of 1000 sheets.

In the paper sheet processing system which has the paper sheet processing apparatus and the paper sheet bundle wrapping apparatus, the paper sheet bundle wrapping apparatus receives ten bundles of 100 paper sheets classified in the same kind. For this reason, the paper sheet bundle wrapping apparatus does not work until ten bundles of 100 paper sheets classified in the same kind are accumulated, and its usage rate of the apparatus is low.

SUMMARY OF THE INVENTION

Embodiments provide a paper sheet processing system which raises the usage rate of a paper sheet bundle wrapping apparatus.

A paper sheet processing system according to the embodiment includes a paper sheet processing apparatus and a paper sheet bundle wrapping apparatus. The paper sheet processing apparatus includes a taking-in unit configured to take in one paper sheet supplied at a time; a paper sheet discrimination unit configured to distinguish category of the paper sheet taken in by the taking-in unit; an accumulation part constituted so that the paper sheet may be accumulated according to the category based on the category which the paper sheet discrimination unit distinguished; a 1st binding unit configured to bind a 1st number of the paper sheets accumulated together by a 1st band at a 1st banding position to form a 1st paper sheet bundle; a discharging mechanism configured to discharge the 1st paper sheet bundle; and a 1st communications unit configured to transmit category information corresponding to the category of the paper sheet included in the 1st paper sheet bundle discharged by the discharging mechanism. The paper sheet bundle wrapping apparatus includes a 1st receiving unit configured to receive the 1st paper sheet bundle discharged from the paper sheet processing apparatus; a 2nd communications unit configured to receive the category information transmitted by the 1st communications unit; an accumulation mechanism configured to accumulate the 1st paper sheet bundle received by the 1st receiving unit on a 1st accumulation tray or a 2nd accumulation tray based on the category information received by the 2nd communications unit; a conveyance mechanism configured to convey a 2nd number of the 1st paper sheet bundles accumulated to the 1st accumulation tray or the 2nd accumulation tray, to a 2nd binding unit; the 2nd binding unit configured to bind the 2nd number of the 1st paper sheet bundles conveyed by the conveyance mechanism together by a 2nd band and a 3rd band to form a 2nd paper sheet bundle; a wrapping unit configured to wrap the 2nd paper sheet bundle; and a control unit configured to control the 1st receiving unit, the accumulation mechanism, the conveyance mechanism, the 2nd binding unit, and the wrapping unit;

DETAILED DESCRIPTION

Embodiment 1

Hereinafter, an embodiment will be described with reference to the drawings.

Figure 1:
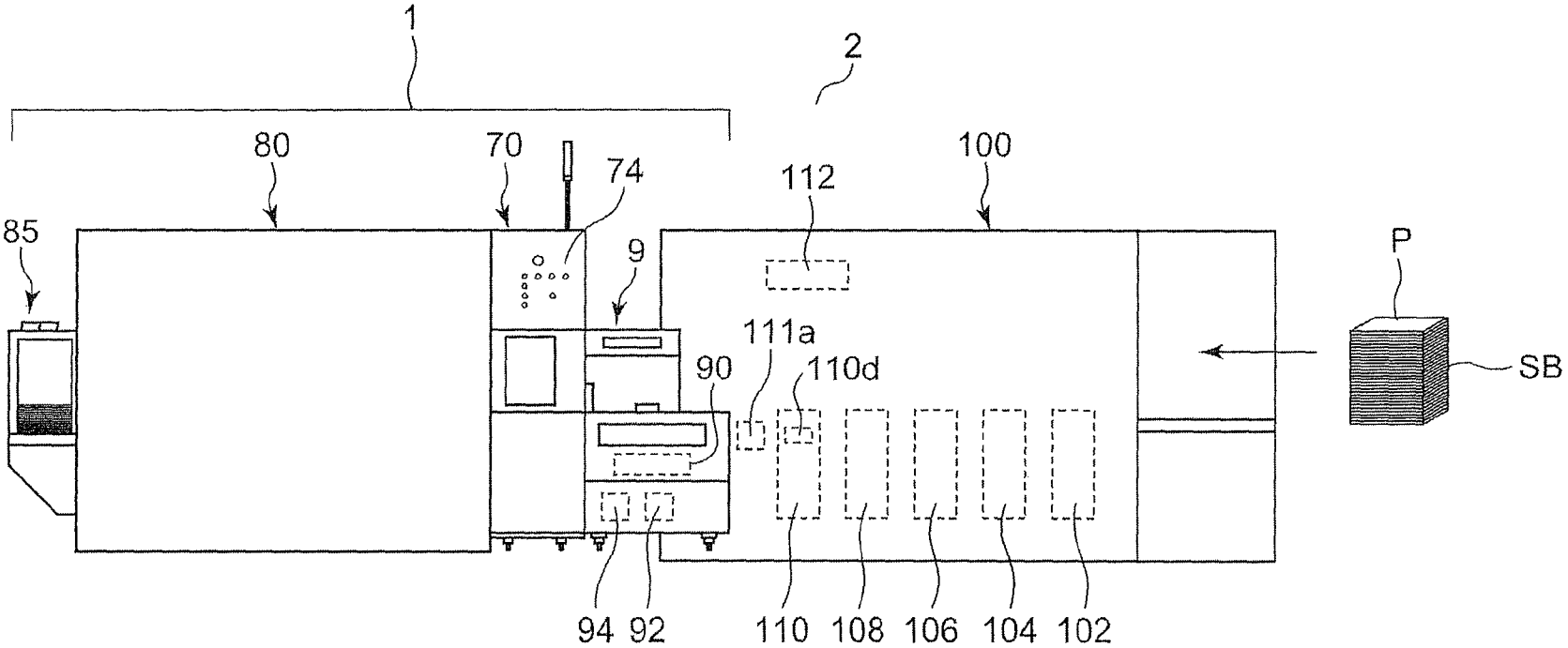
FIG. 1 illustrates an outline of a paper sheet processing system according to an embodiment.
Figure 36:
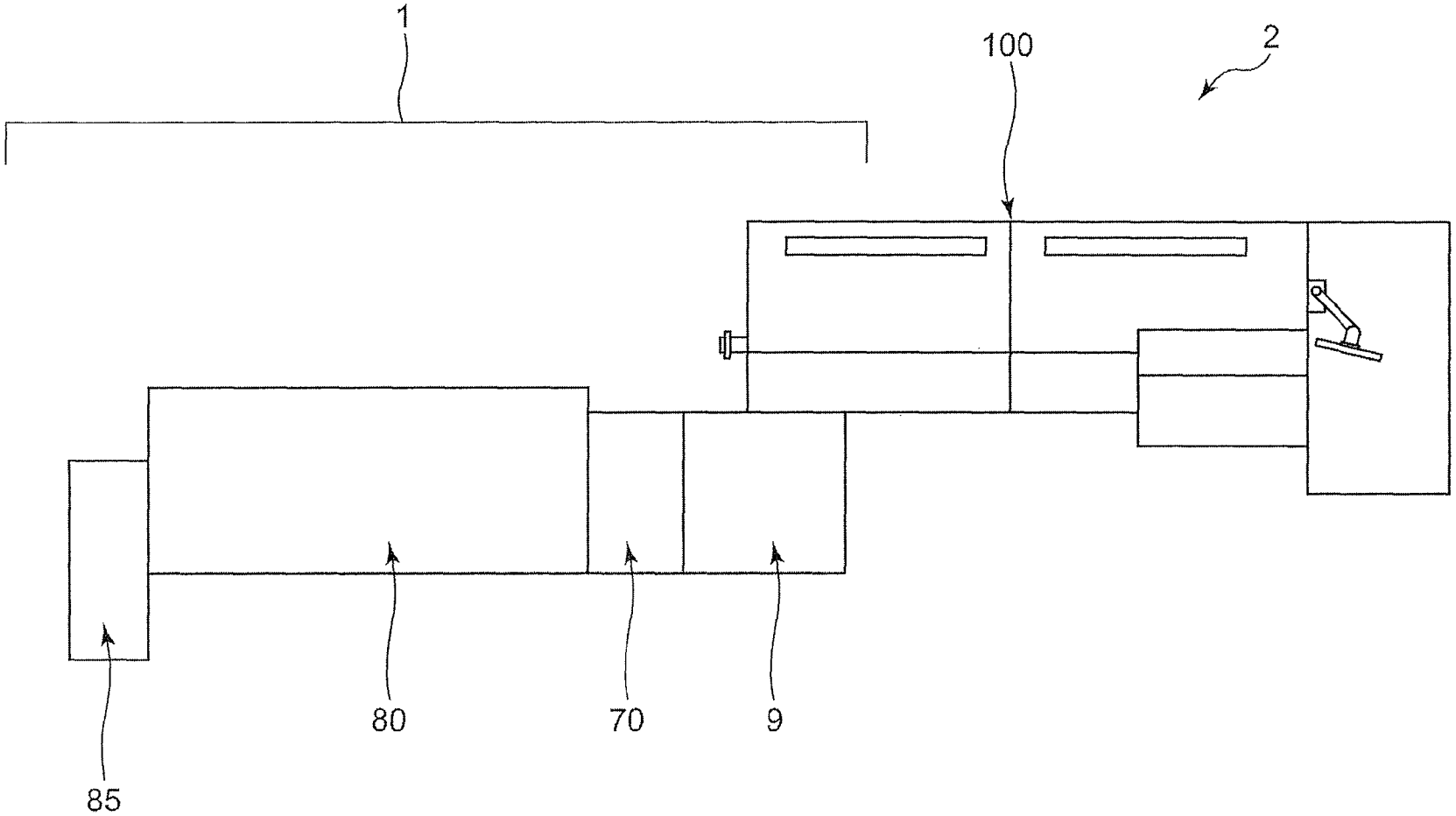
FIG. 36 is a plane arrangement diagram of the paper sheet processing system concerning the embodiment 1.

FIG. 1 shows a paper sheet processing system 2 of the embodiment. The paper sheet processing system 2 has a paper sheet processing apparatus 100 and a paper sheet bundle wrapping apparatus 1. The paper sheet processing apparatus 100 and the paper sheet bundle wrapping apparatus 1 are connected. The paper sheet processing apparatus 100 classifies the supplied paper sheet, and forms a bundle of 100 paper sheets. The paper sheet bundle wrapping apparatus 1 classifies the bundle of 100 paper sheets supplied from the paper sheet processing apparatus 100 and accumulates ten bundles of 100 paper sheets by a 100-sheets bundle accumulation unit 9, bands ten bundles of 100 paper sheets to form a bundle of 1000 paper sheets by a binding unit 70, and further shrink-warps the bundle of 1000 paper sheets by a wrapping unit 80. Numeral 85 denotes a 1000-sheet bundle discharge unit. As shown in FIG. 36, the 100-sheet bundle accumulation unit 9, the binding unit 70, the wrapping unit 80, and the discharge unit of 1000 paper sheets of the paper sheet bundle wrapping apparatus 1 are connected and are arrange in straight shape.

Figure 2:
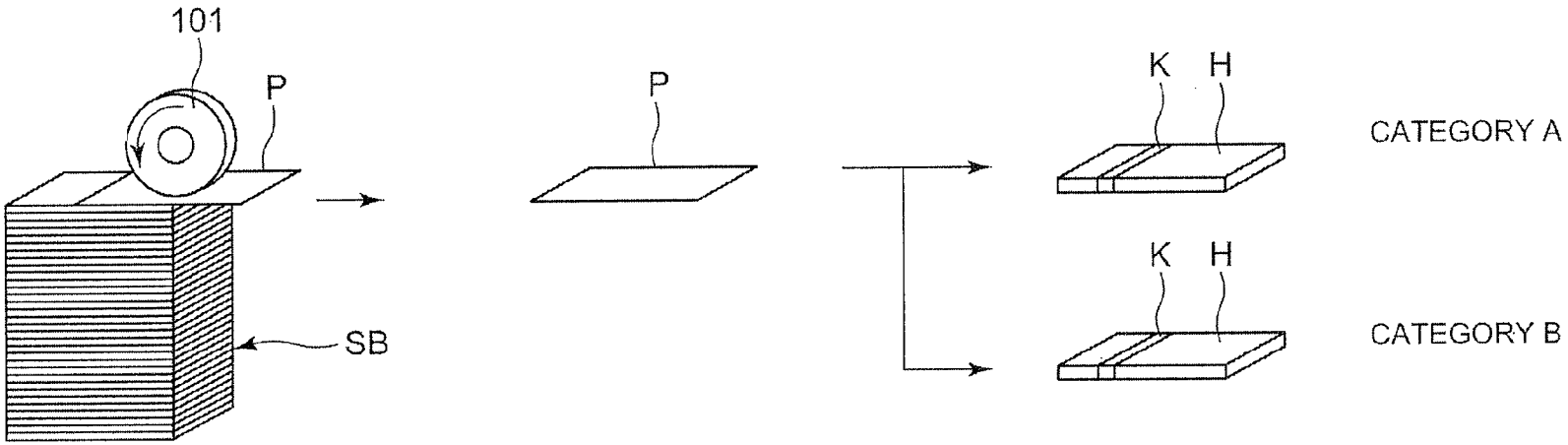
FIG. 2 illustrates a flow of operation until the paper sheet processing apparatus takes in 1000 paper sheets, classifies the paper sheets and forms a bundle of 100 sheets.

The paper sheet processing apparatus 100 takes in one paper sheet P at a time with a taking-in roller 101 which constitutes a taking-in unit 102 in an order from the uppermost of the paper sheet bundle SB supplied collectively, as shown in FIG. 1 and FIG. 2. A paper sheet discrimination unit 104 arranged inside distinguishes the kind, truth/fake, normal/damaged, front/back, etc. of the paper sheet P. The paper sheet discrimination unit 104 classifies the paper sheet P into a normal ticket or a damaged ticket, for example, for every sheet based on the discriminated result. The normal ticket is a reusable and comparatively new paper sheet, and the damaged ticket is an unusable and old paper sheet. Hereinafter, the embodiment which classifies the paper sheet into the normal ticket and the damaged ticket will be described. The normal ticket is classified into category A, and the damaged ticket is classified into category B.

The paper sheet P classified into category A or category B is accumulated by an accumulation unit 106 for every classification. Whenever the paper sheet P classified into each amounts to 100 sheets, 100 paper sheets are bound together by a 1st band K, such as paper or cellophane, by a 1st binding unit 108. The band K is arranged to shift from the center of the paper sheet. Thus, a bundle H of 100 paper sheets is formed. A classification attribute for every category is printed on the band K so that the paper sheet bundle including the paper sheet P classified into category A and the paper sheet bundle including the paper sheet P classified into category B can be distinguished visually. Different bands K according to the categories of the paper sheets P may be used.

There are various methods to classify the paper sheet as mentioned below. (1) The normal ticket is classified into category A and the damaged ticket is classified into category B. (2) A front-conveyed paper sheet is classified into category A, and a back-conveyed paper sheet is classified into category B. (3) A front-conveyed paper sheet is classified into category A, and a paper sheet conveyed except front is classified into category B.

The paper sheet processing apparatus 100 has a discharge mechanism 110 constituted so that the bundle H of 100 paper sheets may be discharged, and a 1st communications unit 112 constituted so that the category information corresponding to the category of the bundle H of 100 paper sheets which the discharge mechanism discharged may be transmitted. The discharge mechanism 110 includes a pushing base 110*d* which pushes out the bundle of 100 paper sheets to the paper sheet wrapping apparatus 1. Reference number 111*a* shows an outlet by which the bundle H of 100 paper sheets is discharged. Here, a category of the bundle H of paper sheets is the same as the category of the paper sheet contained in the bundle H of paper sheets.

Figure 3:
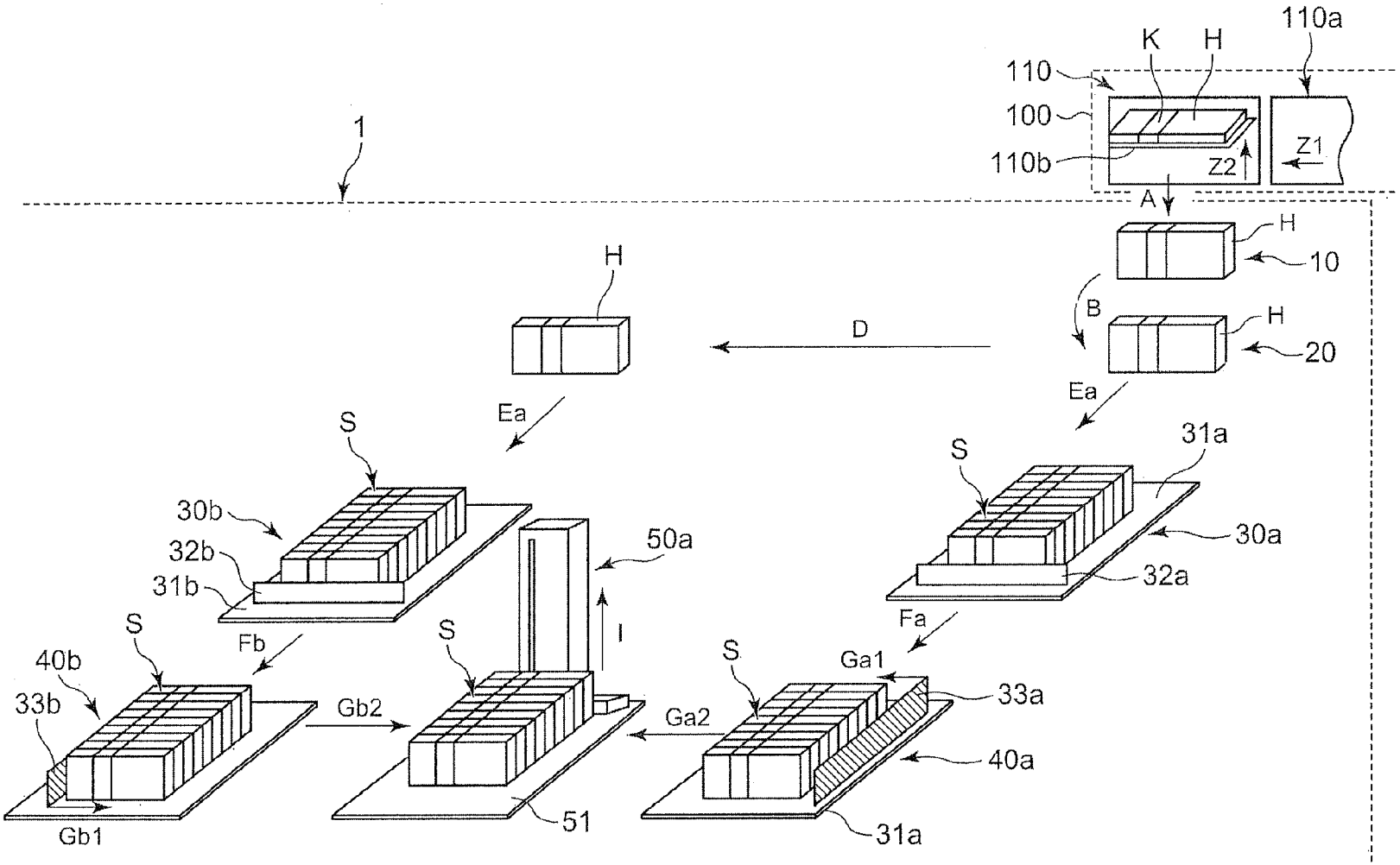
FIG. 3 illustrates a flow of operation until ten bundles of 100 paper sheet are passed to a lift table 51 after a paper sheet bundle wrapping apparatus 1 receives the bundle of 100 paper sheets.

FIG. 3 is a drawing illustrates a flow until a bundle S of 1000 paper sheets is passed to a lift table 51 of a lifter 50 within the paper sheet bundle wrapping apparatus 1 after the bundle H of 100 paper sheets is discharged from the paper sheet processing apparatus 100.

The paper sheet processing apparatus 100 conveys the bundle H of 100 paper sheets in the direction of arrow Z1 on a belt conveyor 110*a*. When the bundle H of 100 paper sheets arrives at a predetermined position, the bundle H of 100 paper sheets is laid on a life table 110*b*. One side of the life table 110*b* is raised by a lifter, and one side edge face of the bundle H of 100 paper sheets is raised in the direction of arrow Z2. Thereby, a posture of the bundle H of 100 paper sheets is changed into a standing position where another side edge face of the bundle H of 100 paper sheets is used as the bottom, and is held.

The bundle H of 100 paper sheets held in the standing position is pushed out from the back by an pushing bar, and is discharged from the outlet 111*a* of the paper sheet processing apparatus 100. The conveyer belt 110*a*, the lift table 110*b*, the lifter, and the pushing bar constitute the discharge mechanism 110. The bundle H of 100 paper sheets discharged from the paper sheet processing apparatus 100 is pushed into a receiving unit 10 of the paper sheet bundle wrapping apparatus 1 in the standing position. In this case, the category information which shows the category of the bundle H of 100 paper sheets is transmitted to a 2nd communications unit 92 of the paper sheet bundle wrapping apparatus 1 from the 1st communications unit 112 of the paper sheet processing apparatus 100.

The receiving unit 10 takes in the bundle H of 100 paper sheets received from the paper sheet processing apparatus 100. The bundle H of 100 paper sheets is pushed in from the back, and is slipping down a slipping down portion which is not illustrated and is held on a shutter which is not illustrated. The shutter holds the bundle H of 100 paper sheets temporarily. Then, the shutter opens and the bundle H of 100 paper sheets slips down on the conveyor which is not illustrated. The details of the shutter will be explained later.

The category selecting unit 20 chooses an accumulation part 30*a* or an accumulation part 30*b* on which the bundle H of 100 paper sheets is accumulated based on the category information which the 2nd communications unit 92 received. The category selecting unit 20 accumulates the bundle H of 100 paper sheets slipped-down on the conveyer on the accumulation part 30*a* or the accumulation part 30*b*. A mechanism which accumulates the bundle H of 100 paper sheets pushed into the receiving unit 10 to the accumulation part 30*a* or the accumulation part 30*b* is called an accumulation mechanism. The accumulation mechanism includes the slipping down portion, the shutter, the conveyor, and the category selecting unit 20.

The bundle H of 100 paper sheets of the normal ticket of category A is pushed out in the direction of arrow Ea and is accumulated in a standing position on an accumulation tray 31*a* arranged at the accumulation part 30*a*. On this occasion, a fall prevention means prevents the bundle H of 100 paper sheets from falling. The details of the fall prevention means are mentioned later. The bundle H of 100 paper sheets is accumulated to ten bundles. Hereinafter, accumulated ten bundles H of 100 paper sheets are collectively called a bundle S of 1000 paper sheets.

When ten bundles H of 100 paper sheets are accumulated, the accumulation tray 31*a* will be moved to a direction change unit 40*a* provided in the direction of arrow Fa by a moving means which is not illustrated.

When the accumulation tray 31*a* reaches the direction change unit 40*a*, movement of the accumulation tray 31*a* stops. Then, when a pusher 33*a* which is a delivery means moves in the direction of arrow Ga1, the bundle S of 1000 paper sheets is pushed out in the direction of arrow Ga2 and is laid on the lift table 51 of the lifter 50.

Thus, when the bundle S of 1000 paper sheets on the accumulation tray 31*a* is moved onto the lift table 51, the accumulation tray 31*a* is conveyed to an opposite direction and returns to an initial state. That is, the accumulation tray 31*a* returns to the accumulation part 30*a*.

On the other hand, the bundle H of 100 paper sheets of the damaged ticket which is category B is conveyed in the direction of arrow D by the conveyor which is not illustrated. On this occasion, a second fall prevention means which is not illustrated prevents the fall of the bundle H of 100 paper sheets. The details of the second fall prevention means are mentioned later.

The bundle H of 100 paper sheets conveyed by the conveyor is pushed out in the direction of arrow Eb, and is accumulated on a accumulation tray 31*b* arranged at the accumulation part 30*b*. When ten bundles H of 100 paper sheets are accumulated on the accumulation tray 31*b*, the accumulation tray 31*b* is conveyed to a direction change unit 40*b* provided in the direction of arrow Fb by the moving means which is not illustrated.

When the accumulation tray 31*b* reaches the direction change unit 40*b*, movement of the accumulation tray 31*b* stops. Then, when a pusher 33*b* moves in the direction of arrow Gb1, the bundle S of 1000 paper sheets is pushed out in the direction of arrow Gb2, and is laid on the lift table 51 of the lifter 50.

When the bundle S of 1000 paper sheets on the accumulation tray 31*b* is moved onto the lift table 51, the accumulation tray 31*b* is conveyed to an opposite direction, and returns to an initial state. That is, the accumulation tray 31*b* returns to the accumulation part 30*b*.

The lifter 50 raises the bundle S of 1000 paper sheets laid on the lift table 51 in the direction of arrow I along a slide rail 54.

Figure 4A:
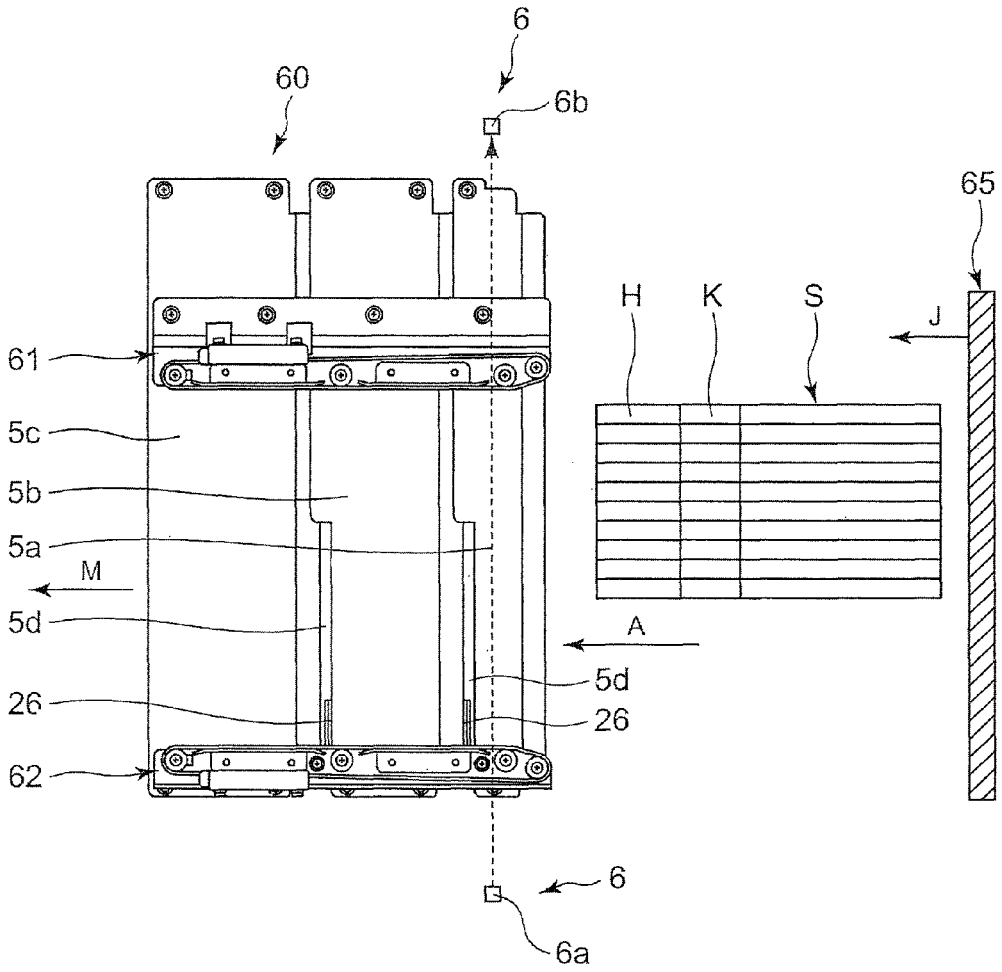
FIGS. 4A and 4B illustrate a flow until ten bundles of 100 paper sheets are bound together after ten bundles of 100 paper sheets are raised up by a lifter 50.
Figure 4B:
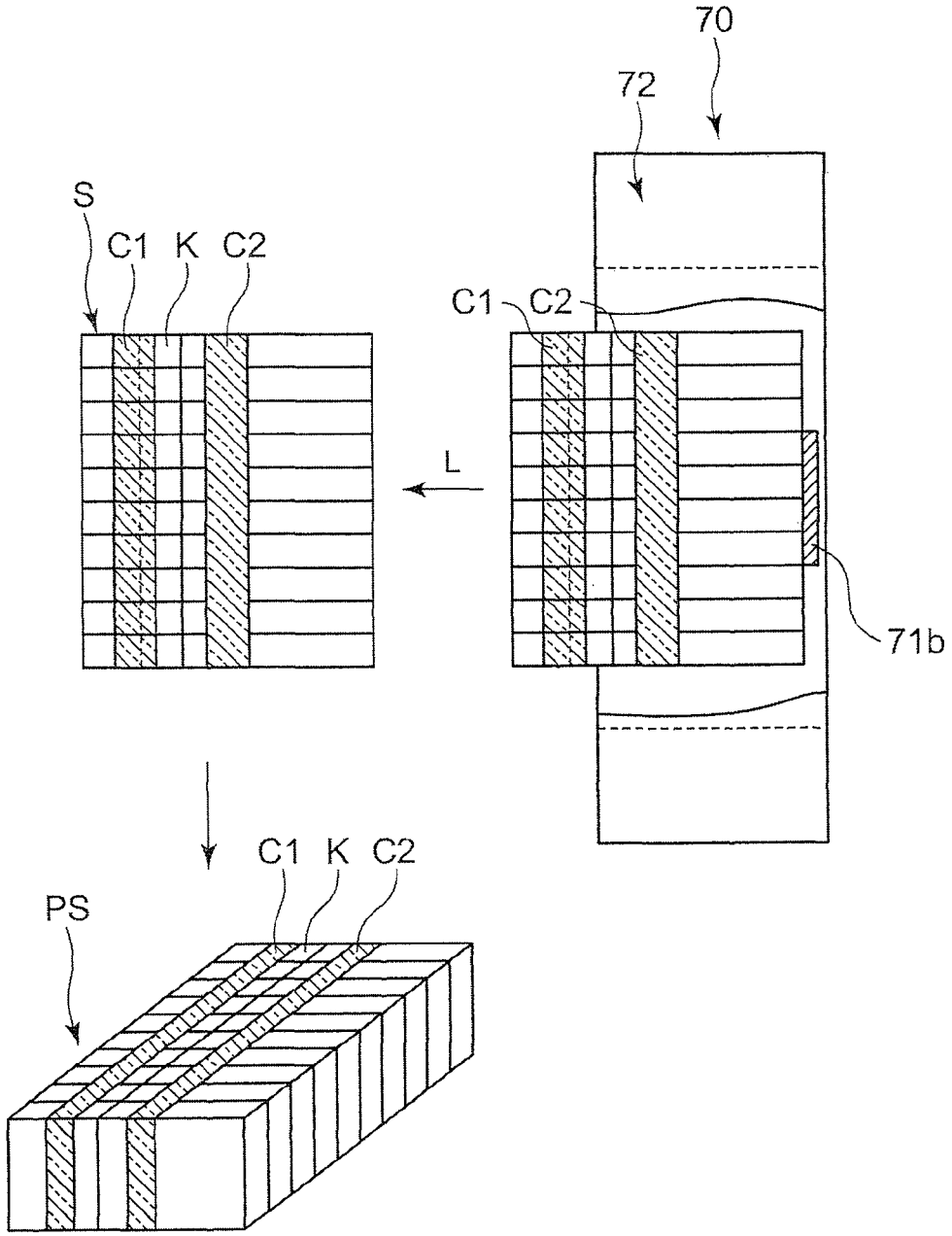

FIG. 4A and FIG. 4B are drawings illustrate a flow until the bundle S of 1000 paper sheets is bound together after the bundle S of 1000 paper sheets is raised up by the lifter 50. When the bundle S of 1000 paper sheets which is raised up by the lifter 50 arrives at a predetermined position, a pusher 65 moves in the direction of arrow J, and delivers the bundle S of 1000 paper sheets to the paper sheet bundle conveying unit 60.

As shown in FIG. 4A, the paper sheet bundle conveying unit 60 has a fixed guide 61, a movable guide 62, and conveying tables 5*a*-5*c*. The paper sheet bundle conveying unit 60 pinches the bundle S of 1000 paper sheets with the fixed guide 61 and the movable guide 62, and conveys it in the direction of arrow M. Each of the movable guide 61 and the fixed guide 62 has a plurality of idle rollers arranged along the conveying direction of the bundle S of 1000 paper sheets, and a belt arranged at the outer circumference of these idle rollers. Even if the thickness of the bundle S of 1000 paper sheets changes, the movable guide 62 presses the bundle S of 1000 paper sheets to the fixed guide 61 side with a constant force spring. The belt conveys the bundle S of 1000 paper sheets to the conveying direction with a light load by the idle rollers. The details of the paper sheet bundle conveying unit 60 are mentioned later.

The paper sheet bundle conveying unit 60 constituted thus prevents collapse of the bundle S of 1000 paper sheets, and enables the light load conveyance of the bundle S of 1000 paper sheets which is about 1 kg in weight by the pusher 65. When the bundle S of 1000 paper sheets is conveyed by the paper sheet bundle conveying unit 60, a position of the bundle S of 1000 paper sheets is arranged at the fixed guide 61 side.

The bundle S of 1000 paper sheets arranged its position and conveyed is pushed out from the paper sheet bundle conveying unit 60, and is sent to a binding unit 70 as shown in FIG. 4B.

The moving means which moves the accumulation trays 31*a*, 31*b* to the direction change units 40*a* and 40*b*, the delivery unit which pushes out the bundle S of 1000 paper sheets on the accumulation trays 31*a*, 31*b* to the lift table, the lifter 50 and the paper sheet bundle conveying unit 60 constitute a conveyance mechanism which conveys the bundle S of 1000 paper sheets accumulated on the accumulation trays 31*a* and 31*b* to the binding unit 70.

In the binding unit 70, a banding machine 71 binds the bundle S of 1000 paper sheets by bands C1, C2 which are made of a transparent resin film at two places, while a pusher 71*b* sends the bundle S of 1000 paper sheets to a conveyance direction only the specified amount.

The bundle S of 1000 paper sheets which is bound together is further pushed out in the direction of arrow L, and also is shrink wrapped by shrink wrapping unit 80.

And a wrapped bundle PS of 1000 paper sheets is stored in a storage which is not illustrated.

Figure 5:
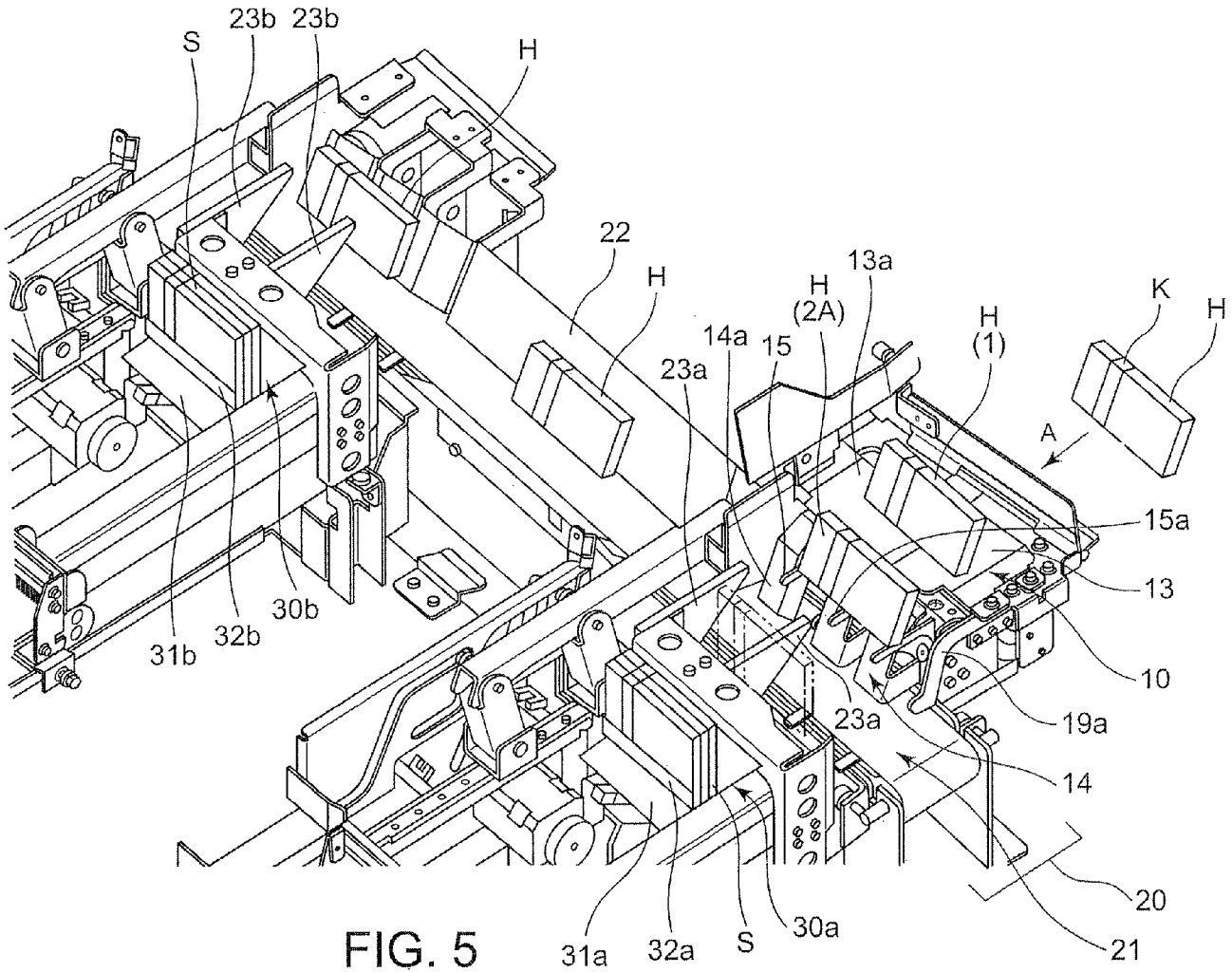
FIG. 5 is a perspective view showing a receiving unit for the bundle of 100 paper sheets, a category selecting unit, and an accumulation mechanism of the paper sheet bundle wrapping apparatus.

Next, the composition of the paper sheet bundle wrapping apparatus 1 will be explained. FIG. 5 is a drawing illustrating operation of the receiving unit 10 for bundle H of 100 paper sheets of the paper sheet bundle wrapping apparatus 1 and the category selecting unit 20.

The receiving unit 10 accepts the bundle H of 100 paper sheets discharged from the paper sheet processing apparatus 100. The receiving unit 10 includes a plate 13 which receives the bundle H of 100 paper sheets. By the side in which the bundle H of 100 paper sheets is inserted, the plate 13 is arranged so that a right end section 13*a* along the direction of insertion of the bundle H of 100 paper sheets may become lower than that of other ends. Since the center of gravity of the bundle H of 100 paper sheets pushed in from the paper sheet processing apparatus 100 moves to the end section 13*a* side by such arrangement, the bundle H of 100 paper sheets is held in a standing position.

The bundle H of 100 paper sheets in the standing position is pushed out by the pusher which is not illustrated, slips down a slope 14*a*, and falls on the shutter 15.

The slope 14*a* constitutes the slipping down portion 14.

The shutter 15 has a plurality of rod-like members 15*a*. The shutter 15 opens when the rod-like members 15*a* retreat from the slope 14*a*, and the shutter 15 closes when the rod-like members 15*a* project from the slope 14*a*. When the shutter 15 is close, while the side edge of the bundle H of 100 paper sheets is made into a bottom and the surface or the back of the bundle H of 100 paper sheets contacts the slope 14*a*, the bundle H of 100 paper sheets slides on the slope 14*a* and is laid on the shutter 15. When the shutter 15 opens, the bundle H of 100 paper sheets slides on the slope 14*a* under the shutter 15 and is laid on a conveyor 21 in a standing position.

The shutter 15 can adjust the height between the plate 13 and the conveyor 21.

The category selecting unit 20 includes the conveyor 21 and a pushing bar 19*a*. The category selecting unit 20 conveys the bundle H of 100 paper sheets laid on conveyor 21 to the accumulation part 30*a* or the accumulation part 30*b* according to the category information. In the embodiment, the normal ticket is pushed into the accumulation part 30*a* of category A by the pushing bar 19*a*, and is accumulated on the accumulation tray 31*a*. While the damaged ticket contacts conveyor side wall 22, the damaged ticket is conveyed by the conveyor 21. When the damaged ticket arrives at a predetermined position, the damaged ticket will be pushed into the accumulation part 30*b* of category B by the pushing bar which is not illustrated and is accumulated on the accumulation tray 31*b*.

When the paper sheet processing apparatus 100 discharges the bundle H of 100 paper sheets, the paper sheet processing apparatus 100 transmits the category information of the bundle H of 100 paper sheets discharged from the 1st communications unit 112. The paper sheet bundle processing apparatus 1 receives the category information by the 2nd communications unit 92 and recognizes the category of the bundle H of 100 paper sheets which the receiving unit 10 receives based on the category information. In the paper sheet bundle processing apparatus 1, the accumulation mechanism accumulates the bundle H of 100 paper sheets to the accumulation part 30*a* or the accumulation part 30*b* based on the category information received.

The bundle H of 100 paper sheets laid on the conveyor 21 shows a state where the bundle H of 100 paper sheets is conveyed toward the accumulation part 30*b*. When a following bundle H of 100 paper sheets is accumulated to the accumulation part 30*a*, discharging the following bundle H of 100 paper sheets on the conveyor 21 by the shutter 15 is controlled so that the following bundle H of 100 paper sheets may be accumulated to the accumulation part 30*a* after the bundle H of 100 paper sheets on the conveyor 21 is accumulated to the accumulation part 30*b*. Accordingly, even if the bundle H of 100 paper sheets of a different category is supplied from the paper sheet processing apparatus 100 at random, the category selecting unit 20 can accumulate the bundle H of 100 paper sheets for every category by such processing. And thus, the bundle H of 100 paper sheets of one category is prevented from mixing to the bundle S of 1000 paper sheets of other category.

The bundle H of 100 paper sheets accumulated on the accumulation tray 31*a* is prevented from falling down by the fall prevention means. The fall prevention means includes a fall prevention pusher 32*a* and a fall prevention guide 23*a*.

The fall prevention pusher 32*a* presses the accumulated bundle H of 100 paper sheets to the fall prevention guide 23*a* side by spring force of a constant force spring (not shown). Therefore, a press by constant load is obtained irrespective of the number of the bundle H of 100 paper sheets accumulated on the accumulation tray 31*a*.

Fall prevention guide 23*a* is a wedge shape, and has a notch section in the back end portion of a wedge. When the bundle H of 100 paper sheets is inserted, an upper end face of the bundle H of 100 paper sheets pushes up the fall prevention guide 23*a* along the wedge shape. When the bundle H of 100 paper sheets is inserted further, the upper end of the bundle H of 100 paper sheets enters into the notch section. Since the bundle H of 100 paper sheets is pinched by the fall prevention guide 23*a* and the fall prevention pusher 32*a*, the bundle H of 100 paper sheets is held in a standing position, without falling.

And the bundle H of 100 paper sheets accumulated on the accumulation tray 31*b* is prevented from falling by a fall prevention means. The fall prevention means includes a fall prevention pusher, 32*b* and a fall prevention guide 23*b*.

The damaged ticket is conveyed to the accumulation part 30*b* side by the conveyor 21 and the conveyor side wall 22 in a standing position, as mentioned above.

The conveyor 21 and the conveyor side wall 22 arranged on the right-hand side of the conveyor 21 along a conveying direction constitute the accumulation conveyance part of the category selecting unit 20.

Since the conveyor side wall 22 leans only a predetermined angle to the perpendicular direction, the bundle H of 100 paper sheets is conveyed to the predetermined position, contacting the conveyor side wall 22. And the bundle H of 100 paper sheets is pushed into the accumulation part 30*b* by the pushing bar which is not illustrated. As a result, the bundle H of 100 paper sheets is conveyed to the accumulation part 30*b* in a standing position.

The accumulation method of the bundles of 100 paper sheets H to the accumulation parts 30*a* and 30*b* is not restricted to the above-mentioned accumulation method. For example, there is a method of processing only the normal ticket or the damaged ticket individually. In this case, the bundle H of 100 paper sheets is not accumulated on the accumulation tray 31*b* of the accumulation part 30*b* until ten bundles H of 100 paper sheets are accumulated on the accumulation tray 31*a* of the accumulation part 30*a*. When ten bundles H of 100 paper sheets are accumulated on the accumulation tray 31*a*, the bundle H of 100 paper sheets conveyed continuously is accumulated on the accumulation tray 31*b* of the accumulation part 30*b*. In this case, while accumulating the bundle H of 100 paper sheets to the accumulation part 30*b*, the bundles S of 1000 paper sheets accumulated to the accumulation part 30*a* can be handed over to other treating unit in order to perform the next processing.

This method can process the bundles H of 100 paper sheets conveyed continuously by two accumulation parts 30*a* and 30*b*.

Figure 6:
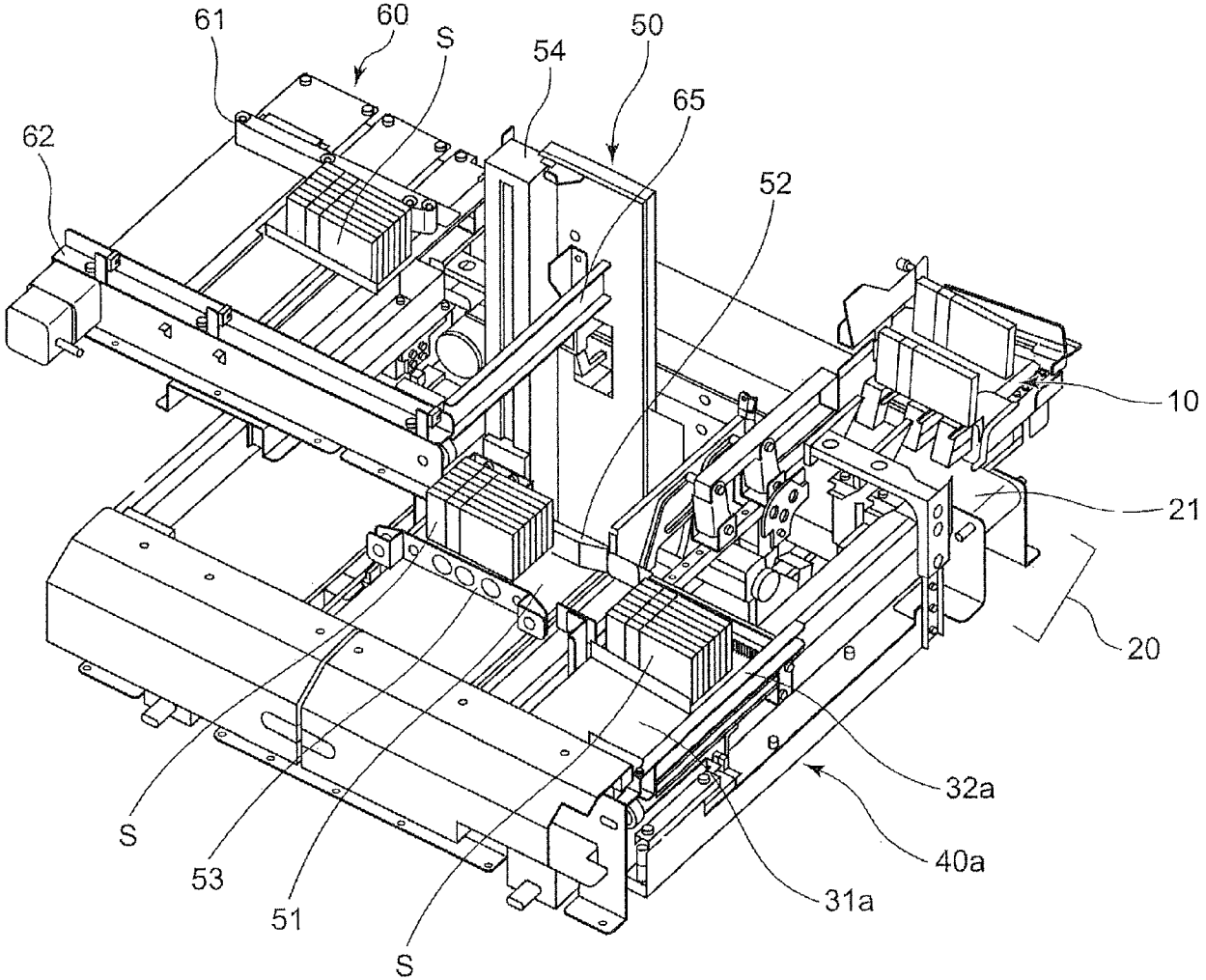
FIG. 6 is a perspective view showing a mechanism which moves accumulated ten bundles of 100 paper sheets to a binding unit.

FIG. 6 illustrates a mechanism which moves the bundle S of 1000 paper sheets to the binding unit 70. The following explains about the normal ticket classified into category A. The damaged ticket classified into category B is moved to the binding unit 70 similarly to the normal ticket.

The bundle H of 100 paper sheets received by the receiving unit 10 as mentioned above is laid on the conveyor 21 of the category selecting unit 20 in the standing position which uses the side edge of a bundle H of 100 paper sheets as the bottom. And then, the bundle H of 100 paper sheets is laid on the accumulation tray 31*a* of the accumulation part 30*a*. When ten bundles H of 100 paper sheets are laid on, the accumulation tray 31*a* moves to the directional change unit 40*a*. FIG. 6 shows a state where the accumulation tray 31*a* on which the bundle S of 1000 paper sheets 1 is laid moved to the directional change part 40*a*.

The bundle S of 1000 paper sheets laid on the accumulation tray 31*a* is passed on, the lift table 51 of the lifter 50 by a pusher 33*a* which is a delivery means.

The bundle S of 1000 paper sheets 2 laid on the lift table 51 is pinched by a guide 52 and a pusher 53, and goes up along the slide rail 54. FIG. 6 shows a state where the bundle S of 1000 paper sheets is laid on the lift table 51.

The following advantage is acquired by raising the bundle of 1000 paper sheets by the lifter 50. (1) Since the binding unit 70 can be arranged to the upper space of the accumulation part 30*b*, the paper sheet bundle wrapping apparatus can be made compact. (2) A portion which accumulates continuously the bundle S of 1000 paper sheets classified for every category, and the binding unit 70 which binds the accumulated the bundle S of 1000 paper sheets together can be driven in parallel. (3) Since the binding unit 70 binds the band around an outer circumference of the bundle S of 1000 paper sheet, the rotating part of the binding unit 70 needs space. This space is secured.

The bundle S of 1000 paper sheets laid on the lift table 51 goes up along the slide rail 54 of the lifter 50.

The bundle S of 1000 paper sheets which went up is passed to the paper sheet bundle conveying unit 60 by the pusher 65. FIG. 6 shows the bundle S of 1000 paper sheets passed to the paper sheet bundle conveying unit 60.

The paper sheet bundle conveying unit 60 arranges a position of the bundle S of 1000 paper sheets to the fixed guide 61 side by the fixed guide 61 and the movable guide 62 as explained with reference to FIG. 4. The bundle S of 1000 paper sheets of which position was arranged is further pushed in by the pusher 65, is conveyed by the paper sheet bundle conveying unit 60, and is supplied to the binding unit 70.

Figure 7:
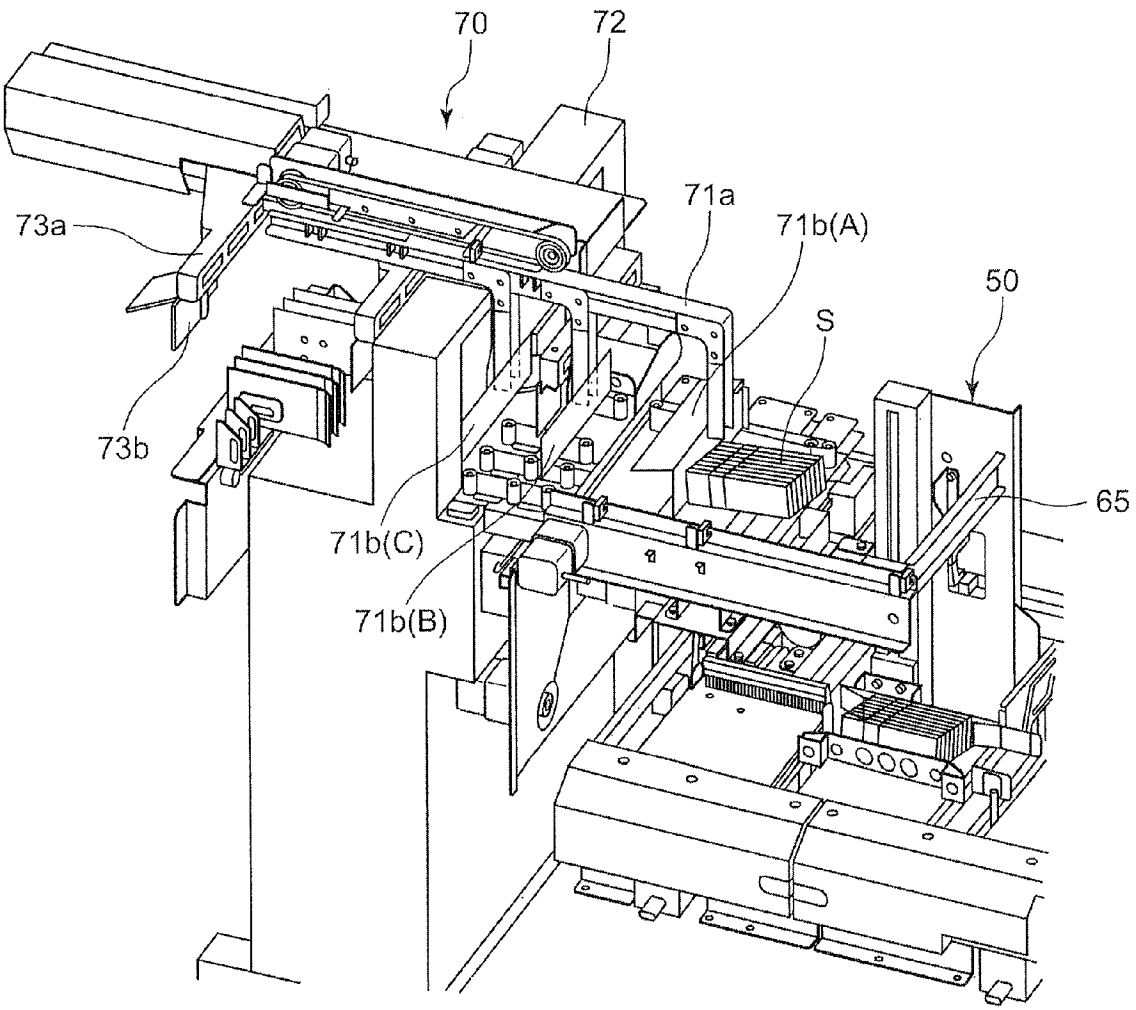
FIG. 7 is a perspective view showing a binding mechanism which binds ten bundles of 100 paper sheets together.

FIG. 7 shows the binding unit 70 which binds the bundle S of 1000 paper sheets together. The binding unit 70 includes a binding machine 72 which binds the bundle S of 1000 paper sheets together, a 1st conveying means which sends the bundle S of 1000 paper sheets to the binding machine 72, and the 2nd conveying means which discharges the bundle S of 1000 paper sheets from the binding unit 70. The 1st conveying means includes an arm 71*a*, and a pusher 71*b* with which the arm 71*a* is provided. The 2nd conveying means includes an arm 73*a*, and a pusher 73*b* with which the arm 73*a* is provided.

The bundle S of 1000 paper sheets passed from the paper sheet bundle conveying unit 60 is pushed out by the pusher 71*b*. When the pusher 71*b* arrives at a predetermined position B, the binding machine 72 binds the bundle S of 1000 paper sheets by the band C1. The position B is called a 2nd binding position. The pusher 71*b* of the 2nd binding position is shown in FIG. 7 by a pusher 71*b* (B). The 2nd binding position is set up so that the band C1 may overlap a part of the band K of each bundle H of 100 paper sheets.

The pusher 71*b* pushes out the bundle S of 1000 paper sheets further. When the pusher 71*b* arrives at predetermined position C, the binding machine 72 binds the bundle S of 1000 paper sheets by the band C2. The position C is called a 3rd binding position. The pusher 71*b* at the 3rd binding position is shown in FIG. 7 by the pusher 71*b* (C).

The band C1 binds the bundle H of 100 paper sheets together so as to overlap a part of the band K which binds the paper sheets together. Thereby, the band K of the bundle H of 100 paper sheets is prevented from being caught in a mechanism inside the apparatus during conveyance of the bundle S of 1000 paper sheets.

The positions of the bands C1, C2 can be set up arbitrarily. In this embodiment, in order to prevent the band K from being caught, the band C1 is arranged so that it may overlap the band K of the bundle H of 100 paper sheets. However, when the band C2 is opaque, the band C2 is arranged in a suitable position in which the band C2 does not hide the pattern of the paper sheet, etc.

Therefore, when the bundle S of 1000 paper sheets is pushed and conveyed at the back end side of the band K, the band K can be prevented from being caught by binding the bundle S of 1000 paper sheets together by the band C1 so that the band C1 may overlap the band K.

In this embodiment, the band C1 can fix the bundle S of 1000 paper sheets, and the band C2 can suppress the change of the thickness of the back end to the thickness of the tip of the bundle S of 1000 paper sheets. Such a binding method became possible by dealing the bundle of 1000 paper sheets in the standing position. When ten bundles H of 100 paper sheets are stacked to a gravity direction, the change of the thickness of the bundle S of 1000 paper sheets becomes large, and a stacked state becomes unstable. In order to prevent this instability, JP, 2008-276751A discloses a method of reversing and laminating the bundles of 100 paper sheets mutually by 5 bundles. However, this method needs an inverting means and a paper sheet bundle wrapping apparatus becomes complicated. In the embodiment, this instability of the stacked bundles of paper sheets is removed by arranging the bundle S of 1000 paper sheets into the standing position.

Next, an arm 73*a* moves to the position on which the bundle S of 1000 paper sheets bound together by the bands C1 and C2 is laid. After a pusher 73*b* contacts a rear end face of the bundle S of 1000 paper sheets, the bundle S of 1000 paper sheets is discharged outside the binding unit 70 with movement of the arm 73*a* in the lower stream of the conveyance.

The bundle S of 1000 paper sheets discharged from the binding unit 70 is further conveyed by a conveying unit, and is shrink-wrapped by the shrink wrapping unit 80 with a transparent sheet. The bundle of 1000 paper sheets shrink-wrapped is discharged from the 1000-sheet bundle discharge unit 85.

Next, the paper sheet bundle conveying unit 60 shown in FIG. 4A will be explained in detail.

When the paper sheets P are the securities, a pattern of a person, for example, is printed on the surface and/or the back of the paper sheet P and a watermark is formed on the right side or the left side of the paper sheet P. In this case, when 100 paper sheets P are laminated to the uniform direction to form the bundle H of 100 paper sheets, the thickness of the portion to which the watermark is given differs from the thickness of the portion to which the printing is given in many cases. If ten bundles H of 100 paper sheets are laid side by side to form the bundle S of 1000 paper sheets, the difference in thickness will be the 10 times difference in thickness of the bundle H of 100 paper sheets.

And there exist a reusable and comparatively new paper sheet called as a normal ticket and a unusable old paper sheet called as a damaged ticket in the paper sheets. Regardless of the existence of the printing or the watermark, the damaged ticket becomes thick by dirt, a folded marks, etc. compared with the normal ticket. The thickness of the bundle of 1000 paper sheets of the normal ticket is about 90 mm, however, the thickness of the bundle of 1000 paper sheets of the damaged ticket may sometime become about 200 mm. That is, the thickness of the bundle S of 1000 paper sheets varies about 2 times according to the quality of the paper sheet.

In the case of the normal ticket, there is few difference between the thickness of the front end part of the bundle of paper sheets which is bound together by the band K and the thickness of the back end portion of the bundle of paper sheets which is not bound together by the band K. However, in the case of the damaged ticket, the difference between the thickness of the end part of the bundle of paper sheets which is bound together by the band K and the thickness of the back end portion of the bundle of paper sheets which is not bound together by a band K becomes large.

As mentioned above, as for the bundle S of 1000 paper sheets, the thickness of the end part of the bundle H of paper sheets which is bound together by the band K differs greatly from the thickness of the back end portion of the bundle H of paper sheets which is not bounded together. The paper sheet bundle conveying unit 60 is required to convey such a bundle S of 1000 paper sheets stably, without the bundle H of 100 paper sheets falling.

Figure 8:
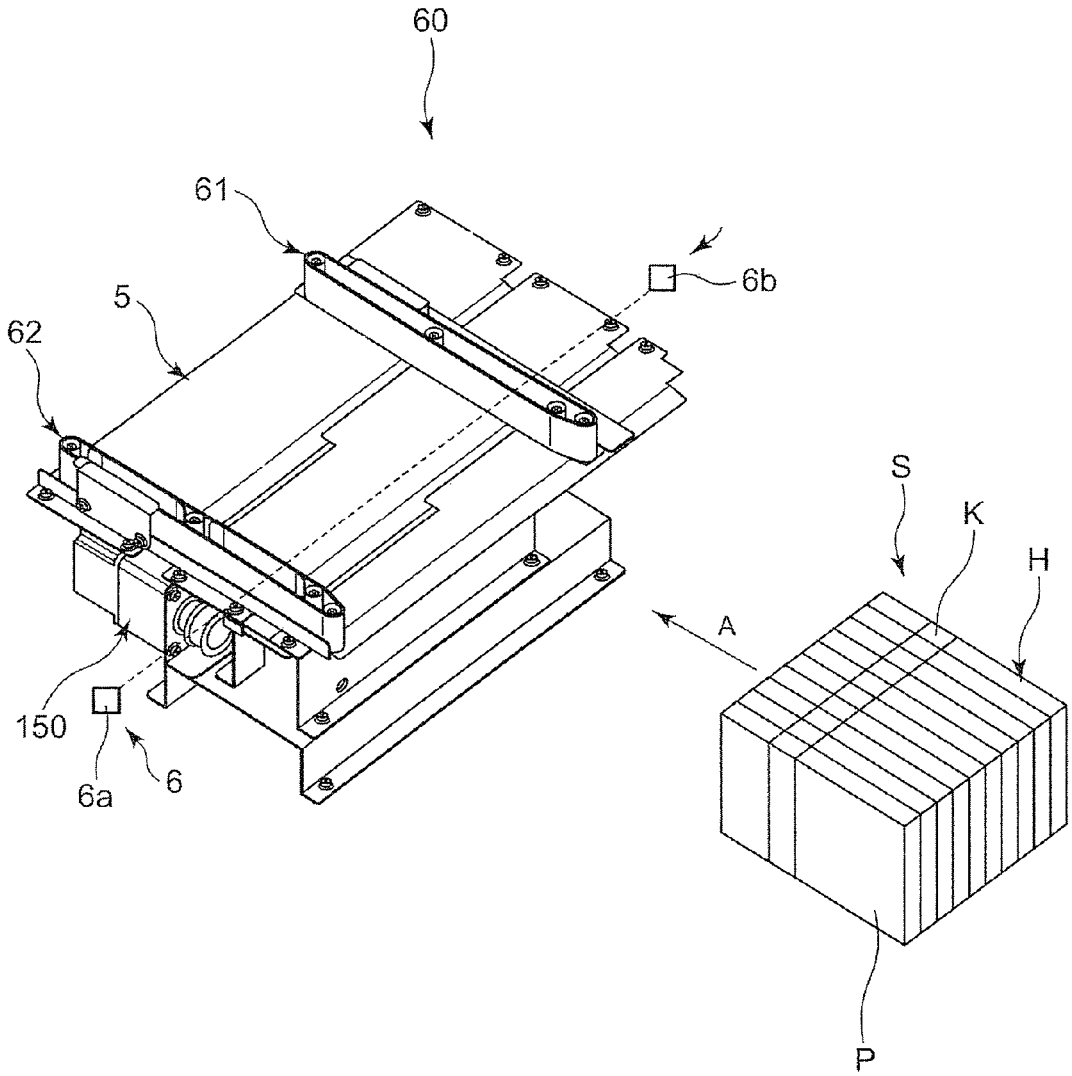
FIG. 8 is a perspective view of a paper sheet bundle conveying unit 60 according to the embodiment.

FIG. 8 is a perspective view of the paper sheet bundle conveying unit 60. The paper sheet bundle conveying unit 60 includes the fixed guide 61, the movable guide 62, a guide opening and closing mechanism unit 150, the conveying table 5, etc.

The bundle S of 1000 paper sheets is pushed out by a pusher in the direction of arrow A, and is supplied on the conveying table 5 of the paper sheet bundle conveying unit 60. The paper sheet bundle conveying unit 60 moves stably the bundle S of 1000 paper sheets supplied, without falling.

In the bundle S of 1000 paper sheets of this embodiment, ten bundles H of 100 paper sheets turn to the same direction, and each bundle H of 100 paper sheets is mutually next to each other. 100 paper sheets P are laminated, are bound together by the band K, such as paper or cellophane, and the bundle H of 100 paper sheets is formed.

This embodiment explains the case where the position of each band K of ten bundles H of 100 paper sheets is, the same.

Figure 9:
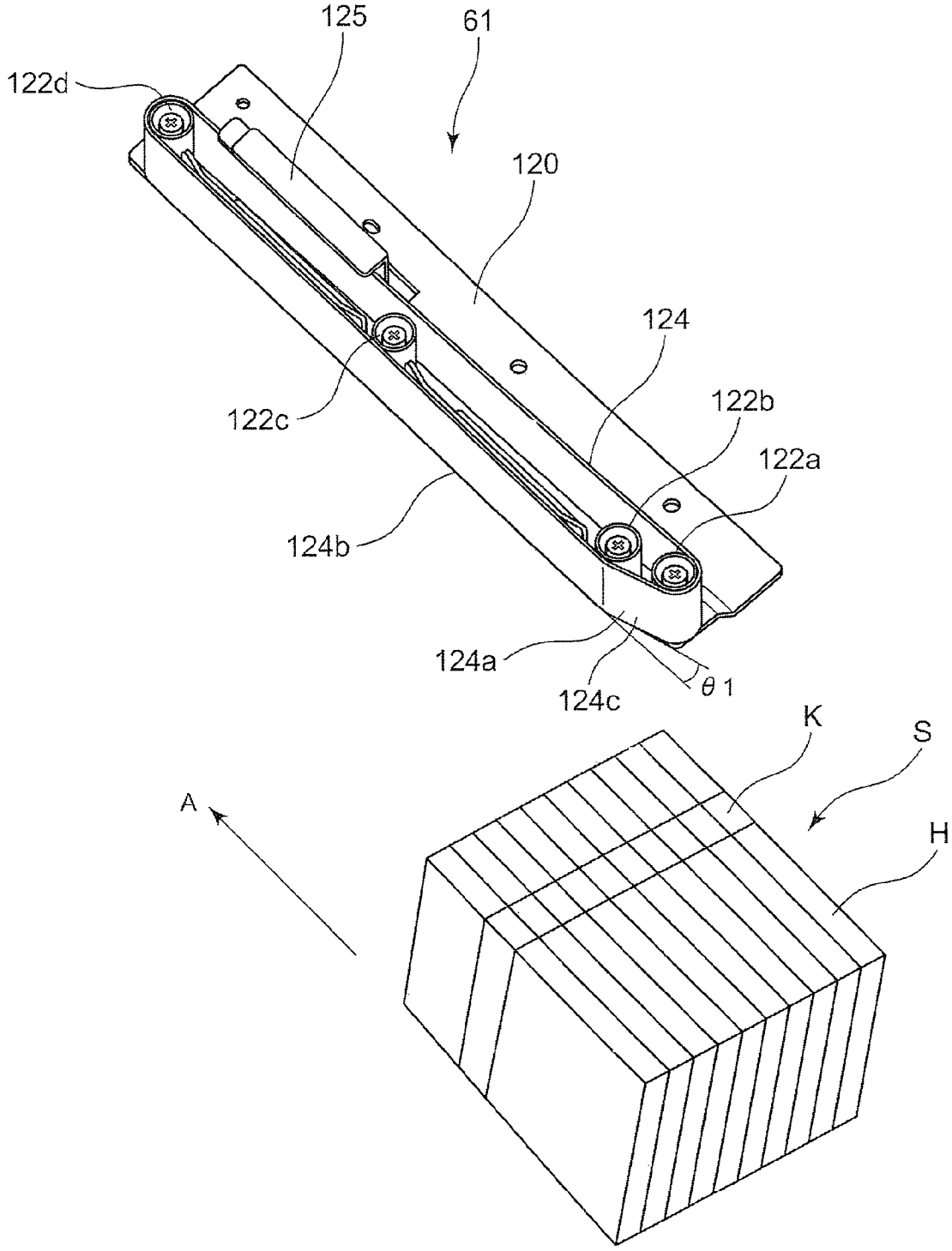
FIG. 9 is a perspective view of a fixed guide 61 shown in FIG. 8.
Figure 10:
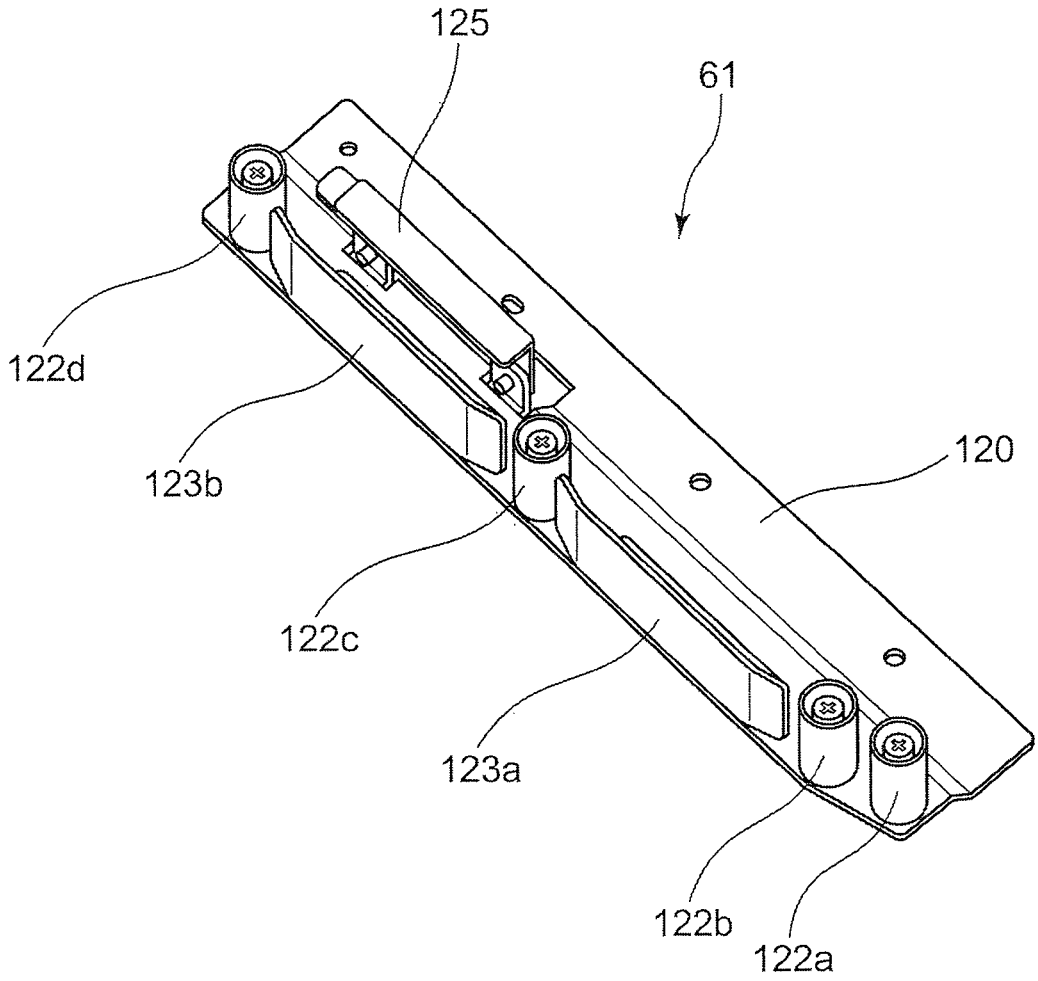
FIG. 10 is a perspective view of the inside of the fixed guide 61 when a belt of the fixed guide 61 shown in FIG. 9 is removed.

FIG. 9 is a perspective view of the fixed guide 61. FIG. 10 is a perspective view of an inside when a belt 124 of the fixed guide 61 shown in FIG. 9 is removed. Hereinafter, the fixed guide 61 will be explained with reference to FIG. 8, FIG. 9, and FIG. 10.

Idle rollers 122*a*-122*d* are arranged on a base 120 along the conveying table 5 which constitutes a carrying path. The belt 124 is hung on the idle rollers 122*a*-122*d*.

Thereby, a receiving section 124*a* and a carrying guide surface 124*b* are formed. The receiving section 124*a* receives the bundle S of 1000 paper sheets, the carrying guide surface 124*b* guides the bundle S of 1000 paper sheets when the bundle S of 1000 paper sheets moves to the lower stream side of the conveying direction.

In the receiving section 124*a*, the idle roller 122*a* is arranged so that a receiving surface 124*c* may open with an aperture angle θ1 to the carrying guide surface 124*b*. In this embodiment, the aperture angle θ1 is 15 degrees. The receiving section 124*a* is called a "receiving section" because the receiving section 124*a* has only the following function. The function is a function which guides so that the receiving section 124*a* may receive the bundle S of 1000 paper sheets and move the bundle S of 1000 paper sheets along the carrying guide surface 124*b* when the bundle S of 1000 paper sheets is pushed out by the pusher and supplied to the receiving section 124*a*. The fixed guide 61 has only a function as a guide fundamentally. The fixed guide 61 does not have a function to take in the bundle S of 1000 paper sheets positively and to convey the bundle S of 1000 paper sheets.

A bend prevention guide 123*a* is arranged between the idle rollers 122*b* and 122*c*, and a bend prevention guide 123*b* is arranged between the idle rollers 122*c* and 122*d*. The bend prevention guides 123*a* and 123*b* restrict bending of the belt 124.

A belt guide 125 is arranged at a return portion of the belt 124, and the belt guide 125 prevents the belt 124 from coming off from the idle rollers 122*a*, 122*b*, 122*c* and 122*d*.

The idle rollers 122*a*, 122*b*, 122*c* and 122*d*, the bend prevention guides 123*a* and 123*b*, and the belt guide 125 are attached to the base 120. The base 120 is fixed to a frame (not shown) which constitutes the paper sheet bundle conveying unit 60.

Figure 11:
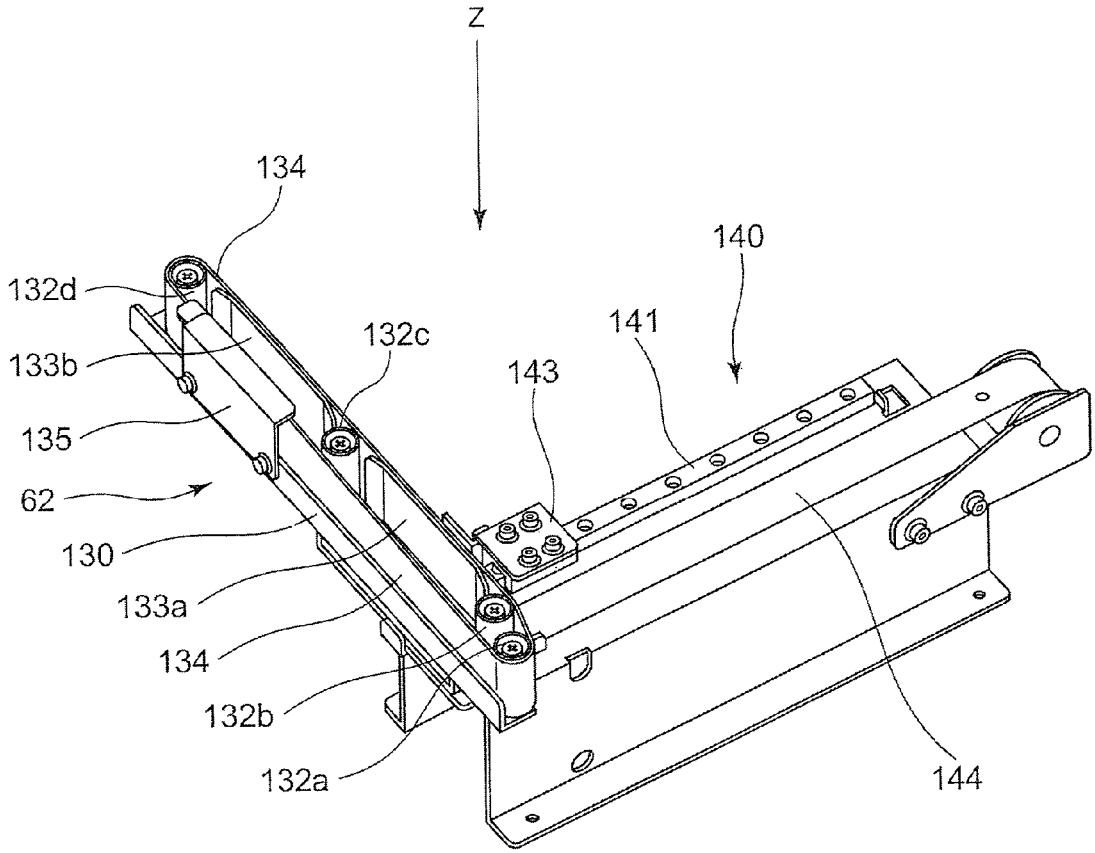
FIG. 11 is a perspective view of a movable guide 62 and a slider unit 140 shown in FIG. 8.
Figure 12:
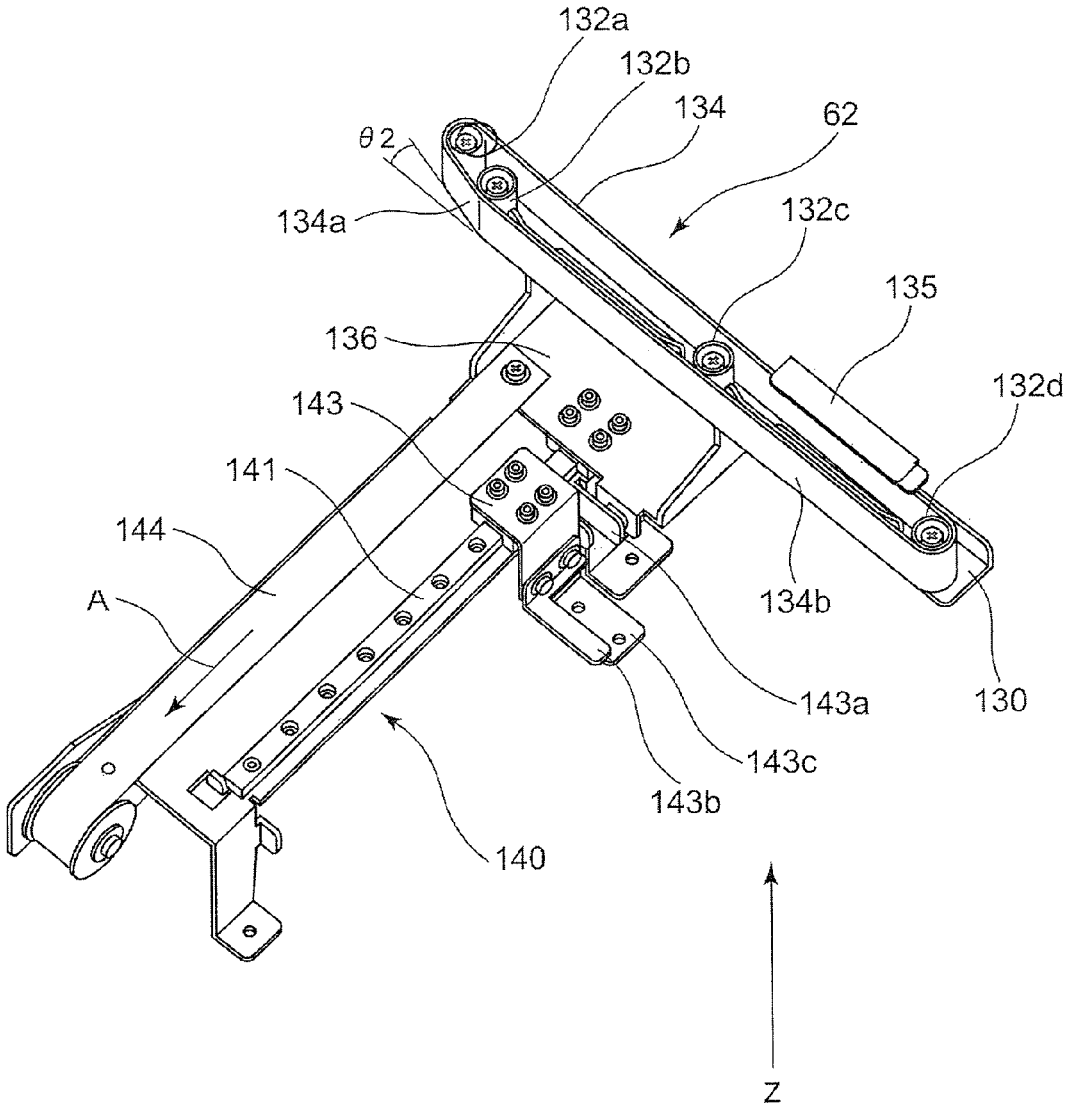
FIG. 12 is a perspective view of the movable guide 62 and the slider unit 140 shown in FIG. 11 which were seen from the direction of arrow Z.
Figure 13:
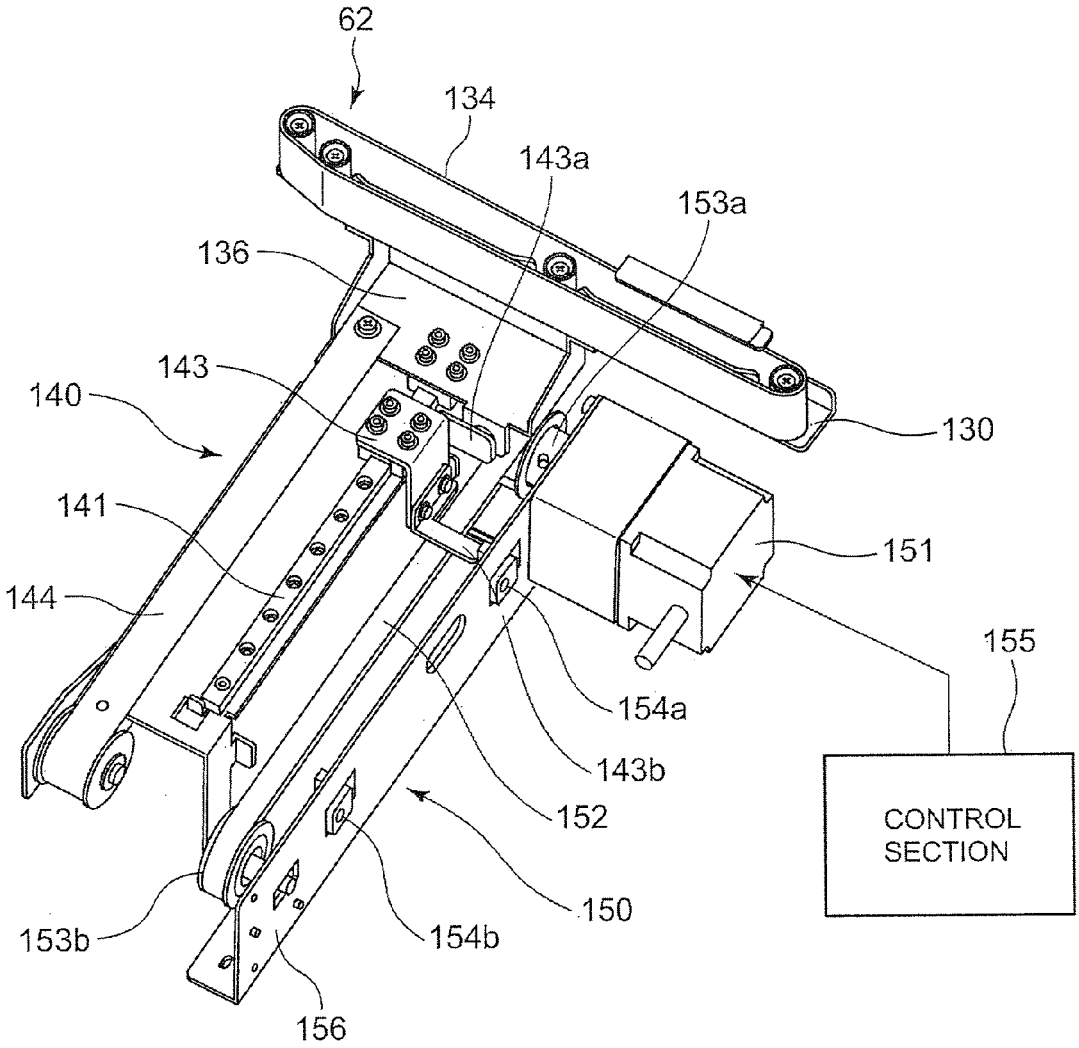
FIG. 13 is a perspective view showing a guide opening/closing mechanism unit 150 which drives a slider 143 of the movable guide 62 shown in FIG. 11.

FIG. 11 is a perspective view of the movable guide 62 and a slider unit 140 showing in FIG. 8. FIG. 12 is a perspective view of the movable guide 62 and the slider unit 140 shown in FIG. 11 viewed from the direction of arrow Z. FIG. 13 is a perspective view illustrating the guide opening and closing mechanism unit 150 which drives a slider 143 shown in FIG. 11. Hereinafter, the movable guide 62 will be explained with reference to these drawings.

The movable guide 62 is arranged so as to counter the fixed guide 61 via the conveying table 5. The movable guide 62 moves forward and backward toward the fixed guide 61 in connection with the slider 143 being controlled by a control section 155.

The movable guide 62 presses the bundle S of 1000 paper sheets received between the movable guide 62 and the fixed guide 61 to the fixed guide 61 side, and pinches the bundle S of 1000 paper sheets with the fixed guide 61. The movable guide 62 guides the bundle S of 1000 paper sheets so that the bundle S of 1000 paper sheets may move toward the lower stream of a transportation direction from the upper stream of the transportation direction.

The movable guide 62 is constituted as a mirror image of the fixed guide 61 in order to pinch and convey the received bundle S of 1000 paper sheets. That is, as shown in FIG. 12, a receiving section 135 and a carrying guide surface 136 of the movable guide 62 are constituted like the receiving section 124*a* and the carrying guide surface 124*b* of the fixed guide 61 respectively. Therefore, an aperture angle θ2 of the receiving section 134*a* of the movable guide 62 is set as 15 degrees like the aperture angle θ1 of the fixed guide 61.

The idle rollers 132*a*, 132*b*, 132*c* and 132*d* are arranged on a base 130 toward the lower stream of the transportation direction from the receiving section 134*a*. A belt 134 is hung on the idle rollers 132*a*, 132*b*, 132*c* and 132*d*.

A bend prevention guide 133*a* is arranged between the idle rollers 132*a* and 132*b*, and the bend prevention guide 133*b* is arranged between idle rollers 132*c* and 132*d*. A belt guide 135 is arranged at the return portion of the belt 134.

The idle rollers 132*a*, 132*b*, 132*c* and 132*d*, the bend prevention guides 133*a* and 133*b*, and the belt guide 135 are attached to the base 130 like the fixed guide 61.

The base 130 is fixed to an arm 136. The arm 136 is attached to a slide rail 141 so that the arm 136 may perform a straight-line motion to the slide rail 141. Thereby, the base 130 is connected with the slide rail 141 slidably, and the movable guide 62 can perform a straight-line motion to the slide rail 141. The slide rail 131 is arranged in the direction which intersects perpendicularly with the carrying guide surface 124*b* of the fixed guide 61.

The arm 136 is pulled toward the fixed guide 61 by a constant force spring 144 arranged in parallel with the slide rail 141. Thereby, the movable guide 62 is always pulled by a constant load in the direction to the fixed guide 61. The constant force spring 144 constitutes an energizing means.

The slider 143 is arranged at the lower stream side of a pulling direction rather than the position where the arm 136 is connected with the slide rail 141. The slider 143 includes a guide stopper 143*a*, a detection plate 143*b* to detect the position of the slider 143 and an attaching part 143*c*. The slider 143 is driven by the guide opening and closing mechanism unit 150, and performs the straight-line motion to the slide rail 141.

As shown in a FIG. 13, the guide opening and closing mechanism unit 150 includes a base 156, a motor 151 as a driving source, a pulley 153*a* attached to a rotational shaft of the motor 151*a*, a timing belt 152, a pulley 153*b* fixed to a base 156.

The timing belt 152 is a ring shape endless belt hung on the pulley 153*a* and the pulley 153*b*. The slider 143 is attached to the timing belt 152 by the attaching part 143*c*.

The control section 155 controls the motor 151 to rotate to a forward direction and a reverse direction. The slider 143 moves free along the slider rail 141 by this control.

When the slider 143 moves with movement of the timing belt 152, the guide stopper 143*a* moves and the arm 136 positioned by the guide stopper 143*a* also moves.

And the movable guide 62 moves with movement of the arm 136.

Figure 14:
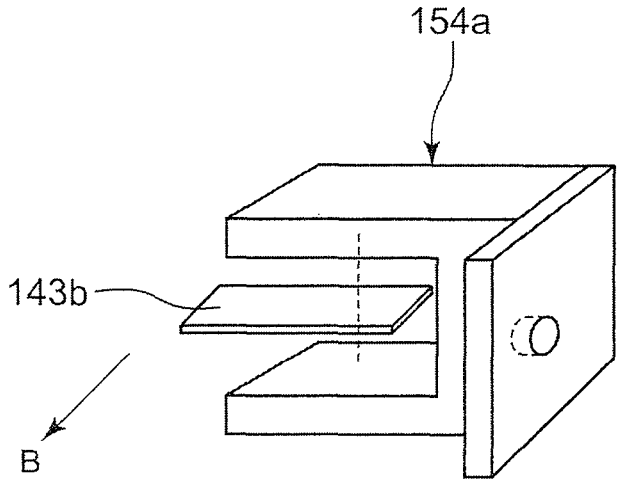
FIG. 14 is a perspective view of a slider detection sensor 154*a* shown in FIG. 13.

FIG. 14 is a perspective view of a slider detection sensor 154*a* which detects a position of the slider 143 shown in FIG. 13. The position of the slider 143 is detected by detecting the detection plate 143*b*. The slider detection sensor 154*a* includes a light emitting unit which emits light and a light receiving unit which receives the light. When the detection plate 143*b* intercepts the light which the light emitting unit emits and the light receiving unit stops receiving the light, the slider detection sensor 154*a* detects the slider 143. In this embodiment, the slider detection sensors 154*a* and 154*b* are arranged in the direction of movement of the slider 143 at two places. When the slider detection sensors 154*a* and 154*b* detect the detection plate 143*b* during the movement of the slider 143, the control section 155 stops the movement of the slider 143.

When the slider 143 moves to the fixed guide 61 side until the slider detection sensor 154*b* detects the detection plate 143*b*, the movable guide 62 moves to the fixed guide 61 side and the carrying guide surface 134*b* presses the bundle S of 1000 paper sheets. For this reason, the movable guide 62 and the arm 136 suspend movement. Thereby, the guide stopper 143*a* of the slider 143 leaves the arm 136 and the guide stopper 143*a* is released from the energizing force from the arm 136.

In the paper sheet bundle conveying unit according to this embodiment, the position of the slider detection sensor 154*b* is decided so that the guide stopper 143*a* may not receive the energizing force from the arm 136 even when the thickness of the bundle S of 1000 paper sheets to be conveyed is the thinnest.

Figure 15:
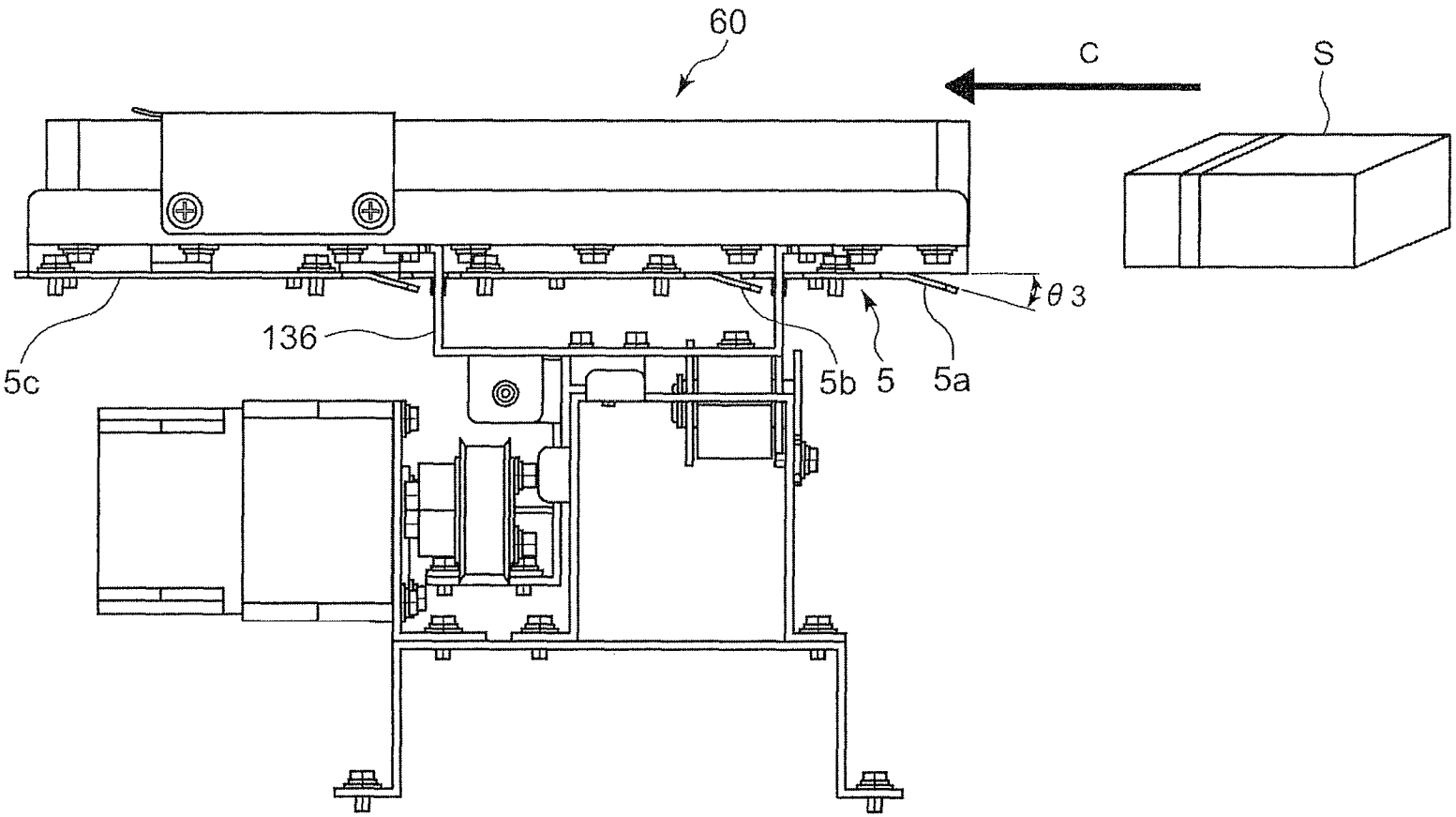
FIG. 15 is a side view of the paper sheet bundle conveying unit 60.
Figure 16:
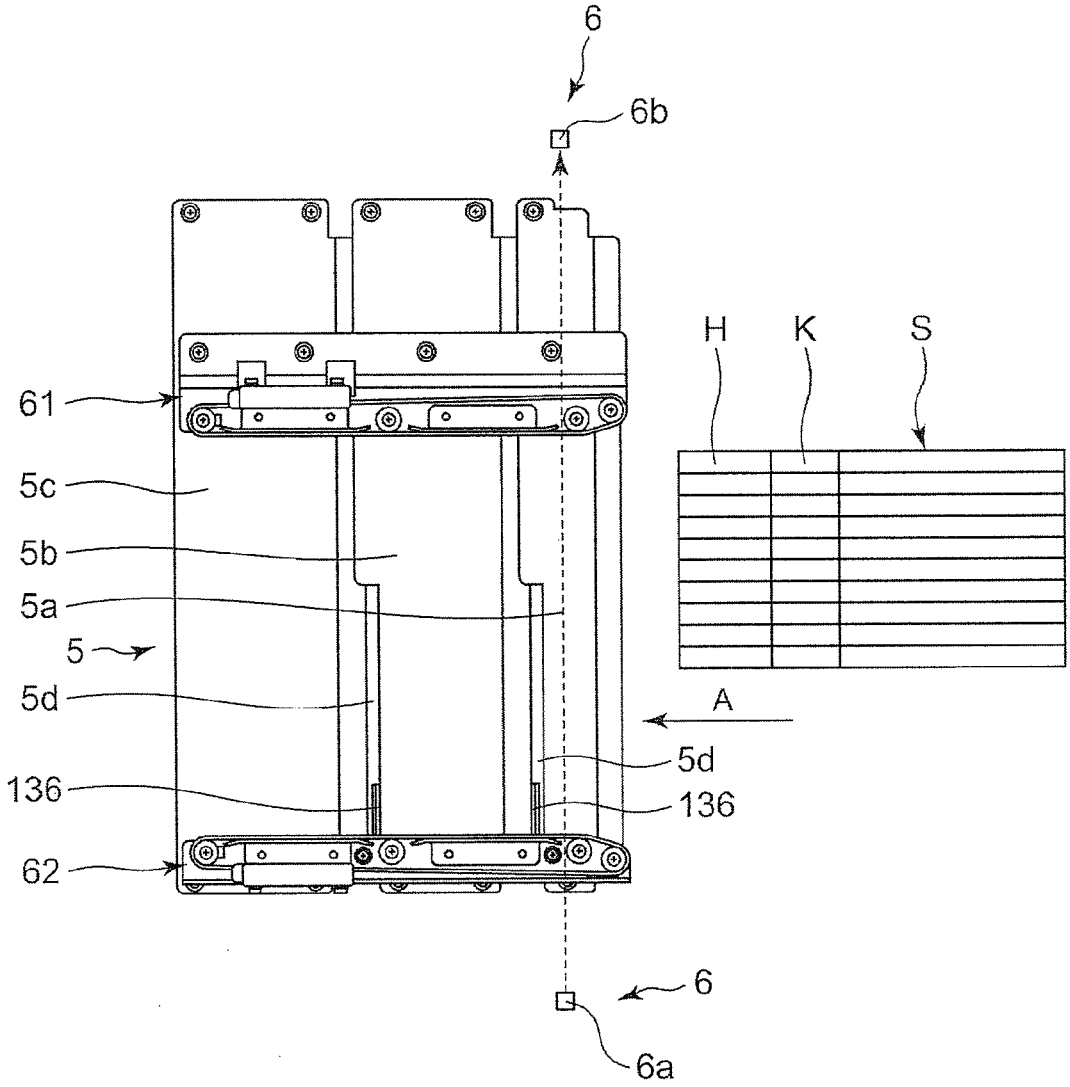
FIG. 16 is a top view of a conveying table 5, and illustrates a state before the movable guide 62 moves.
Figure 17:
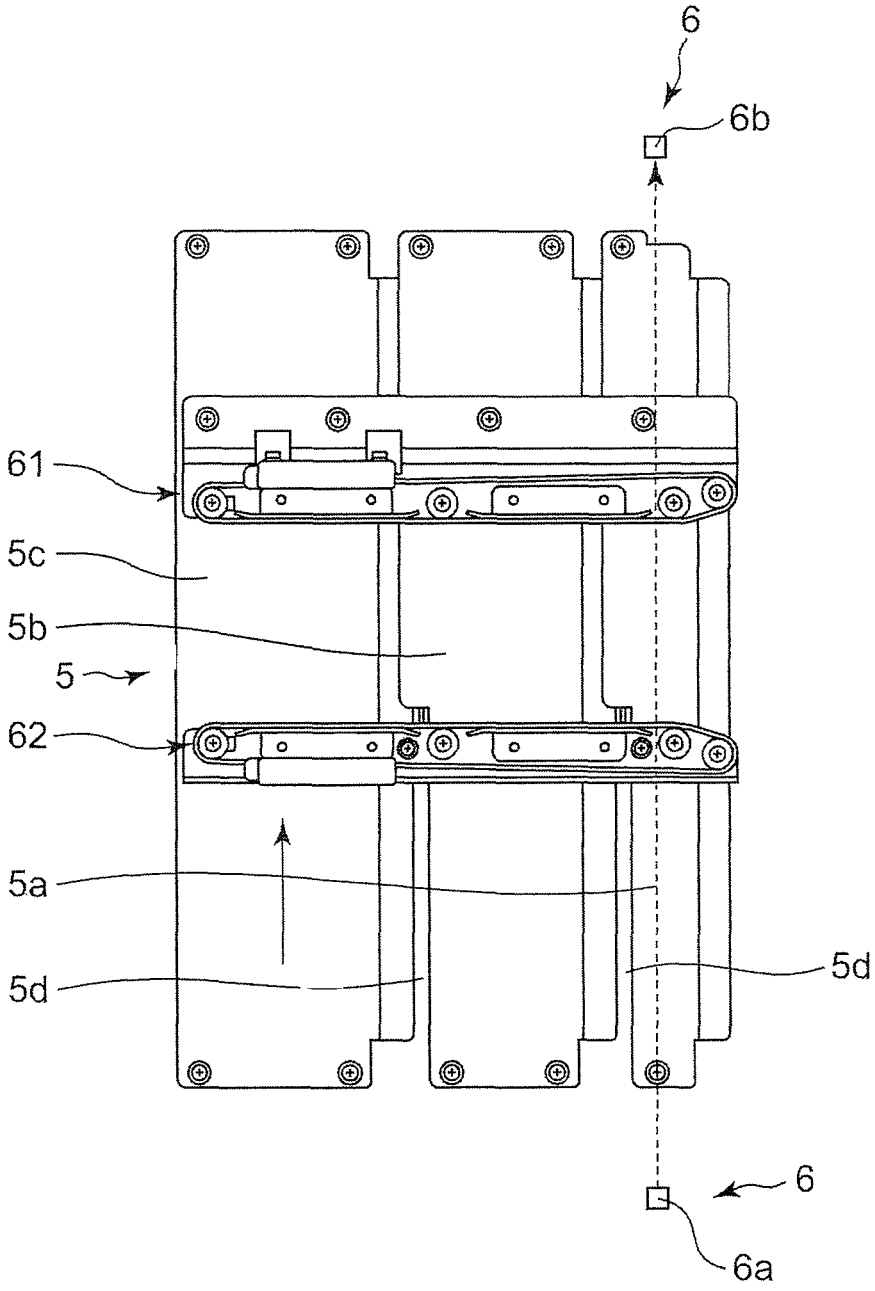
FIG. 17 is a top view of the conveying table 5 shown in FIG. 16, and illustrates a state that the movable guide 62 moved.

FIG. 15 is a side view of the paper sheet bundle conveying unit 60 in which the conveying table 5 was built. FIG. 16 is a top view of the conveying table 5, and shows a state before the movable guide 62 moves. FIG. 17 is a top view of the conveying table 5, and shows a state where the movable guide 62 moved from the position shown in FIG. 16.

A weight of the bundle S of 1000 paper sheets is about 1 kg. The conveying table 5 needs not to be bent by the weight of the bundle S of 1000 paper sheets unlike the conveyor belt. Since the bottom of the bundle S of 1000 paper sheets contacts the surface of the conveying table 5, the surface of the conveying table 5 is desired to have a small coefficient of friction and to be hard. In this embodiment, the conveying table 5 includes metallic guide plates 5*a*, 5*b*, 5*c* in consideration of the above thing. The conveying table 5 may use the guide plates 5*a*, 5*b*, 5*c* which have a Teflon (registered trademark) sheet or a plastic sheet on its surface.

The guide plates 5*a*-5*c* are longer than the thickness of the bundle S of 1000 paper sheets. As for the guide plates 5*a*, 5*b*, 5*c*, end portions of upper stream side of the conveying direction are bent below at an angle of θ3, respectively. In this embodiment, θ3 is 15 degrees. Thereby, when the bundle S of 1000 paper sheets is conveyed from the receiving sections 124*a* and 134*a* to the lower stream side of the conveyance, the tip end of the bundle S of 1000 paper sheets is prevented from being caught in knots of the guide plates 5*a*, 5*b*, 5*c*.

Gaps 5*d*, 5*d* are formed between the guide plates 5*a* and 5*b* and between the guide plates 5*b* and 5*c*, and the arm 136 moves in the gaps 5*b*, 5*d*. The movable guide 62 moves with the movement of the arm 136.

FIG. 16 shows a state where the movable guide 62 is in a home position. A distance between the fixed guide 61 and the movable guide 62 is large, and the movable guide 62 is in a state before receiving the bundle S of 1000 paper sheets. FIG. 17 shows a state where the movable guide 62 has moved toward the fixed guide 61 after the bundle S of 1000 paper sheets was detected by a paper sheet bundle detection sensor 6.

In FIG. 17, the bundle S of 1000 paper sheets is omitted. The paper sheet bundle detection sensor 6 includes the light emitting unit 6*a* and the light receiving unit 6*b*.

FIG. 18-FIG. 22 are state transition diagrams for explaining operation of the paper sheet bundle conveying unit 60. A series of operations is controlled by the control section 155.

Figure 18:
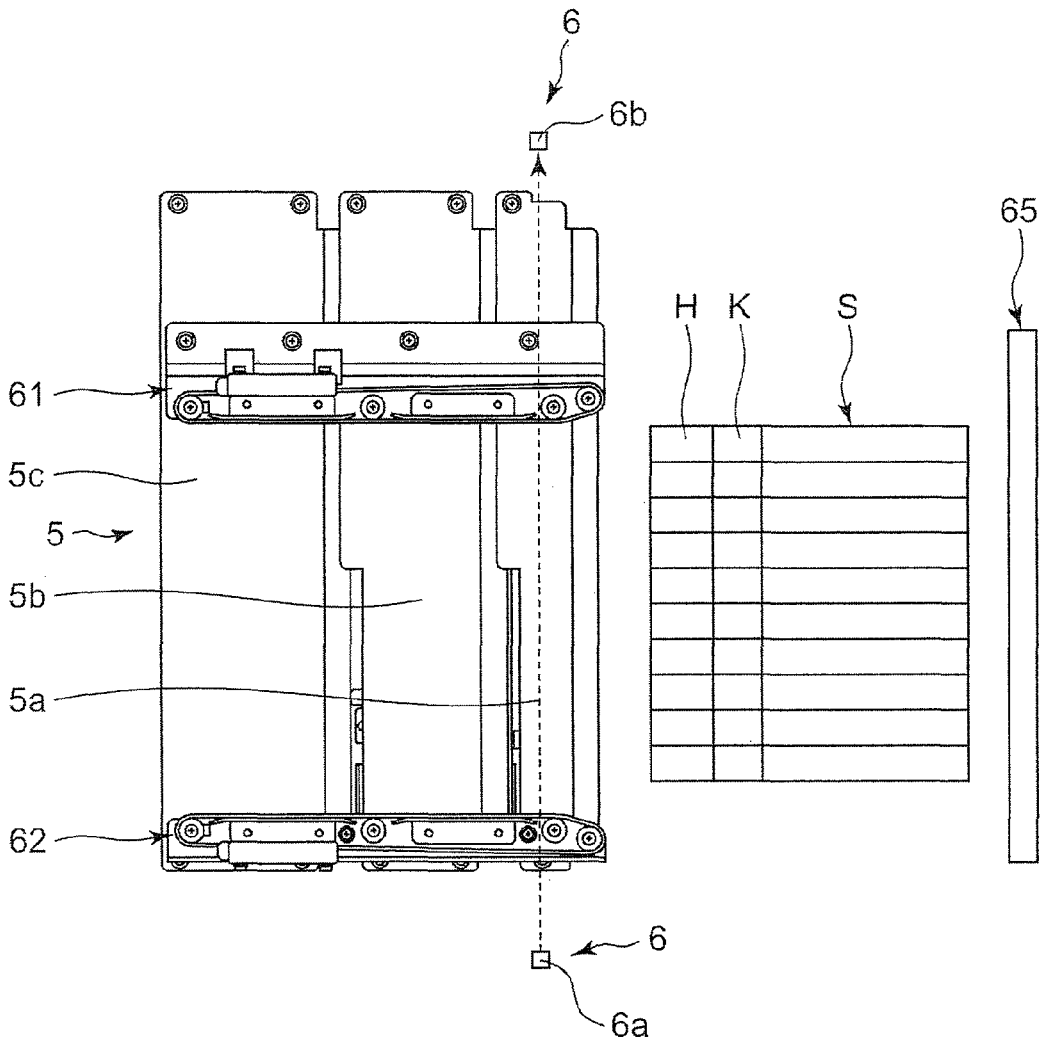
FIG. 18 illustrates a state before ten bundles H of 100 paper sheets are detected by a paper sheet bundle detection sensor.

FIG. 18 shows a state before the bundle S of 1000 paper sheets is detected by the paper sheet bundle detection sensor 6. The movable guide 62 is in a waiting state.

In this state, the distance between the movable guide 62 and the fixing guide 61 is the largest.

Figure 19:
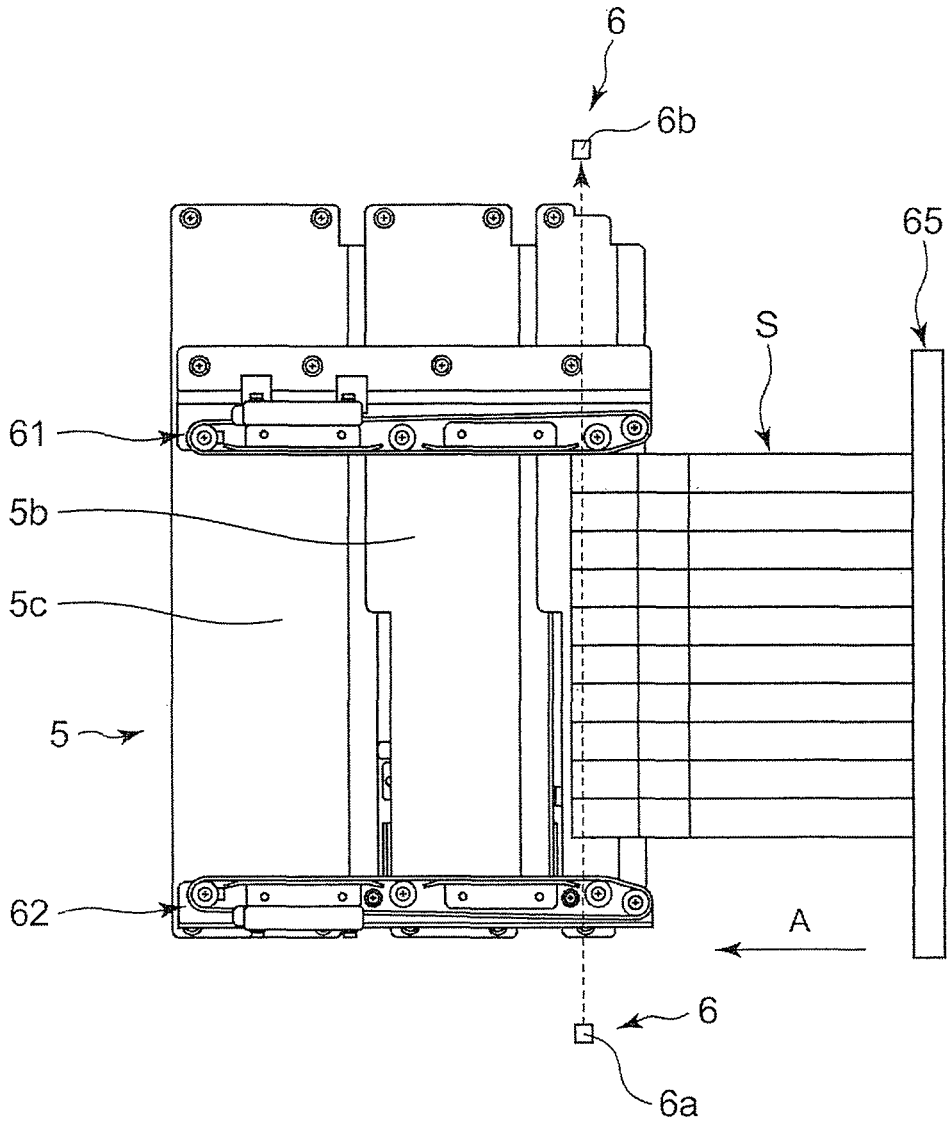
FIG. 19 illustrates a state where ten bundles H of 100 paper sheets were pushed in by a pusher 65, and were detected by the paper sheet bundle detection sensor.

FIG. 19 shows a state where the bundle S of 1000 paper sheets was pushed in by the pusher 65 and the tip end part of the bundle S was detected by the paper sheet bundle detection sensor 6. Hereinafter, the operation is shown in (1)-(3) in order.

(1) First, the pusher 65 pushes out the bundle S of 1000 paper sheets in the direction of arrow A.

(2) The pusher 65 stops pushing out the bundle S of 1000 paper sheets when the paper sheet bundle detection sensor 6 detects the bundle S of 1000 paper sheets.

(3) The control section 155 drives the motor 151 of the guide opening and closing mechanism unit 150, and moves the slider 143 to the fixed guide 61 side along the slide rail 141. Thereby, the arm 136 moves with the movement of the slider 143. The movable guide 62 attached to the arm 136 also moves toward the fixed guide 61 side.

Figure 20:
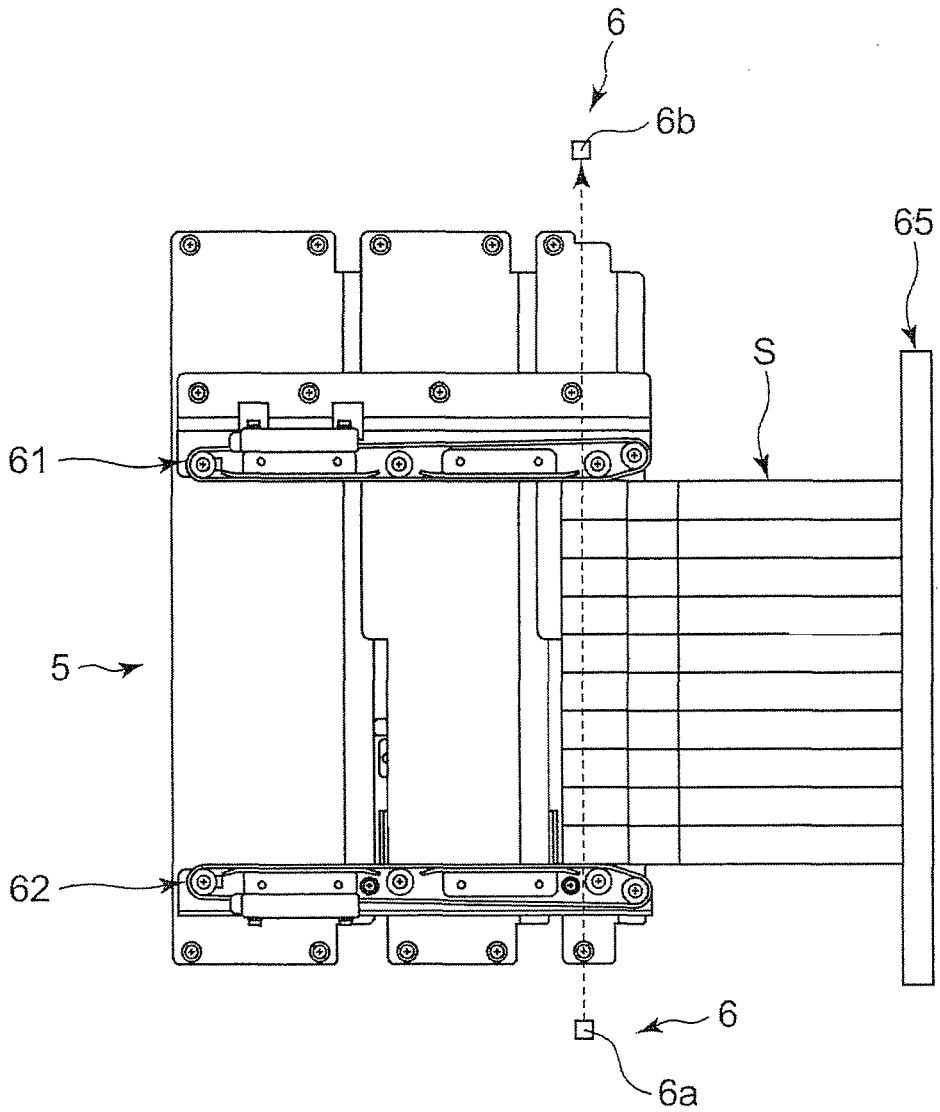
FIG. 20 illustrates a state where the movable guide 62 moved and ten bundles H of 100 paper sheets were pinched between the fixed guide 61 and the movable guide 62.

FIG. 20 shows a state where the movable guide 62 has moved further from the state of the above (3), and the bundle S of 1000 paper sheets is pinched by the fixed guide 61 and the movable guide 62. In this state, the movable guide 62 presses the bundle S of 1000 paper sheets to the fixed guide 61 side by the constant force spring 144.

On the other hand, the slider 143 moves until the detection plate 143*b* is detected by the slider detection sensor 154*b*. The control section 155 stops the motor 151 when the slider detection sensor 154*b* detects the detection plate 143*b*.

At this time, the guide stopper 143*a* moves until the slider detection sensor 154*b* detects the detection plate 143*b*, but a position which the movable guide 62 stops varies depending on the thickness of the bundle S of 1000 paper sheets. The guide stopper 143*a* moves until the slider detection sensor 154*b* detects the detection plate 143*b*.

In this embodiment, since the constant force spring 144 is used in order to press the bundle S of 1000 paper sheets, the fixed guide 61 and the movable guide 62 can always pinch the bundle S of 1000 paper sheets by fixed force even when the thickness of the bundle S of 1000 paper sheets changes.

Figure 21:
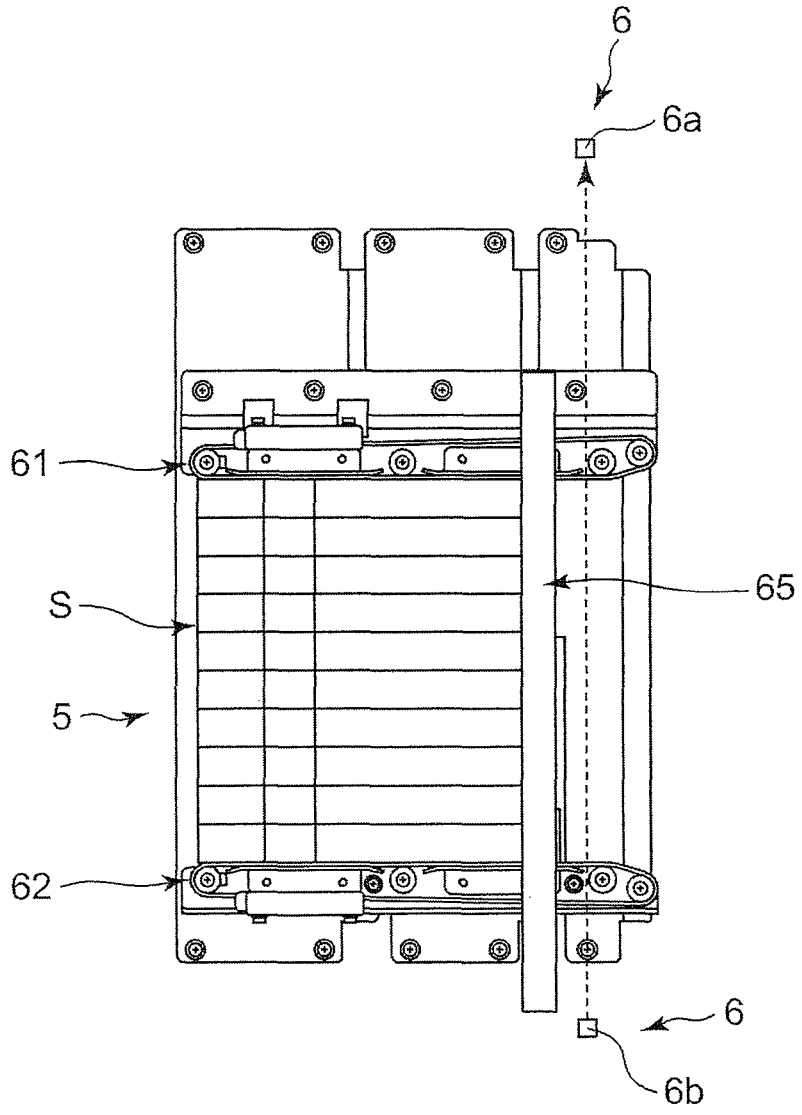
FIG. 21 illustrates a state where ten bundles H of 100 paper sheets pinched by the fixed guide 61 and the movable guide part 2*a* are pushed and conveyed by the pusher 65.

FIG. 21 shows a state where the bundle S of 1000 paper sheets pinched by the fixed guide 61 and the movable guide 62 is being conveyed by the pusher 65. In this state, the movable guide 62 pushes the bundle S of 1000 paper sheets to the fixed guide 61 side with the constant force spring 144 at predetermined force. However, since the belts 124, 134 which constitute the carrying guide surfaces 124*b*, 134*b* where the paper sheet bundle s of 1000 sheets touches are hung on the idle rollers, rotational load of the belts 124, 134 is small and the bundle S of 1000 paper sheets is easily pushed out by the pusher 65 to the lower stream of the conveying direction.

Figure 22:
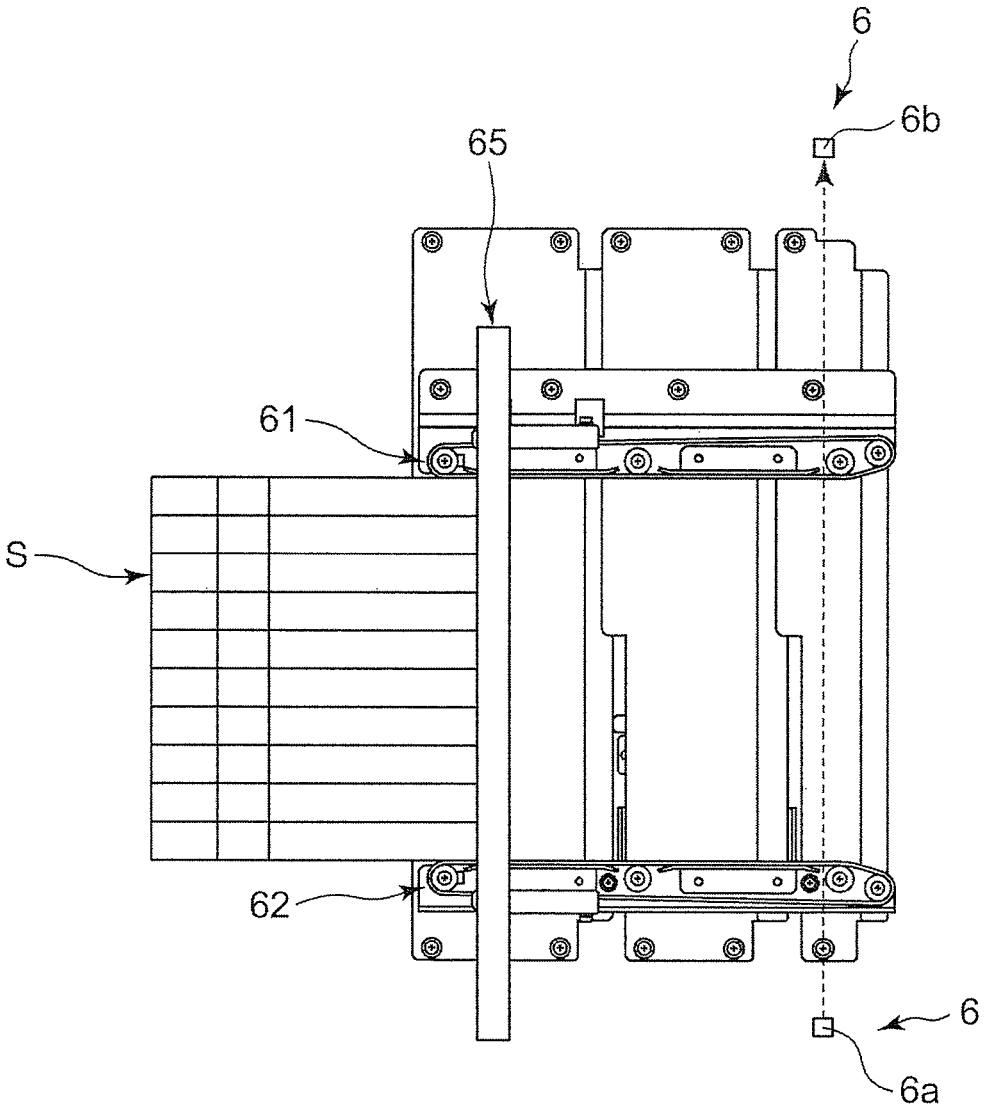
FIG. 22 illustrates a state where ten bundles H of 100 paper sheets pinched by the fixed guide 61 and the movable guide 62 are discharged from the conveying table.

FIG. 22 shows a state where the bundle S of 1000 paper sheets pinched by the fixed guide 61 and the movable guide 62 is discharged from the conveying table 5.

When the bundle S of 1000 paper sheets is discharged, the pusher 65 returns to an original position in order to process a following bundle S of 1000 paper sheets, as shown in FIG. 18. And the control section 155 rotates the motor 151 to a reverse direction and moves the slider 143 until the slider detection sensor 154*a* detects the detection plate 143*b*. Thereby, the slider 143 returns to the original position.

According to the paper sheet bundle conveying unit mentioned above, the effective result of following (1)-(3) is acquired.

(1) Even when the thickness of the bundle S of 1000 paper sheets changes depending the normal ticket or the damaged ticket, the paper sheet bundle conveying unit pinches and conveys the bundle S of 1000 paper sheets according to the thickness.

(2) Since the paper sheet bundle conveying unit pinches and conveys the bundle S of 1000 paper sheets unbound, the paper sheet bundle conveying unit can convey the bundle S of 1000 paper sheets in a standing position, without causing collapse.

(3) According to the paper sheet bundle conveying unit 60 shown in FIG. 8, the surface of the conveying table in contact with the bottom of the bundle S of 1000 paper sheets is formed with a hard material having a small coefficient of friction, and the belts 124, 134 performs guide conveyance to the conveying direction. For this reason, even when the weight of the bundle S of 1000 paper sheets is heavy, the paper sheet bundle conveying unit can convey the bundle S of 1000 paper sheets with a light load.

Although the embodiment explained the case where the bundle S of 1000 paper sheets was conveyed, the paper, sheet bundle conveying unit according to the embodiment can convey a bundle of 500 paper sheets. The paper sheet bundle conveying unit of the embodiment is applicable also to the paper sheet bundle conveying unit which conveys the paper sheet bundle of the number of sheets which exceeds 1000 sheets.

As explained above, in the paper leaf processing system of this embodiment, the paper sheet bundle wrapping, apparatus receives the bundle of paper sheets discharged from paper sheet processing apparatus irrespective of the category of the bundle of paper Sheets. And then, the paper sheet bundle wrapping apparatus classifies the bundle of paper sheets according to the category of the bundle of paper sheets, and accumulates the bundle of paper sheets. And when a predetermined number of the bundle of paper sheets are accumulated for every category, the paper sheet bundle processing apparatus binds the predetermined number of the bundles of paper sheets together by the binding unit. For this reason, the usage rate of the paper sheet bundle processing apparatus becomes high compared with the prior art.

According to this embodiment, irrespective of the difference between the thickness of the bound portion of the bundle H of 100 paper sheets discharged from paper sheet processing apparatus and the thickness of its other portion, the paper sheet bundle wrapping apparatus arranges the band K in a uniform direction for every category, accumulates ten bundles H of 100 paper sheets in the standing position where the side edge face is used as a bottom, and binds the accumulated the bundle S of 1000 paper sheets together.

As carried out conventionally, when ten bundles H of 100 paper sheets are stacked to form the bundle of 1000 paper sheets, since the quality of the paper sheet or the thickness of the paper sheet is not uniform, the bundle of 100 paper sheets needs to be reversed for every the bundles of 500 paper sheets and stacked. However, when ten bundles of 100 paper sheets are accumulated in the standing position like the present invention, unstable factors of mounting position by the difference in thickness when ten bundles of 100 paper sheets are stacked are removed. Therefore, the paper sheet bundle wrapping apparatus of the system according to this embodiment can bind ten bundles H of 100 paper sheets together at two places in a state that the bands K of the bundles of 100 paper sheets has turned to the uniform direction.

The bundle S of 1000 paper sheets of which each band K of the bundle H of 100 paper sheets has turned to a uniform direction suits liking of a user of the bundle of 1000 paper sheets.

Modification

Figure 23:
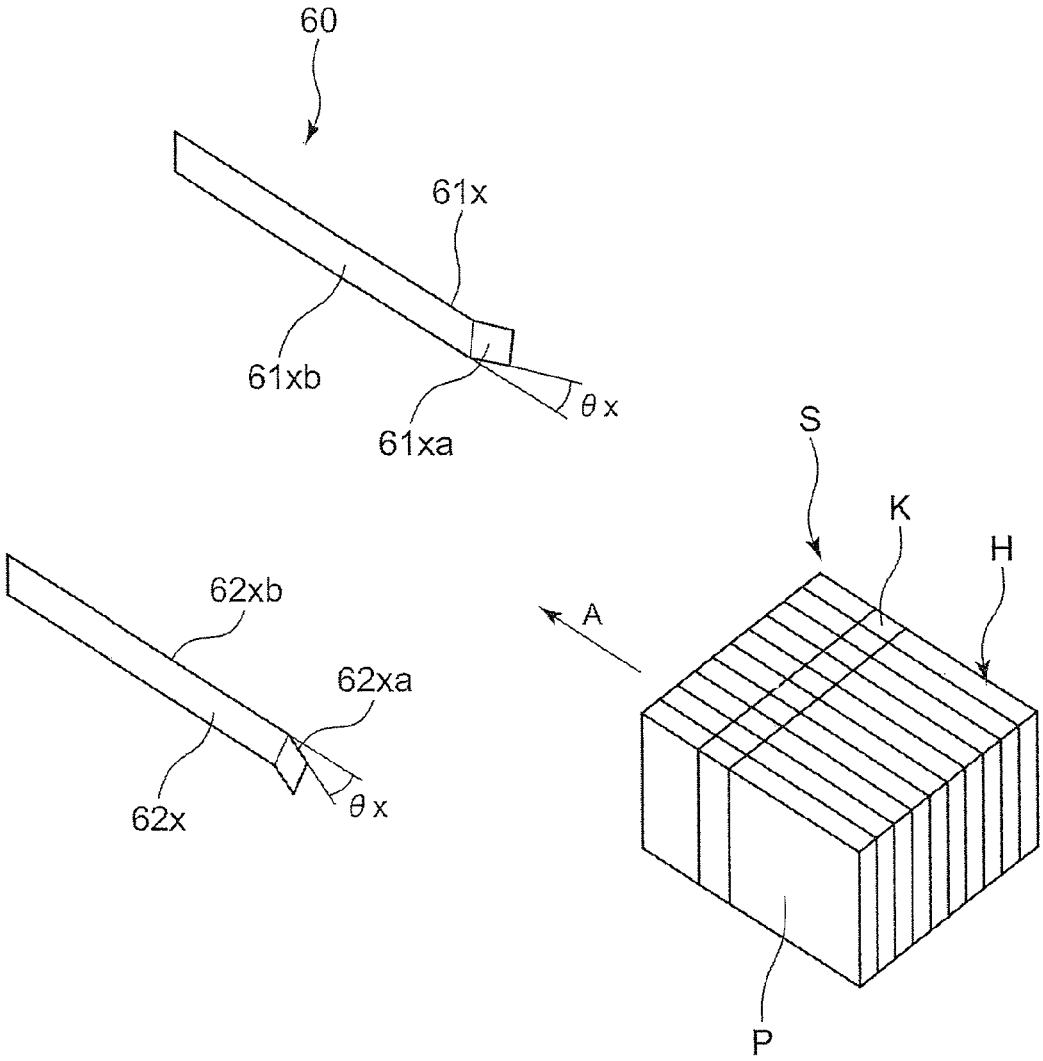
FIG. 23 illustrates an main portion of the paper sheet bundle conveying unit 60 using a fixed guide 61*x* and a movable guide 62*x* according to another embodiment.

FIG. 23 shows a modification of the paper sheet bundle conveying unit 60. Since the construction other than a fixed guide 61*x* and a movable guide 62*x* is the same as that of the above-mentioned embodiment, explanation of the same portion is omitted and a different portion is explained.

Unlike the fixed guide 61 shown in FIG. 9 or FIG. 10, the fixed guide 61*x* does not have any idle roller and a belt. The fixed guide 61*x* is a plate. Aperture angle θx of a receiving section 61*xa* is the same as the aperture angle θ of the receiving section 124*a* of the fixed guide 61 of the embodiment mentioned above. The fixed guide 61*x* has a substrate and the low frictional resistance material provided at the portion to which the bundle S of 1000 paper sheets contacts. The low frictional resistance material is provided by attaching or applying on a surface of the substrate. For example, the receiving section 61*xa* and a carrying guide surface 61*xb* of the fixed guide 61*x* have a Teflon sheet attached on the surface of the substrate.

Unlike the movable guide 62 shown in FIG. 11 or FIG. 12, the movable guide 62*x* does not have any idle roller and a belt. The movable guide 62*x* is a plate. Aperture angle θx of a receiving section 62*xa* is the same as the aperture angle θ of the receiving section 134*a* of the movable guide 62. The movable guide 62*x* has a substrate and the low frictional resistance material provided at the portion to which the bundle S of 1000 paper sheets contacts. The low frictional resistance material is provided by attaching or applying on a surface of the substrate. The Teflon sheet mentioned above can be used as the low frictional resistance material.

The paper sheet bundle conveying unit of this modification can acquire the same effective result as the paper sheet bundle conveying unit of the embodiment mentioned above. Accordingly the paper sheet processing system which uses the paper sheet bundle conveying unit of this modification also performs the same effective result as the embodiment 1.

Embodiment 2

In the paper sheet processing system of the embodiment 1, when failure occurs in the paper sheet bundle wrapping apparatus 1 while the paper sheet processing apparatus 100 processes, the failure of the paper sheet bundle wrapping apparatus 1 may expand further if the bundle H of 100 paper sheets is handed over to the paper sheet bundle wrapping apparatus 1 from paper sheet processing apparatus 100. On the other hand, if operation of the paper sheet processing apparatus 100 stops in this state, nevertheless there is no failure in the paper sheet processing apparatus 100, the paper sheet processing apparatus 100 will stop, and the throughput of the paper sheet processing apparatus 100 will fall.

In this embodiment, accordingly an evacuation stacker 211 is provided to the paper sheet bundle wrapping apparatus 1 of the embodiment 1. When the failure occurs in the paper sheet bundle wrapping apparatus 1 side, the bundle of 100 paper sheets is accumulated to the evacuation stacker 211.

Hereinafter, the embodiment will be explained with reference to the drawings.

Figure 24:
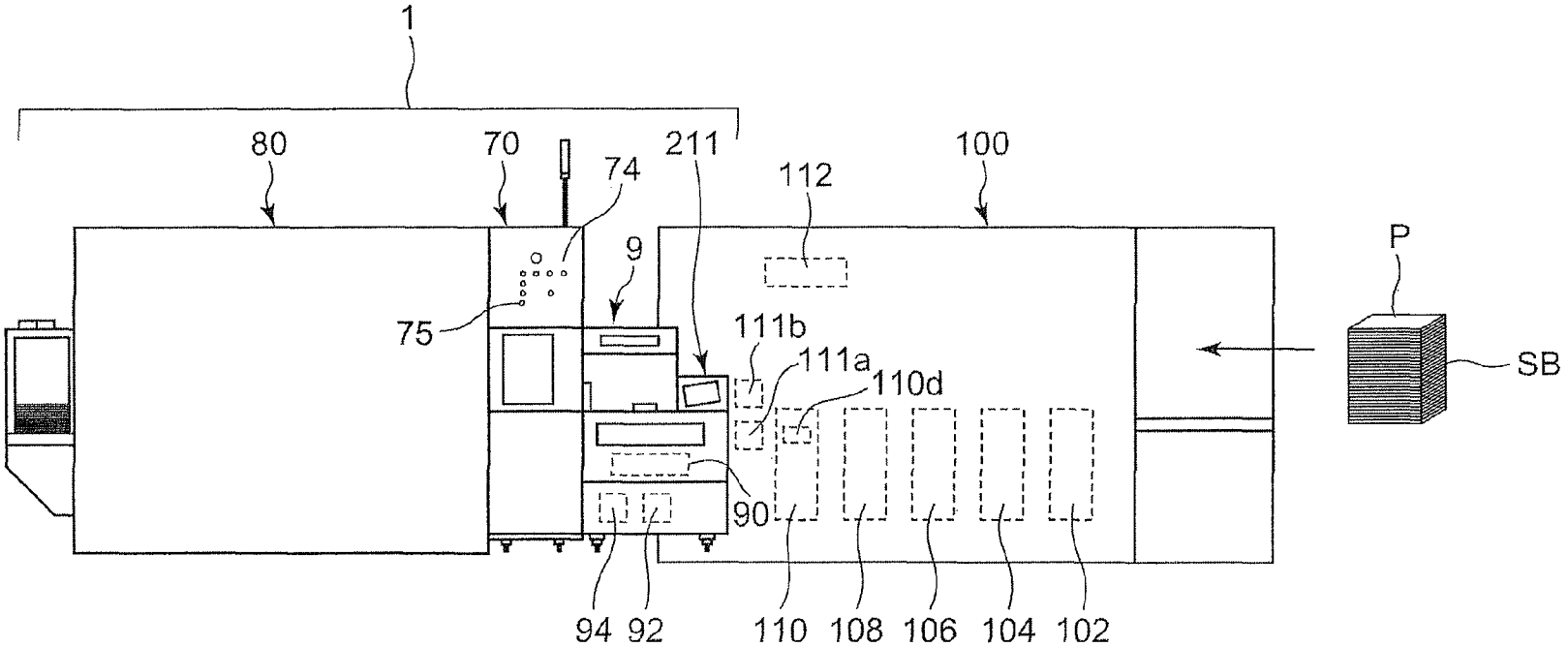
FIG. 24 illustrates an outline of a paper sheet processing system according to other embodiment.
Figure 25:
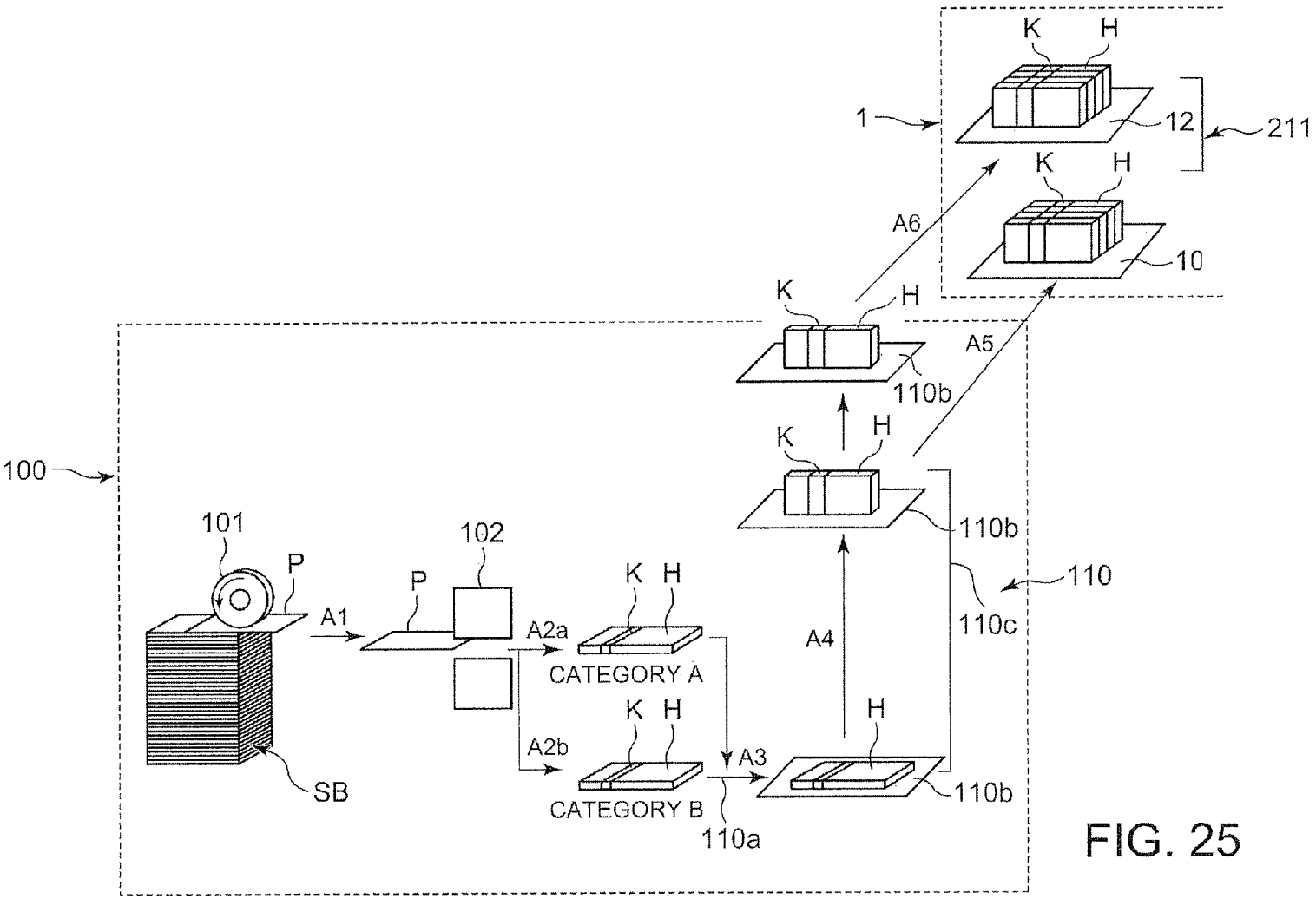
FIG. 25 illustrates a flow of operation of the paper sheet processing apparatus shown in FIG. 24.

FIG. 24 is a drawing showing the paper sheet processing apparatus 100 and the paper sheet bundle wrapping apparatus 1 concerning the embodiment. FIG. 25 is a drawing explaining a flow of operation of the paper sheet processing apparatus 100 and the paper sheet bundle wrapping apparatus 1 shown in FIG. 24. The paper sheet processing apparatus 100 and the paper sheet bundle wrapping apparatus 1 of this embodiment are constituted almost like the paper sheet processing apparatus 100 and the paper sheet bundle wrapping apparatus 1 which were explained previously. The paper sheet bundle wrapping apparatus 1 differs especially from the paper sheet bundle wrapping apparatus 1 previously explained with a point that the paper sheet bundle wrapping apparatus 1 has the evacuation stacker. The paper sheet processing apparatus 100 differs especially from the paper sheet processing apparatus 100 explained previously in a point that the paper sheet processing apparatus 100 can deliver the bundle of paper sheets to the receiving unit and the evacuation stacker of the paper sheet bundle wrapping apparatus 1. In the embodiment 2, the same number as the embodiment 1 is given to a portion equivalent to the embodiment 1.

The paper sheet processing apparatus 100 takes out one paper sheet P at a time with the taking-in roller 101 which constitutes the taking-in unit 102 in order from the uppermost surface of the paper sheet bundle SB supplied collectively, and conveys the paper sheet P in the direction of arrow A1 by the carrying path which is not illustrated. The paper sheet processing apparatus 100 distinguishes the kind, truth, normal/damaged, front/back, etc. of the paper sheet P by the paper sheet discrimination unit 104 arranged inside, and classifies the paper sheet P into categories, such as the normal ticket and the damaged ticket, for every sheet based on the discriminated result.

The paper sheet P classified into the normal ticket or the damaged ticket is accumulated by the accumulation unit 106 for every classification. Whenever the accumulated paper sheet P amounts to 100 sheets, the binding unit 108 binds 100 paper sheets P together using the band K which can adhere with heat.

Thus, the bundle H of 100 paper sheets is discharged by the discharge mechanism 110 to the paper sheet bundle wrapping apparatus 1. That is, in FIG. 25, the bundle H of 100 paper sheets is laid on the lift table 110*b* of the lifter 110*c* by the conveyor belt 110*a*. The bundle H of 100 paper sheets laid on the lift table 110*b* is conveyed in the direction of arrow A4 by the lifter 110*c*, and is also discharged to the paper sheet bundle wrapping apparatus 1.

When the bundle H of 100 paper sheets is conveyed by the lifer 110*c* in the direction of arrow A4 and arrives at a predetermined position, one side edge face of the bundle H of 100 paper sheets is raised and the bundle H of 100 paper sheets is held in the standing position where the another side edge of the bundle H of 100 paper sheets is used as the bottom.

When the failure does not occur in the paper sheet bundle wrapping apparatus 1, the bundle H of 100 paper sheets held in the standing position is pushed out from its back with its standing position, and is passed to the receiving unit 10 of the paper sheet bundle wrapping apparatus 1 with this standing position. In this case, the category information which shows the kind of the bundle H of 100 paper sheets is transmitted to the paper sheet bundle wrapping apparatus 1 from the first communications unit 112 of the paper sheet processing apparatus 100.

The bundle H of 100 paper sheets passed to the receiving unit 10 of the paper sheet bundle wrapping apparatus 1 is accumulated according to the category based on the category information received by the 2nd communications unit 92, as explained with reference to FIG. 3, FIG. 5 and FIG. 6. And when ten bundles H of 100 paper sheets are accumulated, ten bundles H of 100 paper sheets are bound together by the band which is made of a transparent resin sheet as the bundle S of 1000 paper sheets, and are shrink-wrapped and are discharged from the paper sheet bundle wrapping apparatus.

On the other hand, when failure occurs in the paper sheet bundle wrapping apparatus 1 side, a fault detection unit 94 detects occurrence of the failure. The communications unit 92 notifies the occurrence of the failure, that is, failure information to the communications unit 112 of the paper sheet processing apparatus 100. As shown in FIG. 25, the paper sheet processing apparatus 100 which received a notice of occurrence of the failure further raises the lift table 110*b* of the lifer 110*c*, and delivers the bundle H of 100 paper sheets to the receiving unit 12 of the evacuation stacker 211 of the paper sheet bundle wrapping apparatus 1.

The evacuation stacker 211 will be explained below. In the embodiment, the evacuation stacker 211 is arranged in the upper part of the receiving unit 10 of the paper sheet bundle wrapping apparatus 1.

Figure 26:
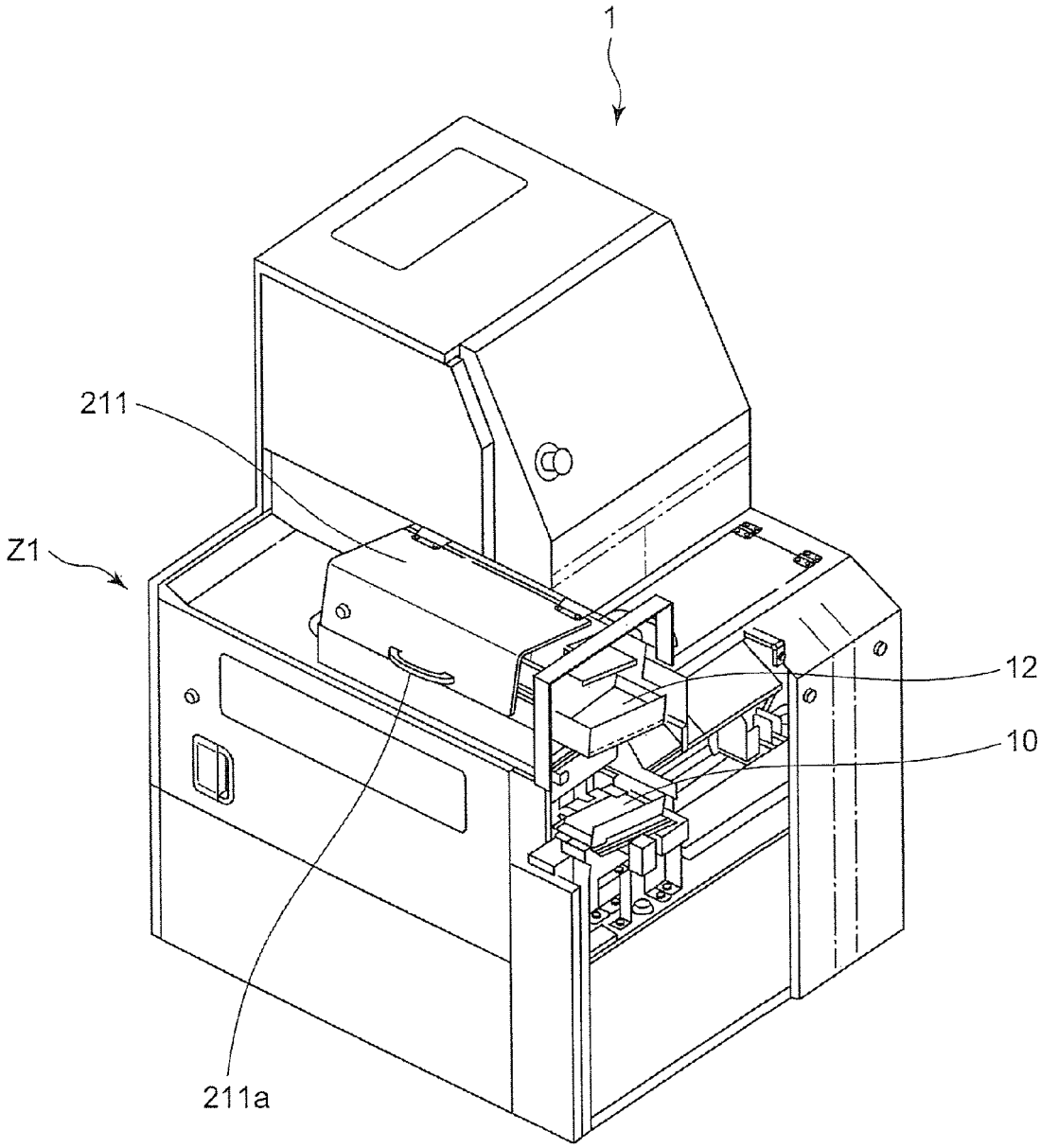
FIG. 26 is a perspective view of the paper sheet bundle wrapping apparatus shown in FIG. 24.
Figure 27:
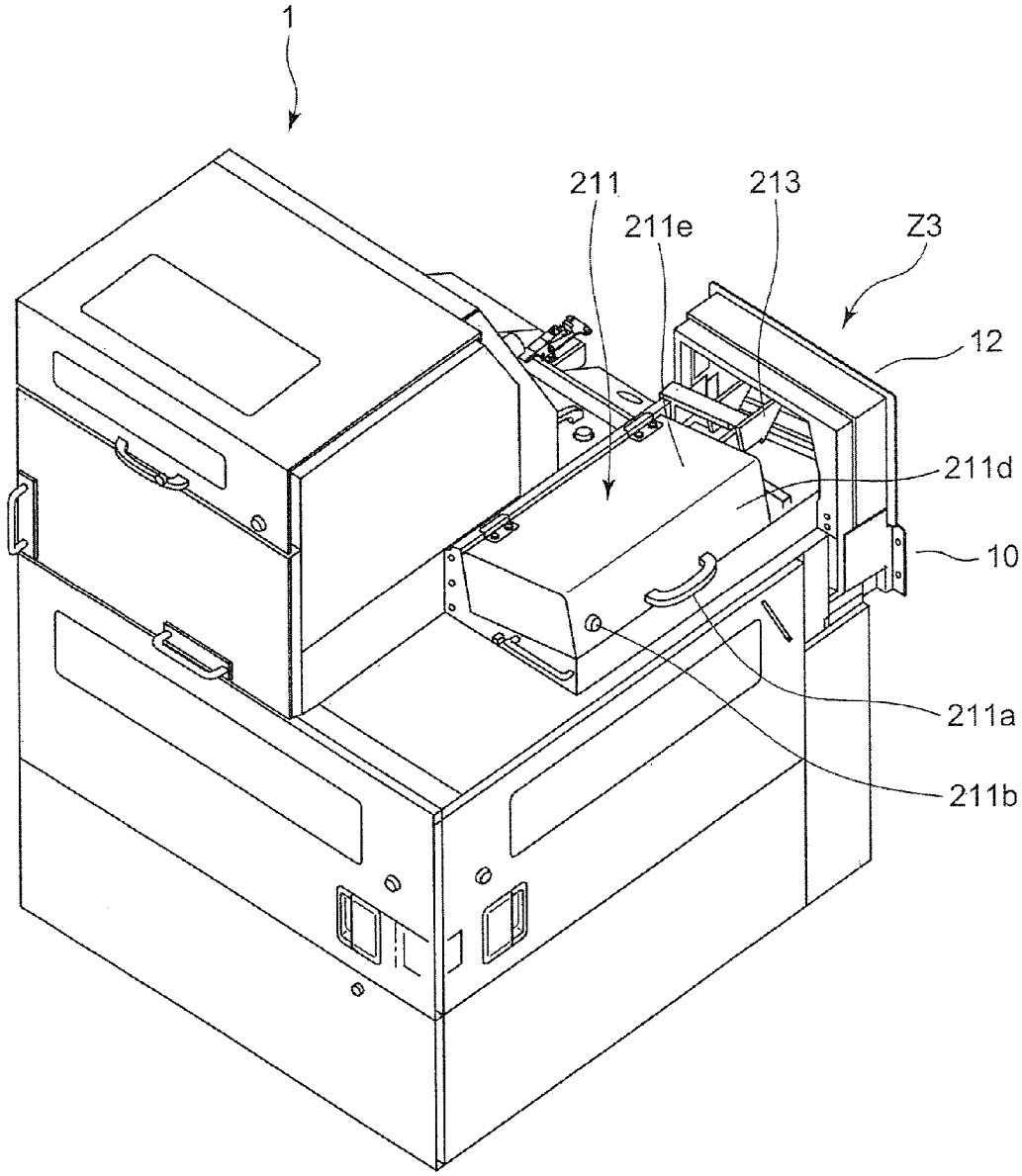
FIG. 27 is a perspective view of the paper sheet bundle wrapping apparatus shown in FIG. 26 seen from the direction of arrow Z1.

FIG. 26 is a perspective view of the paper sheet bundle wrapping apparatus 1 seen from the back side. FIG. 26 is a front view of the paper sheet bundle wrapping apparatus 1. One evacuation stacker 211 is arranged at the paper sheet bundle wrapping apparatus 1. FIG. 27 is a perspective view of the paper sheet bundle wrapping apparatus 1 shown in FIG. 26 viewed form the direction of arrow Z1. FIG. 26 and FIG. 27 show a state where a cover was removed partly so that an internal structure can be seen.

The evacuation stacker 211 is arranged in the upper part of the receiving unit 10 of the paper sheet bundle wrapping apparatus 1. When the evacuation stacker 211 is seen from the direction of arrow Z3, the evacuation stacker 211 is arranged so that the lower right side may become lower than the lower left side. With such arrangement, as for the bundle H of 100 paper sheets evacuated to the evacuation stacker 211, a position is arranged at the lower left side by its own weight.

The receiving unit 12 of the evacuation stacker 211 is opened so that the bundle H of 100 paper sheets can be inserted.

Figure 28:
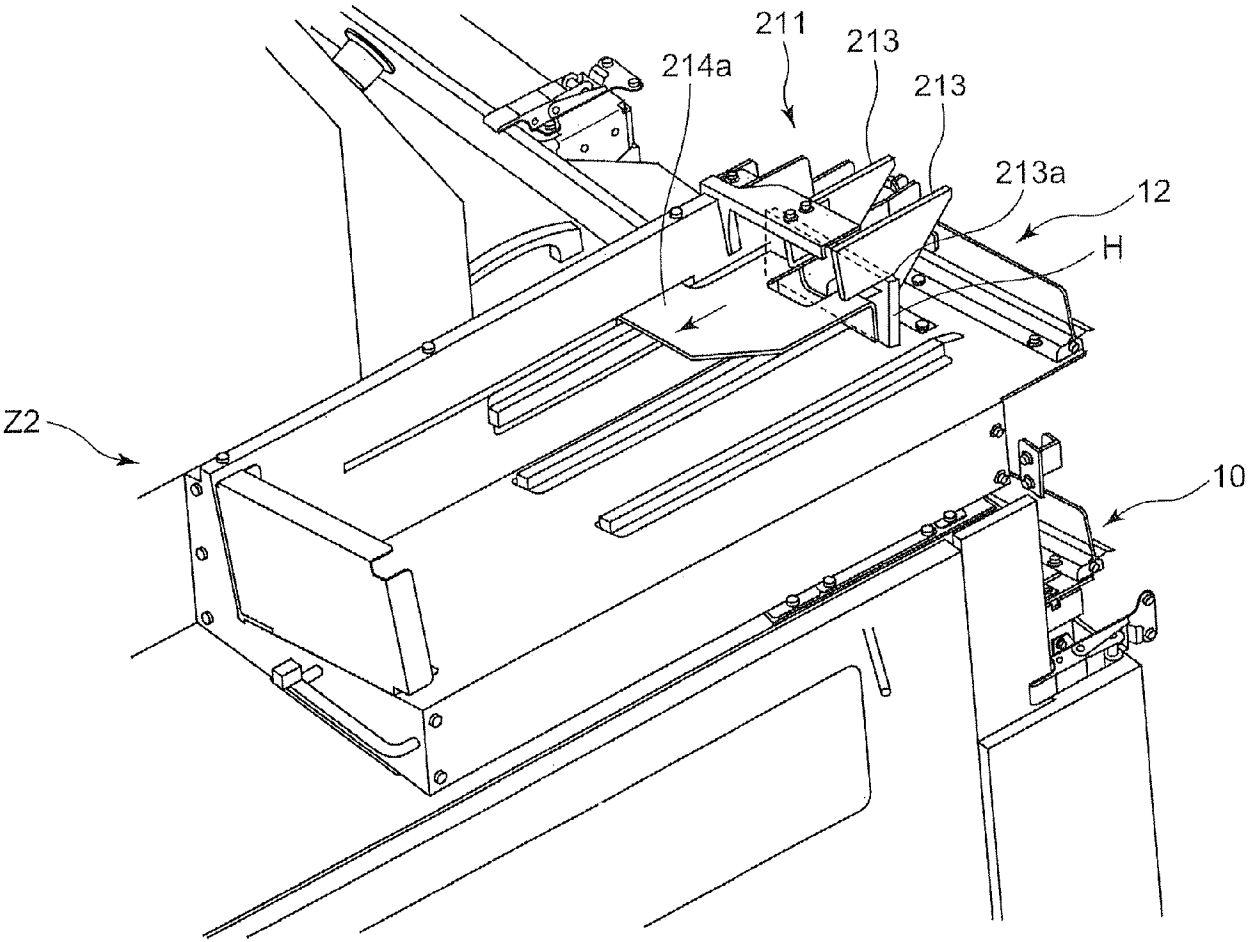
FIG. 28 is a perspective view showing the inside of an evacuation stacker of the paper sheet bundle wrapping apparatus shown in FIG. 26.
Figure 29:
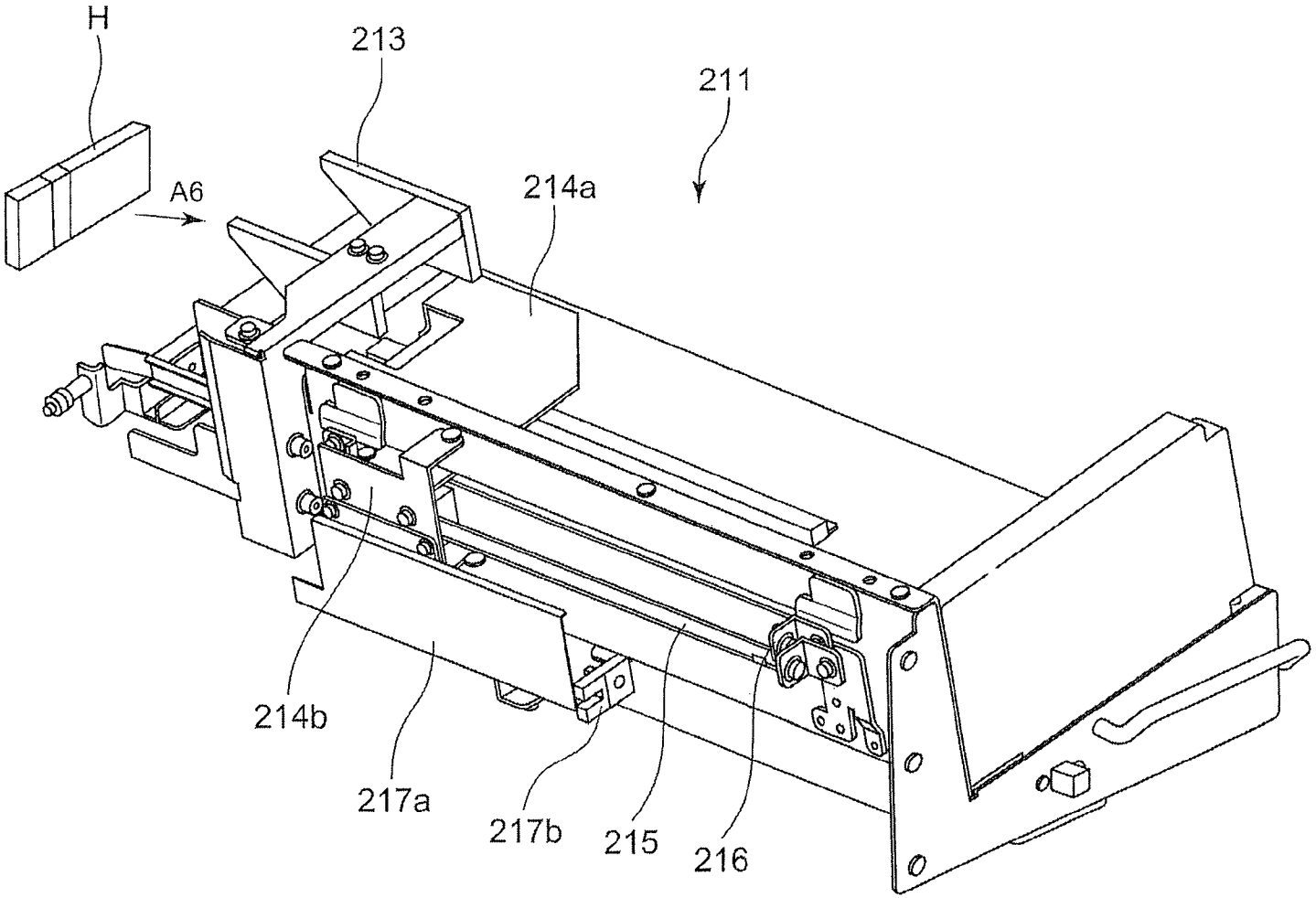
FIG. 29 is a perspective view of the evacuation stacker shown in FIG. 28 seen from the direction of arrow Z2.

FIG. 28 shows an inside composition of the evacuation stacker 211 shown in FIG. 26 or FIG. 27. FIG. 29 is a drawing of the evacuation stacker 211 shown in FIG. 28 seen from the direction of arrow Z2.

The evacuation stacker 211 includes the receiving unit 12, a fall prevention guide 213, a backup 214*a*, a slide rail 215, a constant force spring (not shown), etc.

The backup 214*a* is fixed to a backup holder 214*b*. The backup holder 214*b* is attached to the slide rail 215, and is movable free to the major axis direction of the slide rail 215.

When the backup holder 214*b* moves into the evacuation stacker 211 along the slide rail 215, the stopper 216 restricts movement of the backup holder 214*b*.

The backup holder 214*b* is attached to the constant force spring, and the constant force spring pulls the backup 14*a* with fixed load to the fall prevention guide 213 side.

The fall prevention guide 213 is a wedge shape, and has a notch section 213*a* in the back end portion of a wedge. When the bundle H of 100 paper sheets is inserted, the upper end face of the bundle H of 100 paper sheets pushes up the fall prevention guide 213 along the wedge shape. When the bundle H of 100 paper sheets is further inserted, the upper end of the bundle H of 100 paper sheets enters into the notch section 213*a*. The bundle H of 100 paper sheets is sandwiched between the fall prevention guide 213 and the backup 214*a*, and is held in a standing position. The backup 214*a* pushes the lower part of the bundle H of 100 paper sheets to the fall prevention guide 213 side.

In the evacuation stacker 211 constituted in this way, when the bundle H of 100 paper sheets is pushed into the receiving unit 12 from the paper sheet processing apparatus 100 by the pushing bar which is not illustrated, the bundle H of 100 paper sheets is taken in between the fall prevention guide 213 and the backup 214*a*, as mentioned above. FIG. 28 shows a state where the bundle H of 100 paper sheets has been taken in. In this state, the notch section 213*a* of the fall prevention guide 213 prevents the bundle H of 100 paper sheets from falling back, and the backup 214*a* prevents the bundle H of 100 paper sheets from falling down ahead. As a result, the bundle H of 100 paper sheets is held inside the evacuation stacker 211 in a standing position.

When the following bundle H of 100 paper sheets is pushed out from the paper sheet processing apparatus 100 and taken into the fall prevention guide 213, the bundle H of 100 paper sheets which was taken in previously and the backup 214*a* are pushed into inside the evacuation stacker 211. In this case, the backup holder 214*b* which supports the backup 14*a* moves to the major axis direction of the slide rail 215. However, since the constant force spring pulls the backup holder 214*b* by fixed load to the fall prevention guide 213 side, both the bundle H of 100 paper sheets taken in previously and the bundle H of 100 paper sheets taken in continuously are held between the fall prevention guide 213 and the backup 214*a* in the standing position.

A bundle H of 100 paper sheets supplied further continuously is similarly taken in between the fall prevention guide 213 and the backup 214*a*.

The bundle H of 100 paper sheets is accumulated on the bottom of the evacuation stacker 211 as mentioned above in the standing position.

Since the backup 214*a* is pulled by the constant load spring to the fall prevention guide 213, the bundle H of 100 paper sheets accumulated in the evacuation stacker 211 is pushed by constant load irrespective of the accumulated number.

When the backup holder 214*b* moves into the evacuation stacker 211, a detection plate 217*a* attached to the backup holder 214*b* also moves to the back simultaneously. The detection plate 217*a* is detected by a backup sensor 217*b* which includes a photo-transmitter and a photo-receiver. In this embodiment, the detection plate 217*a* is arranged at a position where the detection plate 217*a* is detected by the backup sensor 217*b* in an initial state. Here, the initial state means a state where the bundle H of 100 paper sheets is not taken into the evacuation stacker 211.

When the evacuation stacker 211 fills with the bundles H of 100 paper sheets taken-in, the detection plate 217*a* will not be detected by the backup sensor 217*b*. The evacuation stacker 211 fills with 20 bundles H of 100 paper sheets, for example. When the evacuation stacker 211 becomes full, the evacuation stacker 211 becomes unusable. The detection result by the backup sensor 217*b* is notified to the control unit 90 of the paper sheet bundle wrapping apparatus 1 by a reporting means which is not illustrated.

The control unit 90 transmits the detection result to the paper sheet processing apparatus 100 by the communications unit 92 in the paper sheet bundle wrapping apparatus 1.

The paper sheet processing apparatus 100 receives the detection result transmitted from the communications unit 92 by the communications unit 112. When the paper sheet processing apparatus 100 recognizes that the evacuation stacker 211 is in an unusable state, the paper sheet processing apparatus 100 stops operation, and stops supplying a new bundle H of 100 paper sheets to the paper sheet wrapping apparatus 1.

On the other hand, when the failure of the paper sheet bundle wrapping apparatus 1 is removed by the time the evacuation stacker 211 fills, an operator sets up that the failure was removed with a setting means 75 of the controlling unit 74 of the paper sheet bundle wrapping apparatus 1. Thereby, the communications unit 92 notifies the communications unit 112 of the paper sheet bundle wrapping apparatus 1 operating normally. When the communications unit 112 receives a notice, the paper sheet processing apparatus 100 stops supplying the bundle H of 100 paper sheets to the evacuation stacker 211, and start supplying the bundle H of 100 paper sheets to the receiving unit 10.

The evacuation stacker 211 is constituted so that the evacuation stacker 211 can be removed from main body of the paper sheet bundle wrapping apparatus 1. As shown in FIG. 27, a handle 211*a* is attached to the evacuation stacker 211 so that removal and movement of the evacuation stacker 211 can be performed easily. A lock 211*b* is attached to the evacuation stacker 211, and the evacuation stacker 211 can use as a safety box. When the lock 211*b* is released by a key, a side 211*d* to which the handle is attached and an upper surface 211*e* can be opened, and access to the bundles H of 100 paper sheets accumulated in the inside can be performed.

As explained above, according to the paper sheet processing system of the embodiment, when the failure occurs in the paper sheet bundle wrapping apparatus 1, the paper sheet bundle wrapping apparatus 1 can accumulate the bundle H of 100 paper sheets in the evacuation stacker 211 in the standing position. Therefore, even when the failure occurs in the paper sheet bundle wrapping apparatus 1, the paper sheet processing apparatus 100 can continue processing. Thereby, the fall of a throughput can be prevented. While the bundle H of 100 paper sheets is accumulated in the evacuation stacker, the work which removes the failure of the paper sheet bundle wrapping apparatus 1 can be done.

After the bundle H of 100 paper sheets is pushed into the evacuation stacker 211 from the paper sheet processing apparatus 1 in the standing position, the bundle H of 100 paper sheets is received and is accumulated with the standing position without electric control by mechanical movement. This is effective at the point that the evacuation stacker 211 can accumulate the bundle H of 100 paper sheets without the controlling by the paper sheet bundle wrapping apparatus which generated the failure.

This is a very important function on the stable operation of the paper sheet processing apparatus 100 including the evacuation stacker 211.

If there is an additional installing space, a plurality of the evacuation stackers 211 can be arranged. In this case, after a 1st evacuation stacker fills, the bundle H of 100 paper sheets is accumulated in a 2nd evacuation stacker. When a plurality of the evacuation stackers 211 are arranged, even when it takes long time to recover from the failure of the paper sheet bundle wrapping apparatus 1, the processing of the paper sheet processing apparatus may not be influenced.

The bundle H of 100 paper sheets accumulated in the evacuation stacker 211 is manually taken out from the evacuation stacker 211 by the operator. The operator checks the band K of the bundle H of 100 paper sheets taken-out, and classifies the bundle H of 100 paper sheets for every categories, such as the normal ticket and the damaged ticket. And the operator binds ten classified bundles H of 100 paper sheets together by a binding machine, and makes the bundle S of 1000 paper sheets.

The paper sheet processing system of this embodiment has a high usage rate of the paper sheet bundle wrapping apparatus 1 as well as the embodiment 1.

Even when the failure occurs in the paper sheet bundle wrapping apparatus 1, the paper sheet processing system does not reduce the throughput of the paper sheet bundle processing apparatus 100.

Embodiment 3

Next, the paper sheet processing system constituted so that the bundle H of 100 paper sheets accumulated in the evacuation stacker 211 could be supplied to the paper sheet bundle wrapping apparatus 1 manually will be explained. According to the paper sheet processing system by this embodiment, processing of the bundle H of 100 paper sheets accumulated in the evacuation stacker 211 by the operator becomes easy compared with the paper sheet processing system of the embodiment 2. The operator does not need to classify the bundle H of 100 paper sheets accumulated in evacuation stacker 211, and does not need to collect ten bundles H of 100 paper sheets in the same category.

In addition to the composition of the embodiment 2, the paper sheet processing system of this embodiment includes an on-line setting unit which sets the paper sheet bundle wrapping apparatus 1 as an on-line state, an off-line setting unit which sets the paper sheet bundle wrapping apparatus 1 as an off-line state, a manual slot for the bundle H of 100 paper sheets, and a category specifying unit for specifying the bundle H of 100 paper sheets supplied to a manual slot manually. In the on-line, state, the paper sheet bundle wrapping apparatus cooperates with the paper sheet processing apparatus, and operates. In the off-line state, the paper sheet bundle wrapping apparatus 1 operates independently.

Figure 30:
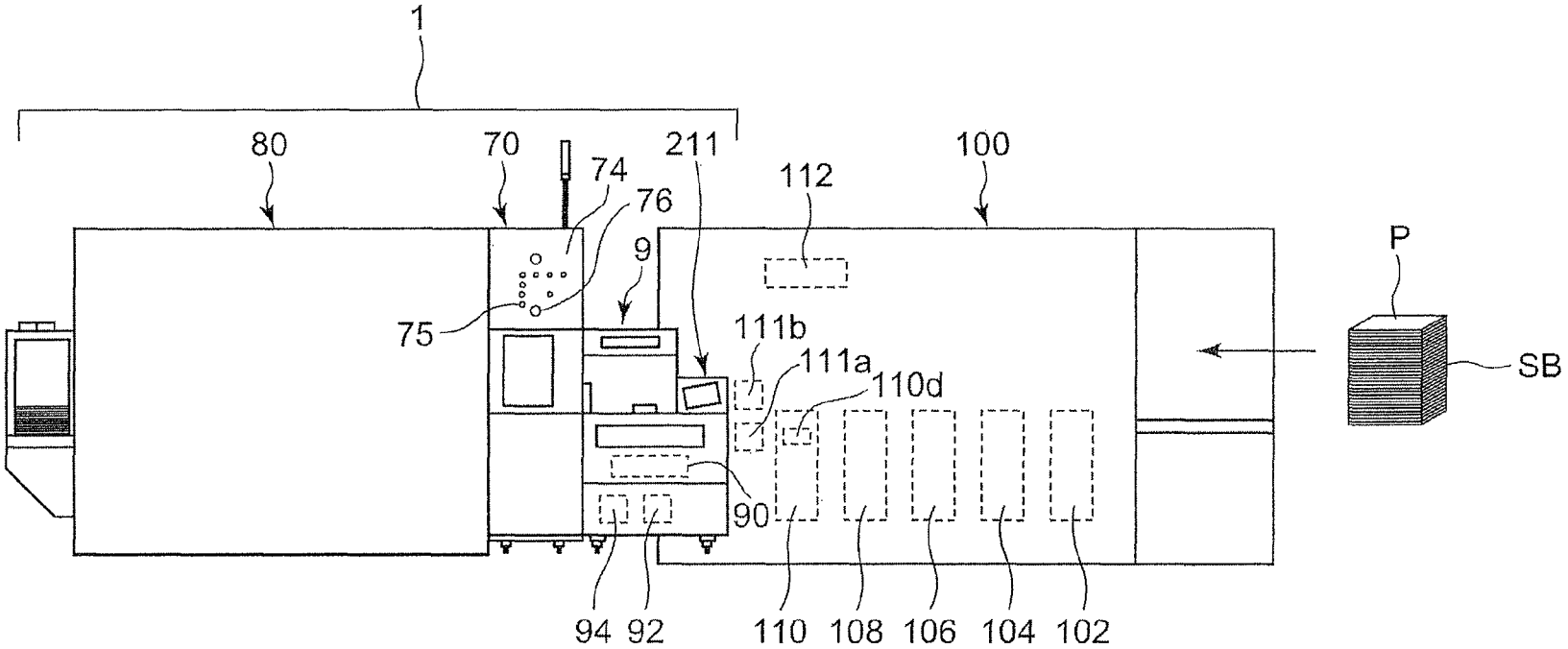
FIG. 30 is an outline view of the paper sheet processing system according to another embodiment.

FIG. 30 shows the constitution of the paper sheet processing system concerning the embodiment. A basic constitution is the same as the constitution of the embodiment 2 shown in FIG. 24. A flow until the paper sheet processing apparatus 100 classifies the supplied paper sheet bundle SB, forms the bundle H of 100 paper sheets and discharges the bundle H of 100 paper sheets to the paper sheet bundle wrapping processing 1 is the same as that of the embodiment 2 shown in FIG. 25. Therefore, an explanation of the constitution of the paper sheet processing system and an explanation of the flow of operation of the paper sheet processing apparatus 100 are omitted. The paper sheet processing system will be explained below focusing on the point which is different from the embodiment 2. In the embodiment 3, the same numeral as the embodiment 1 and the embodiment 2 is given to a portion equivalent to the embodiment 1 and the embodiment 2.

The paper sheet bundle wrapping apparatus 1 of the paper sheet processing system of this embodiment has the controlling unit 74, as shown in FIG. 30. The controlling unit 74 is provided with the on-line setting unit which sets the paper sheet bundle wrapping apparatus 1 on-line state, and the off-line setting unit which sets the paper sheet bundle wrapping apparatus 1 off-line state. The on-line setting unit and the off-line setting unit comprise a switch 76 which sets up the on-line state and the on-line state alternatively.

First, the case where the paper sheet bundle wrapping apparatus 1 is in the on-line state will be explained. In the on-line state, the paper sheet bundle wrapping apparatus 1 cooperates with the paper sheet processing apparatus 100. A communication line is formed between the communications unit 112 of the paper sheet processing apparatus 100 and the communications unit 92 of the paper sheet bundle wrapping apparatus 1. The paper sheet wrapping apparatus 1 notifies the paper sheet bundle processing apparatus 100 of the operating status of the paper sheet bundle wrapping apparatus 1. The paper sheet processing apparatus 100 can know that the paper sheet bundle wrapping apparatus 1 is in the unusable state, and that the evacuation stacker 211 is full, for example.

Like the paper sheet processing apparatus 100 of the embodiment 1 and the embodiment 2, whenever the paper sheet processing apparatus 100 discharges the bundle H of 100 paper sheets to the paper sheet bundle wrapping apparatus 1, the paper sheet processing apparatus 100 transmits the category information showing the category of the bundle H of 100 paper sheets to the communications unit 92 of the paper sheet bundle wrapping apparatus 1 by the communications unit 112. The category information which shows category A is transmitted when the bundle H of 100 paper sheets is the normal ticket, and the category information which shows category B is transmitted when the bundle H of 100 paper sheets is the damaged ticket.

When the paper sheet bundle wrapping apparatus 1 is in the on-line state and the paper sheet bundle wrapping apparatus is working normally, the discharge mechanism 110 of the paper sheet processing apparatus 100 discharges the bundle H of 100 paper sheets from the 1st outlet 111*a*. The bundle H of 100 paper sheets discharged is supplied to the receiving unit 10 of the paper sheet bundle wrapping apparatus 1, and is processed by the paper sheet bundle wrapping apparatus 1 like the paper sheet bundle wrapping apparatus 1 of the embodiment 1.

When the paper sheet bundle wrapping apparatus 1 is in the on-line state and the failure occurs in the paper sheet bundle wrapping apparatus 1, the paper sheet bundle wrapping apparatus 1 notifies the paper sheet processing apparatus 100 that the paper sheet bundle wrapping apparatus 1 is in an unusable state. The paper sheet processing apparatus 100 gets to know generating of failure when the failure occurs in the interface between the paper sheet bundle wrapping apparatus 1 and the paper sheet processing apparatus 100. When the paper sheet processing apparatus 100 gets to know that the paper sheet bundle wrapping apparatus 1 is in the unusable state or that the failure occurs in the interface, the discharge mechanism 110 of the paper sheet processing apparatus 100 discharges the bundle H of 100 paper sheets from a 2nd outlet 111*b* of the paper sheet processing apparatus 100. The bundle H of 100 paper sheets discharged is supplied to the receiving unit 12 of the evacuation stacker 211 of the paper sheet bundle wrapping apparatus 1 connected with the 2nd outlet. The discharge mechanism 110 and the evacuation stacker 211 are constituted like the embodiment 2, and accumulation of the bundle H of 100 paper sheets to the evacuation stacker 211 is performed like the embodiment 2.

Next, the case where the paper sheet bundle wrapping apparatus 1 is in the off-line state will be explained. When the paper sheet bundle wrapping apparatus 1 is in the off-line state, the paper sheet bundle wrapping apparatus 1 operates independently. For this reason, the paper sheet processing apparatus 100 cannot know operational status of the paper sheet bundle wrapping apparatus 1, and cannot transmit the information including the category information of the bundle H of 100 paper sheets, etc. to the paper sheet bundle wrapping apparatus 1. Since the bundle H of 100 paper sheets accumulated in the evacuation stacker 211 are processed manually, the evacuation stacker 211 does not accumulate the bundle H of 100 paper sheets newly.

Therefore, the paper sheet bundle wrapping apparatus 1 stops processing the paper sheet.

Next, the evacuation stocker 211 and a manual controlling unit 230 will be explained.

Figure 32:
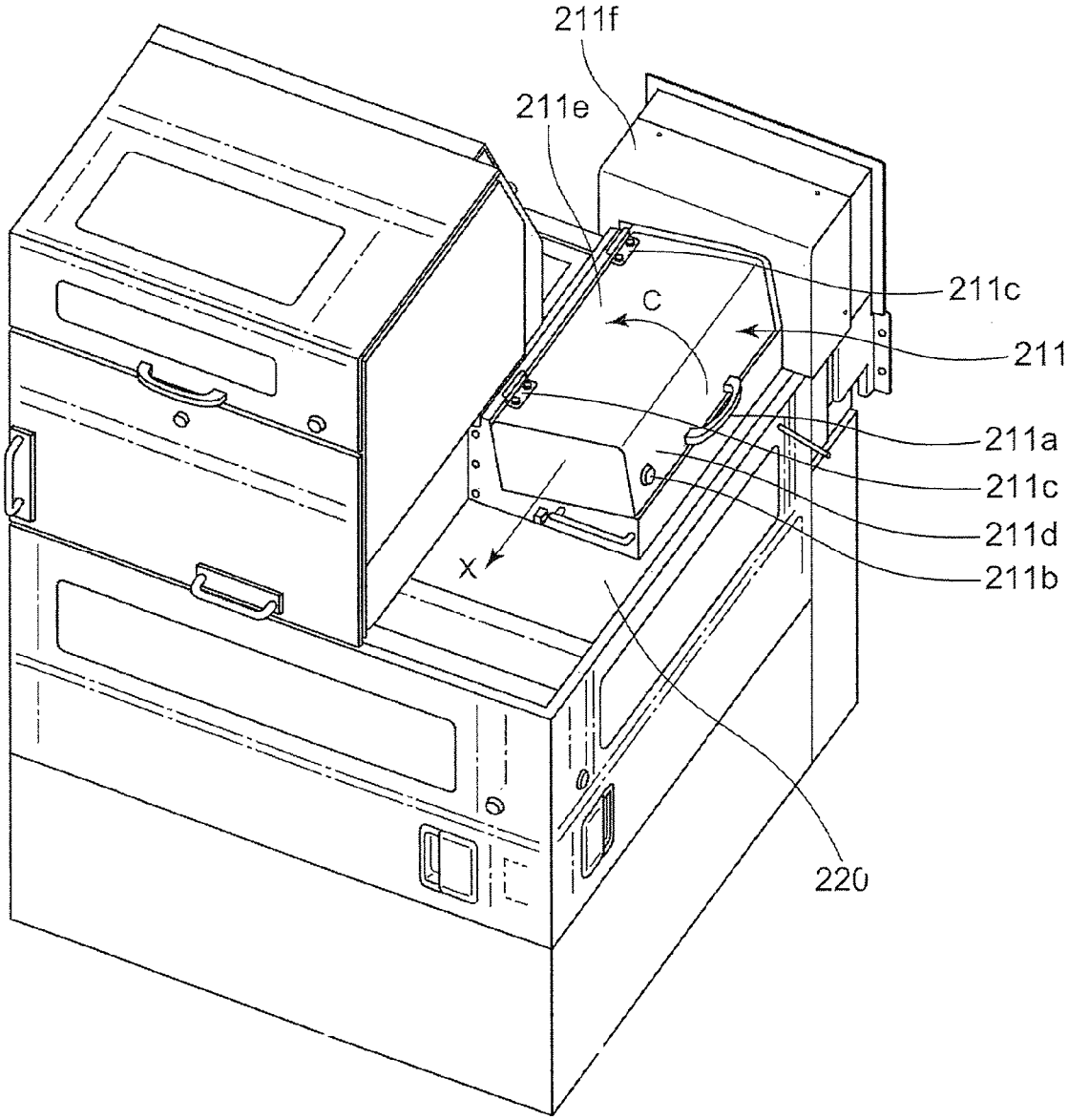
FIG. 32 is a front perspective view of the evacuation stacker of the paper sheet bundle wrapping apparatus.
Figure 33:
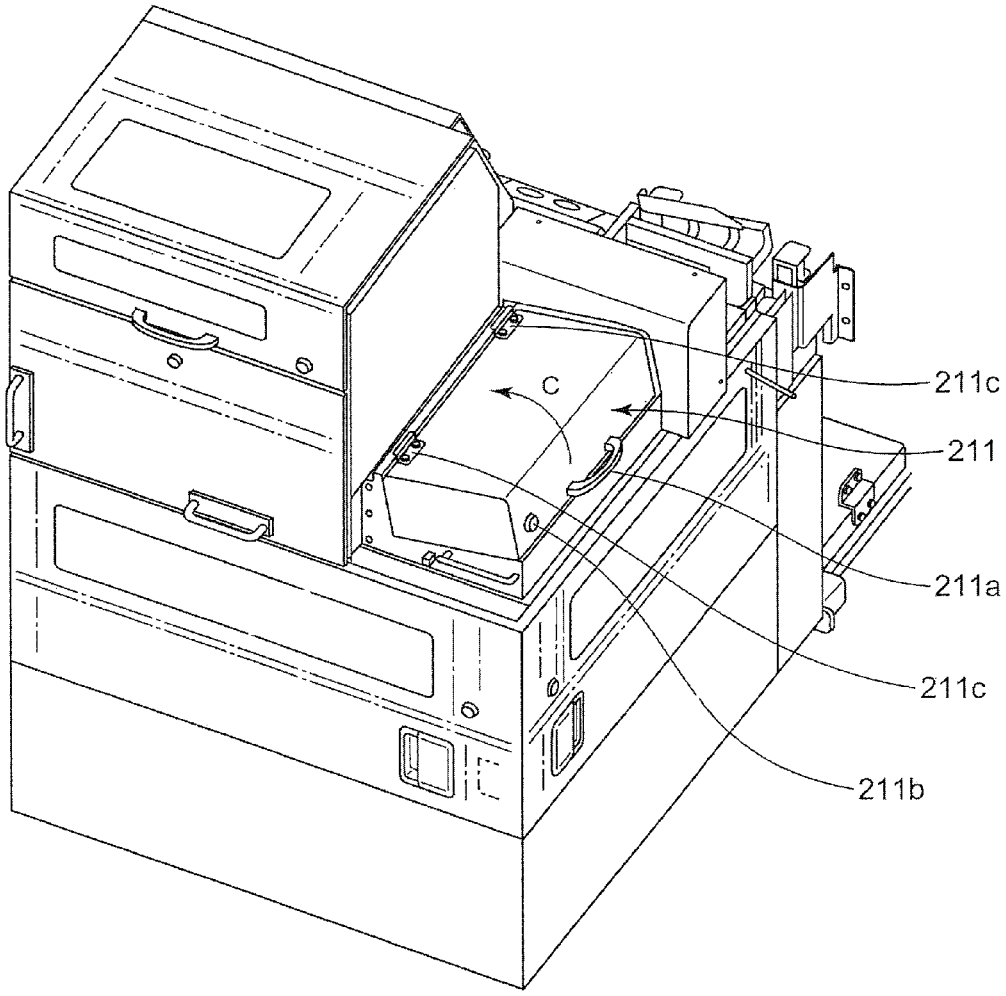
FIG. 33 is a perspective view showing a state where the evacuation stacker moved.

Since the evacuation stacker 211 is similar to the embodiment 2, its explanation is omitted. The evacuation stacker 211 is arranged on a table 220 movable in the direction shown by arrow X, as shown in FIG. 32. Since a cover 211*f* is indicated in FIG. 32, unlike FIG. 27, the fall prevention guide 213 is not seen. FIG. 33 shows a state where the evacuation stacker 211 has moved in the direction of arrow X. The evacuation stacker 211 is in a position illustrated in FIG. 32 while the paper sheet processing apparatus 100 works. When the bundles H of 100 paper sheets accumulated by the evacuation stocker is processed manually, the evacuation stacker 211 is moved to the position indicated in FIG. 33.

The side 211*d* and the upper surface 211*e* of the evacuation stacker 211 can be opened in the direction of arrow C by using hinges 211*c* as a fulcrum when the lock 211*b* is released by the key. By opening the side 211*d* and upper surface 211*e*, the bundles H of 100 paper sheets accumulated inside the evacuation stacker 211 can be taken out.

Figure 34:
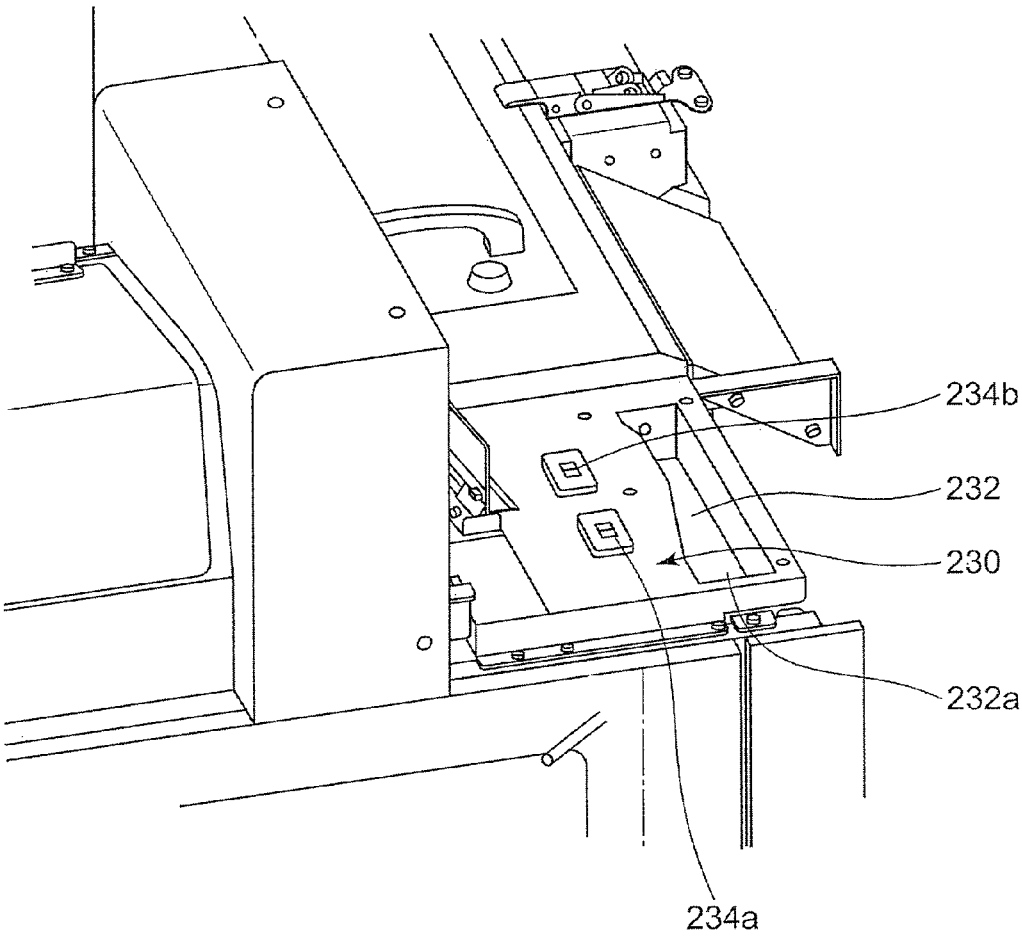
FIG. 34 is a perspective view of a manual controlling unit of the paper sheet bundle wrapping apparatus.
Figure 35:
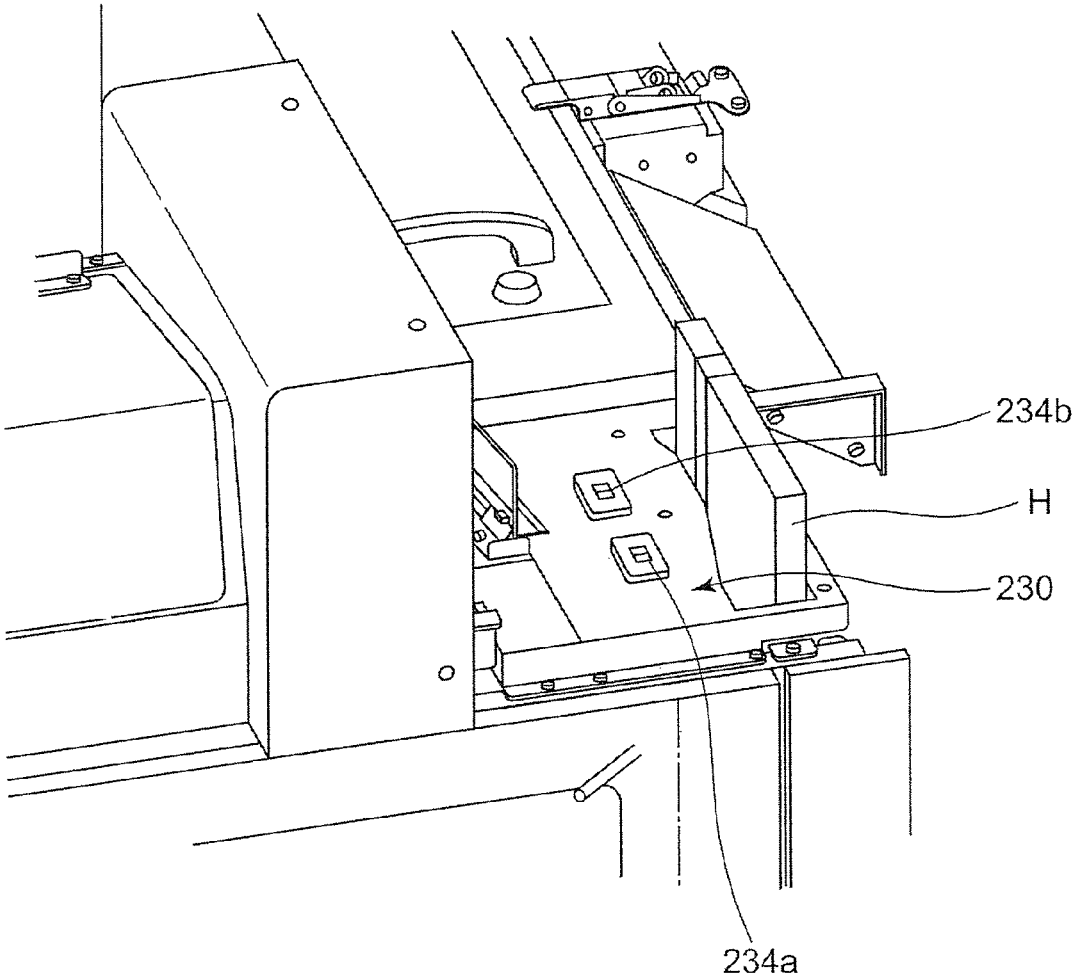
FIG. 35 is a perspective showing a state where the bundle H of 100 paper sheets was supplied to a manual slot.

FIG. 34 shows the manual controlling unit 230 of the paper sheet bundle wrapping apparatus 1 which is appeared when the evacuation stacker 211 moves in the direction of X. The operation of the manual controlling unit 230 is effective when the paper sheet bundle wrapping apparatus 1 is in the off-line state. FIG. 35 is a drawing showing a state where the bundle H of 100 paper sheets is supplied to the manual slot 230*a* manually.

The processing of the bundle H of 100 paper sheets accumulated in the evacuation stacker 211 will be explained. The bundle H of 100 paper sheets accumulated in the evacuation stacker 211 is processed when the paper sheet bundle wrapping apparatus 1 is in the off-line state. Setting of the off-line state of the paper sheet bundle wrapping apparatus 1 is set up by the switch 76 of the controlling unit 74.

The bundle H of 100 paper sheets is processed after the failure of the paper sheet bundle wrapping apparatus 1 is removed.

Figure 31:
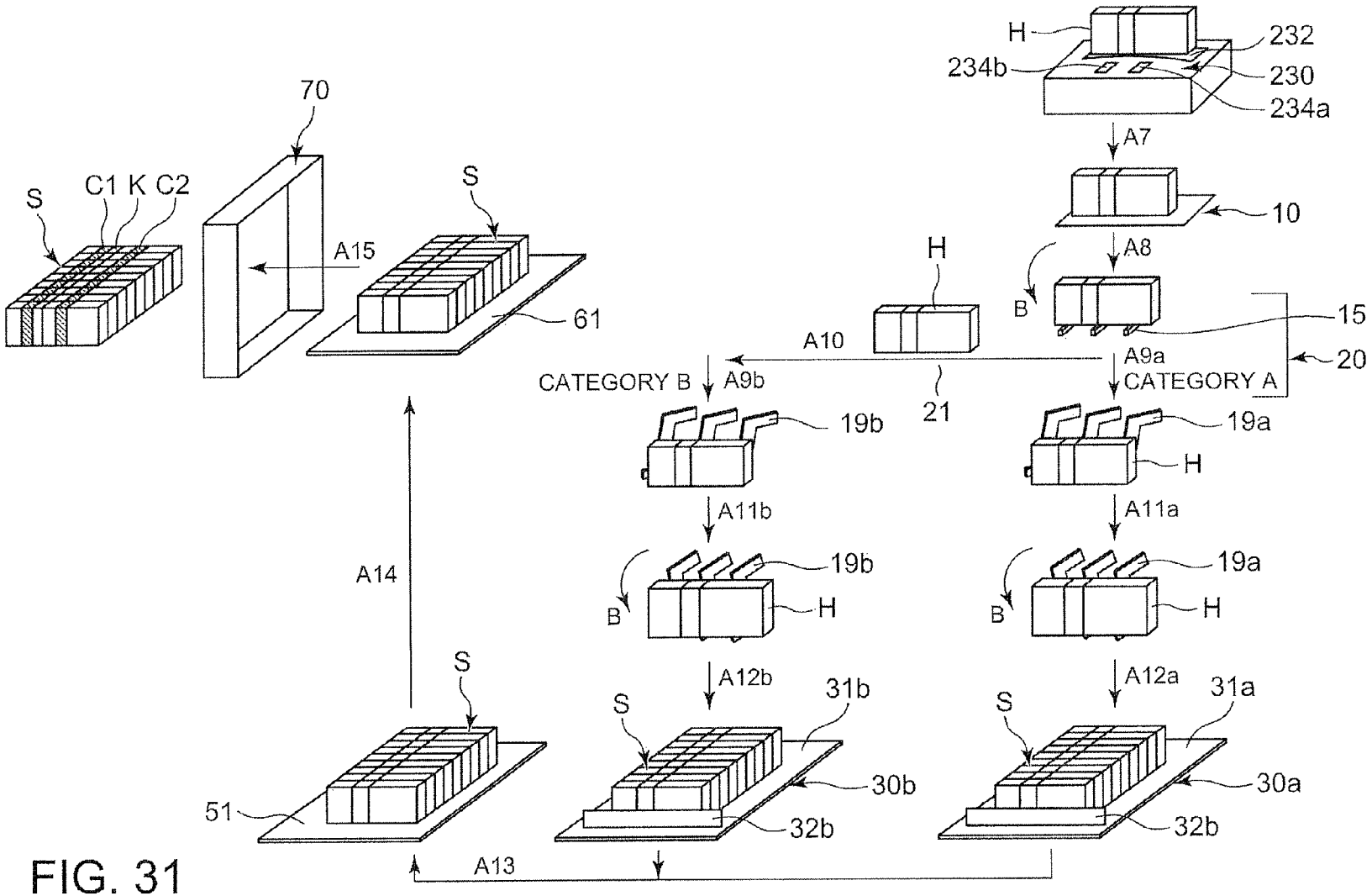
FIG. 31 illustrates a flow of operation until the bundles H of 100 paper sheets supplied by manual operation are formed in a bundle S of 1000 paper sheets.

FIG. 31 is a drawing illustrating a flow of operation until the bundle S of 1000 paper sheets is formed after the bundle H of 100 paper sheets accumulated in the evacuation stacker 211 are supplied to the manual slot 232 manually.

The operator slides the evacuation stacker 211 in the direction of arrow X of FIG. 32 when the bundle H of 100 paper sheets accumulated in the evacuation stacker 211 are processed. Then, as shown in FIG. 34, the controlling unit 230 is appeared. The controlling unit 230 has a manual slot 232 to which the bundle H of 100 paper sheets is supplied, and a bundle taking-in switch 234*a* and a bundle taking-in switch 234*b* for taking in the bundle H of 100 paper sheets supplied. The width of the manual slot 232 becomes spread toward one end 232*a* from about the center corresponding to the shape of the bundle of 100 paper sheets bound by the band K.

The operator opens the side 211*d* and the upper surface 211*e* of the evacuation stacker 211, takes out one bundle H of 100 paper sheets accumulated, and puts the bundle H of 100 paper sheets into the manual slot 232. In that case, the operator checks a printing for the category classification on the band K.

The operator pushes the taking-in switch 234*a* when the band K of the bundle H of 100 paper sheets belongs to category A. The operator pushes the taking-in switch 234*b* when the band K of the bundle of 100 paper sheets belongs to category B. The taking-in switch 234*a* and the taking-in switch 234*b* function as the category setting unit.

When the taking-in switch 234*a* or the taking-in switch 234*b* is pushed, the bundle H of 100 paper sheets falls down on the receiving unit 10 of the paper sheet bundle wrapping apparatus 1, and the bundle H 100 paper sheets is taken into the receiving unit 10 like the case where the bundle H of 100 paper sheets is supplied to the receiving unit 10. And the category information is given to the control section 90 of the paper sheet bundle wrapping apparatus 1, and the category selecting unit is controlled.

The bundle H of 100 paper sheets taken into the receiving unit 10 is processed like the embodiment 1.

The bundle H of 100 paper sheets which fell down on the receiving unit 10 of the paper sheet bundle wrapping apparatus 1 is pushed, and is slid down on the shutter 15. When the shutter 15 is opened, the bundle H of 100 paper sheets is slid down on the conveyor 21. When the bundle H of 100 paper sheets belongs to category A, the pushing bar 19*a* pushes the bundle H of 100 paper sheets in the standing position and accumulates the bundle H of 100 paper sheets on the accumulation tray 31*a* of the accumulation part 30*a* of category A. In particular, progressing ahead, the pushing bar 19*a* rotates as arrow B indicates and pushes the bundle H of 100 paper sheets on the accumulation tray 31*a*. Thus, the bundle H of 100 paper sheets is pushed out ahead, holding the standing position.

On the other hand, when the bundle H of 100 paper sheets belongs to category B, the conveyor 22 conveys the bundle H of 100 paper sheets which was slipped down on the conveyor 22 in the direction of arrow A10 with the standing position. The pushing bar 19*b* accumulates the bundle H of 100 paper sheets which arrived at the predetermined position on the accumulation tray 31*b* of the accumulation part 30*b* of category B with the standing position. In particular, progressing ahead, the pushing bar 19*b* rotates as arrow B shows and pushes the bundle H of 100 paper sheets on the accumulation tray 31*a*.

Subsequent operation of the paper sheet bundle wrapping apparatus 1 is the same as the operation of the paper sheet bundle wrapping apparatus 1 explained in the embodiment 1. That is, when ten bundles H of 100 paper sheets are accumulated on the accumulation tray 31*a* or the accumulation tray 31*b*, the ten bundles H of 100 paper sheets, i.e., the bundle S of 1000 paper sheets, is sent to the lift table 51. The bundle S of 1000 paper sheets is further sent to the binding unit 72, and is bound together with the bands C1, C2 at two places by the binding machine 72 of the binding unit 70. The bundle S of 1000 paper sheets which is bound together is discharged from the binding unit 70, and the bundle S of 1000 paper sheets is shrink-wrapped by the shrink wrapping unit 80.

Next, how to use the paper sheet processing system of this embodiment will be explained. As shown in FIG. 30, 1000 paper sheets as the paper sheet bundle SB of one throughput are collectively supplied to the paper sheet processing apparatus 100 in many cases. One paper sheet P supplied is taken out at a time, and is classified according to the category. 100 paper sheets are bound together to form the bundle H of 100 paper sheets whenever the classified paper sheet amounts to 100 paper sheets. When the failure mentioned above occurs during this processing, the evacuation stacker 211 concerning the embodiment functions effectively.

That is, the paper sheet processing apparatus 100 supplies the bundle H of 100 paper sheets to the receiving unit 10 of the paper sheet bundle wrapping apparatus 1 until the failure occurs. If the failure will be detected in the middle of this supply, the paper sheet processing apparatus 100 will supply the following bundle H of 100 paper sheets to the receiving unit 12 of the evacuation stacker 211.

By use of the evacuation stacker 211, even when the failure occurs in the paper sheet bundle wrapping apparatus 1, the paper sheets of 1000 sheets supplied collectively are processed continuously. Generally processing of 1000 paper sheets is called one transaction. After processing of the paper sheets SB of one transaction under processing is finished, the paper sheet processing apparatus 100 stops processing of the paper sheet and waits for supply of paper sheets SB of next transaction.

Usually, removal processing of the failure of the paper sheet bundle wrapping apparatus 1 is performed in this state. When the failure is removed, in the off-line state which, the paper sheet bundle wrapping apparatus 1 and the paper sheet processing apparatus 100 do not cooperate, the bundle H of 100 paper sheets accumulated in the evacuation stacker 211 is processed manually. In this embodiment, the bundle H of 100 paper sheets accumulated to the evacuation stocker 211 is processed easily by only inserting the bundle H of 100 paper sheets in a manual slot and pushing the taking-in switch 234*a* or the taking-in switch 234*b*.

As explained above, according to the paper sheet processing system of this embodiment, when the failure occurs in the paper sheet bundle wrapping apparatus, the paper sheet bundle wrapping apparatus accumulates the bundle of 100 paper sheets supplied from the paper sheet processing apparatus to the evacuation stacker of the the paper sheet bundle wrapping apparatus, and the paper sheet processing apparatus continues processing of the transaction. After removing the failure of the paper sheet bundle wrapping apparatus, the bundle of 100 paper sheets accumulated in the evacuation stacker is taken out and is supplied to the paper sheet bundle wrapping apparatus manually. Thereby, the paper sheet processing system, and the paper sheet bundle wrapping apparatus which classify the bundle 100 paper sheets for every category, and bind ten bundles of 100 paper sheets together to form the bundle of 1000 paper sheets are provided.

In the paper sheet processing system of this embodiment, the usage rate of the paper sheet bundle wrapping apparatus 1 is high like the embodiment 1. The paper sheet processing system does not reduce the throughput of the paper sheet processing apparatus 100 even when the failure occurs in the paper sheet bundle wrapping apparatus 1.

Embodiment 4

The embodiment 1 explains the paper sheet processing system 2 with which the paper sheet bundle wrapping apparatus 1 is arranged at a straight shape as shown in FIG. 36. The paper sheet processing system 2 of the embodiment 1 needs a straight shape long installation area. On the other hand, as for the paper sheet processing system 2 of this example, the paper sheet bundle wrapping apparatus 1 is arranged at a U shape. The paper sheet processing system 2 of this embodiment 4 is preferred to the case the straight shape long installation area is not secured.

Figure 37:
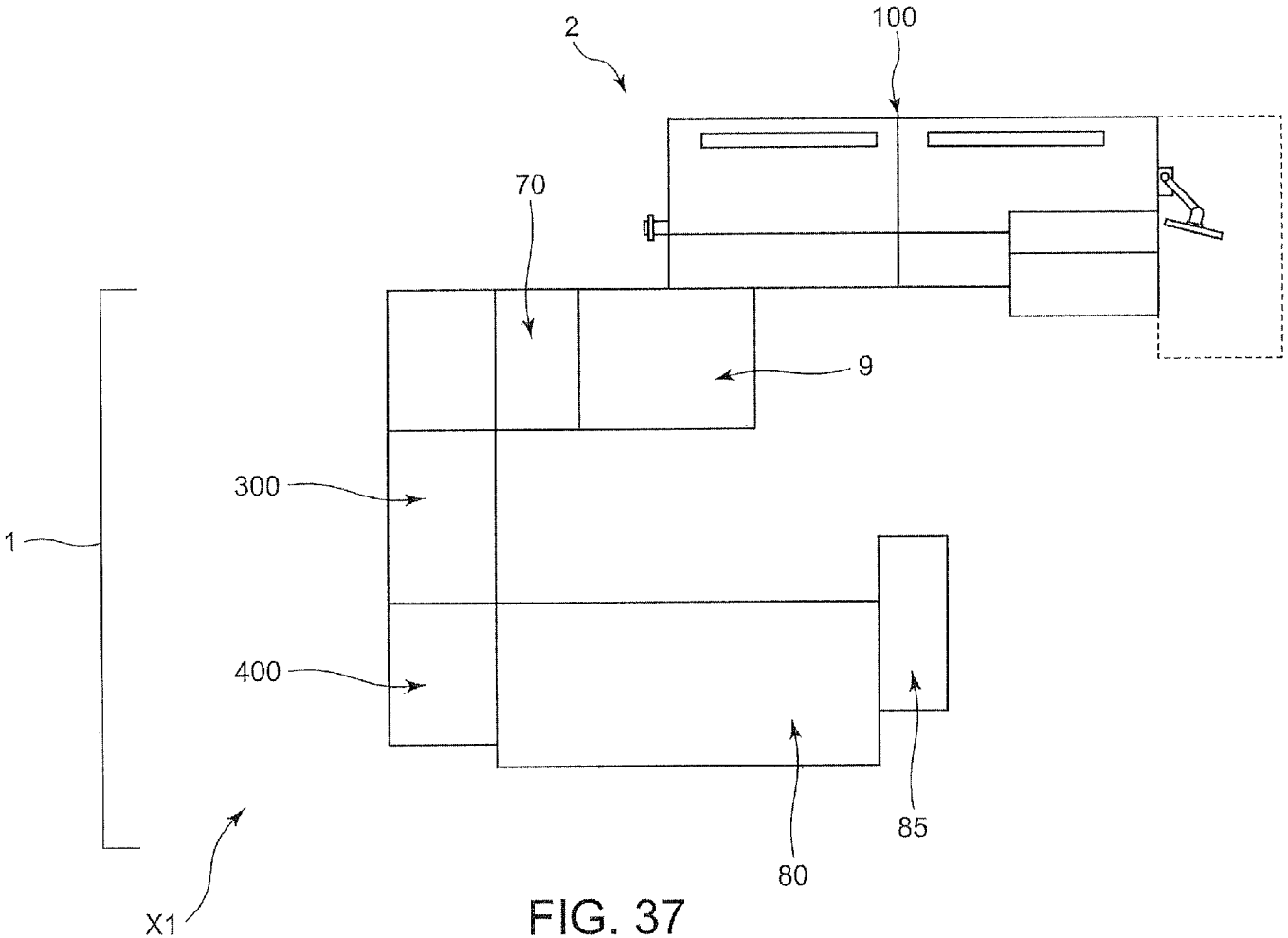
FIG. 37 is a plane arrangement diagram o a paper sheet processing system concerning a embodiment 4.

FIG. 37 is a plane arrangement diagram of the paper sheet processing system 2. This paper sheet processing system 2 has an evacuation stacker 211 like the paper sheet processing system of the embodiment 2, for example. However, in this embodiment, the paper sheet bundle wrapping apparatus 1 is arranged at U shape, as shown in FIG. 37.

The 100-sheet bundle accumulation unit 9, the binding unit 70, the wrapping unit 80, and the 1000-sheet bundle discharge unit 85 of the paper sheet bundle wrapping apparatus 1 are connected in the U shape. A conveyor 300 and an arranger 400 connect the binding unit 70 and the wrapping unit 80, and convey the bundle S of 1000 paper sheets which is discharged from the binding unit 70 to the wrapping unit 80.

When the bundle of 1000 paper sheets is arranged its position in the center of a supplying inlet, the wrapping unit 80 can shrink-wraps the bundle of 1000 paper sheets properly. Therefore, the arranger 400 arranges the bundle of 1000 paper sheets in the center of the supplying inlet of wrapping unit 80.

Figure 38:
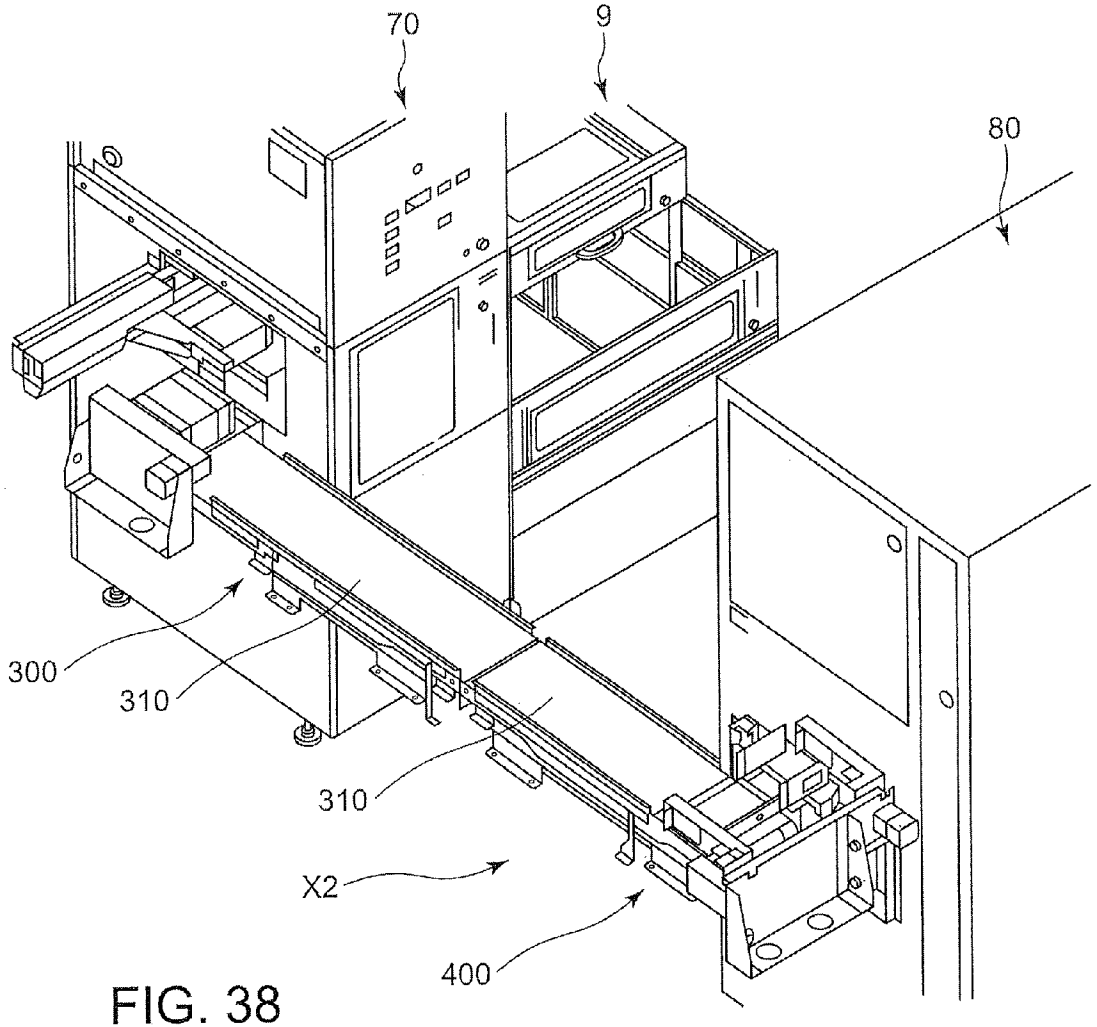
FIG. 38 is a perspective view of the paper sheet bundle wrapping apparatus in [0045] FIG. 37 viewed from X1 direction.
Figure 39:
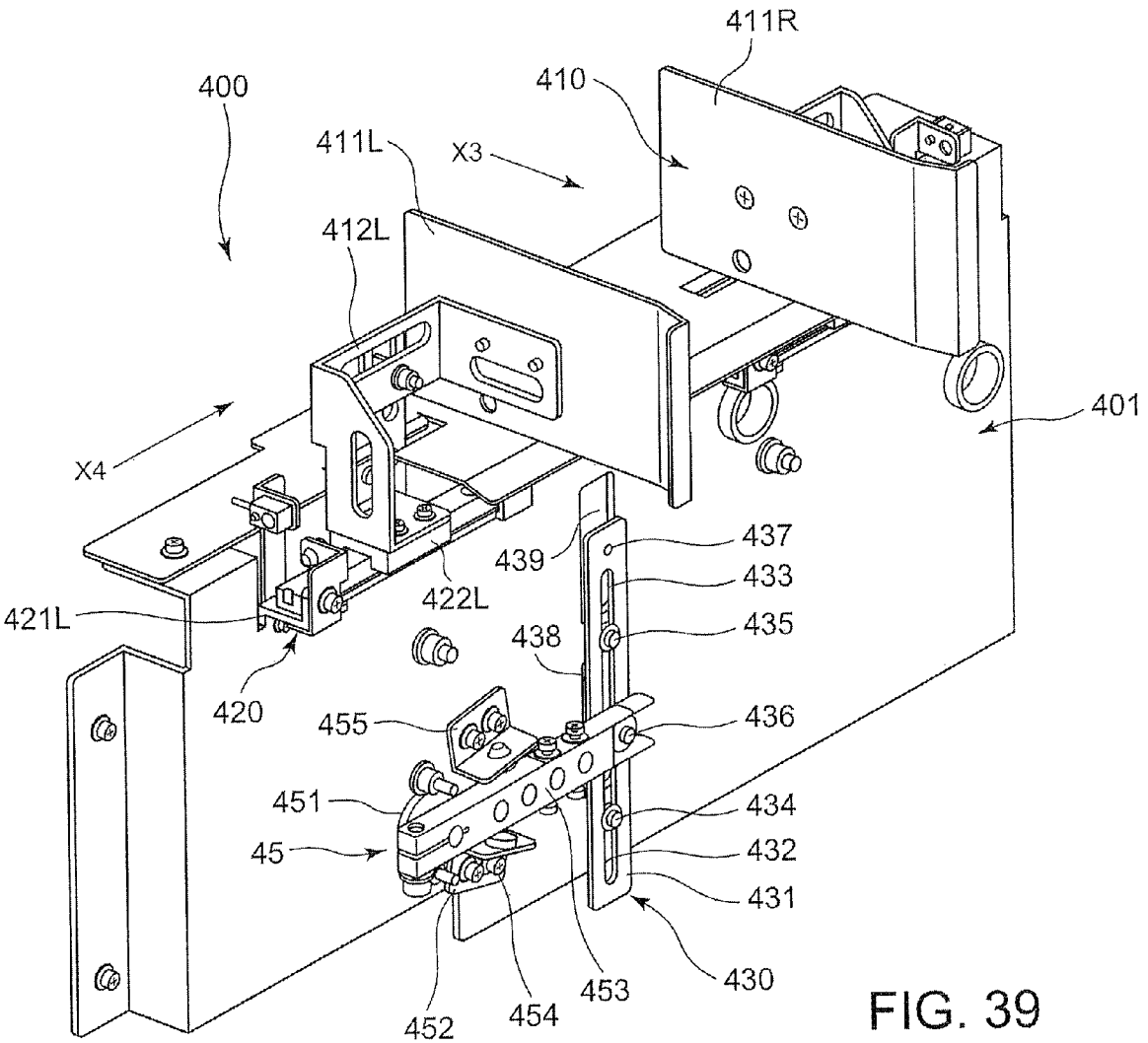
FIG. 39 is a perspective view of an arranger in FIG. 38 viewed from X 2 direction.
Figure 40:
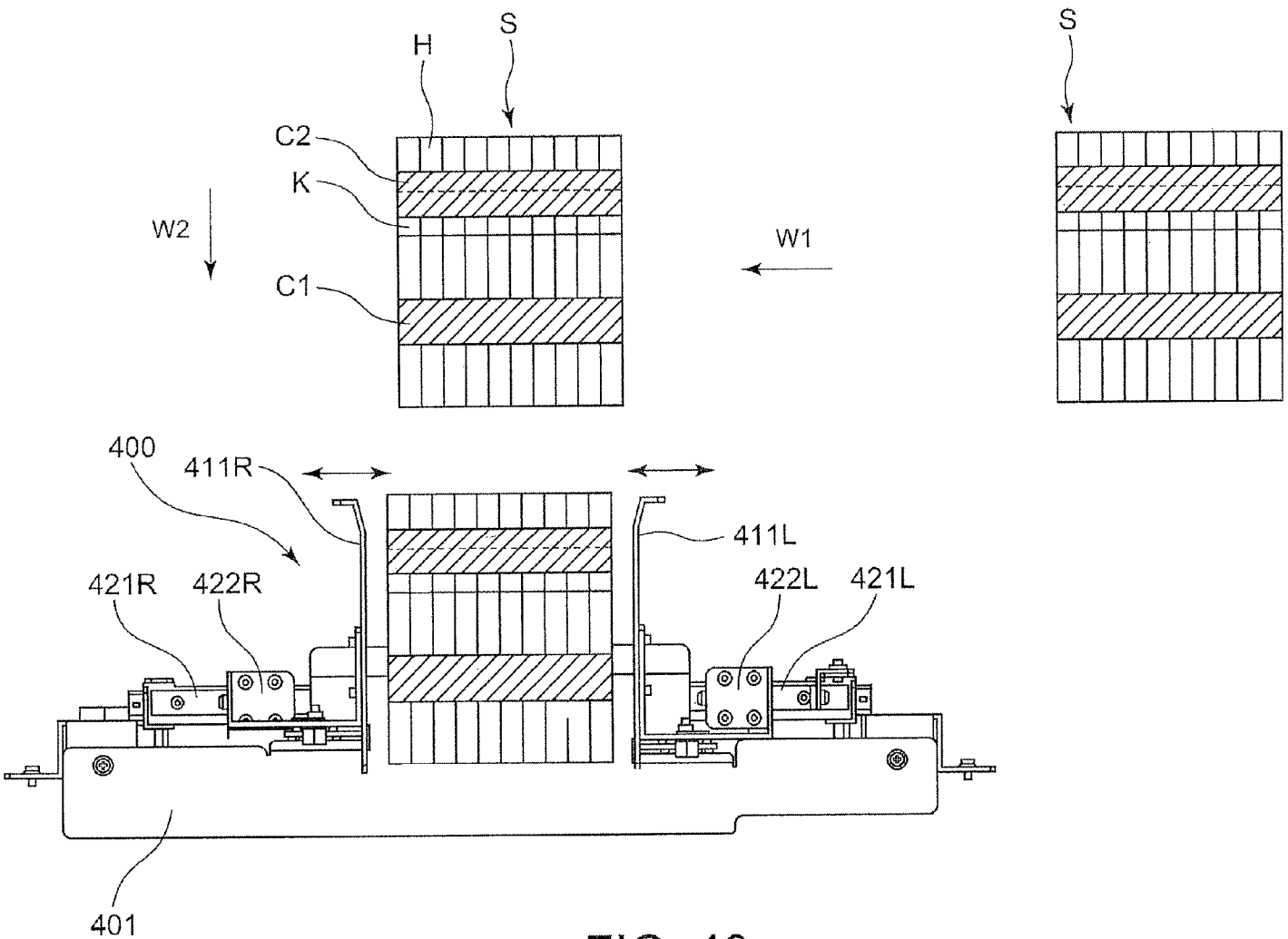
FIG. 40 is a top view of the arranger explaining operation of the arranger.
Figure 41:
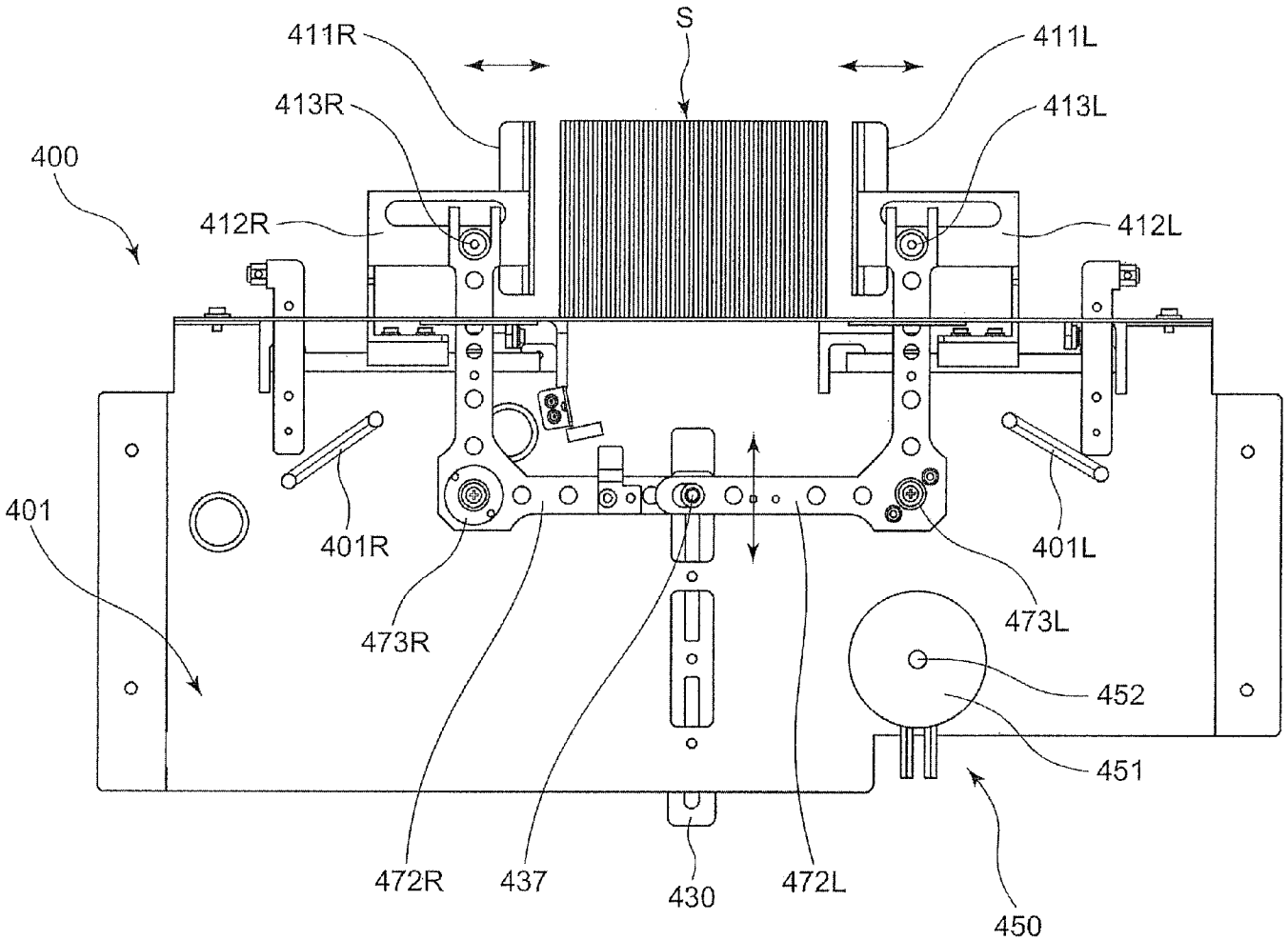
FIG. 41 is a front view of the arranger explaining operation of the arranger.
Figure 42:
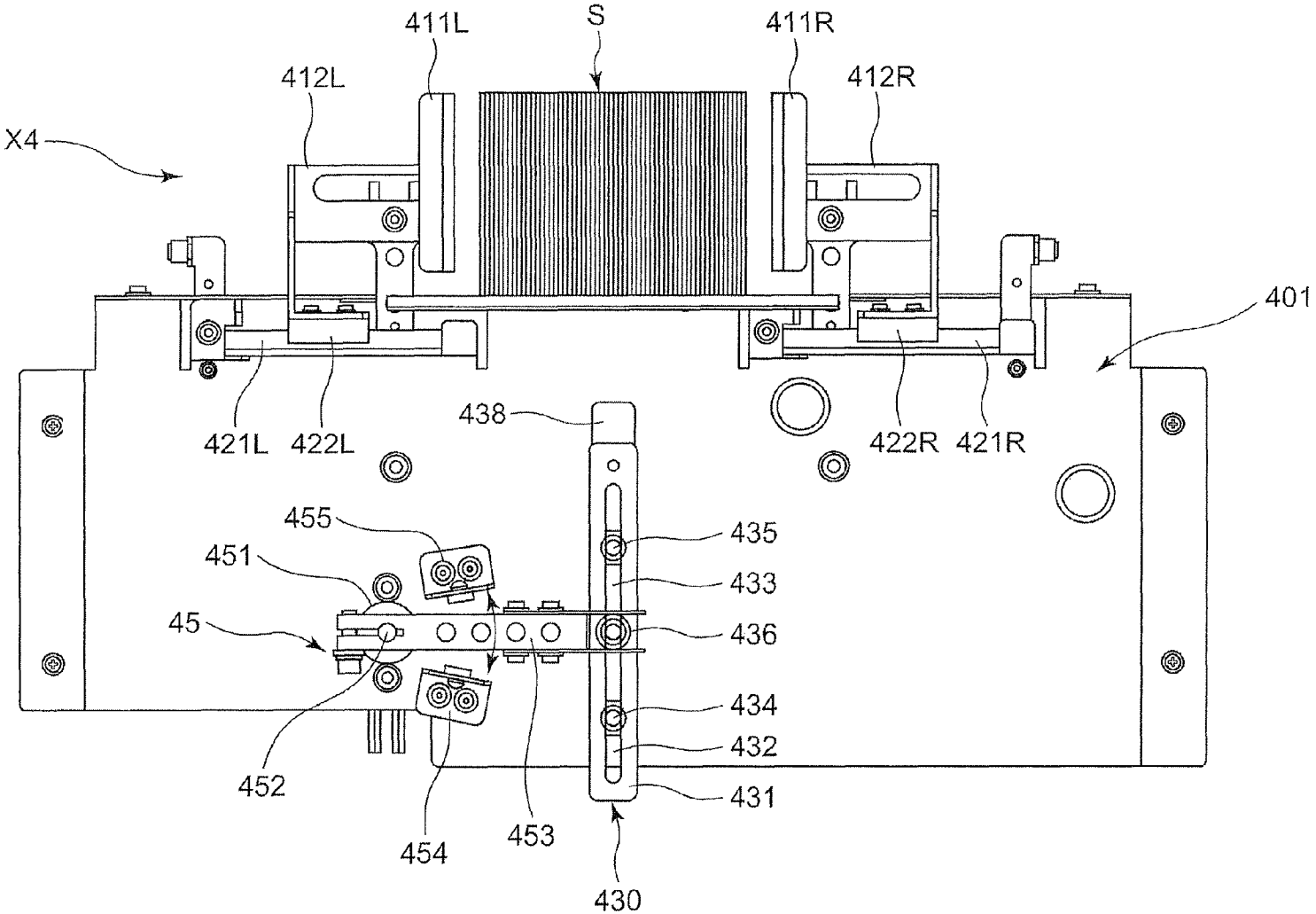
FIG. 42 is a back view of the arranger explaining an actuator of the arranger.
Figure 43:
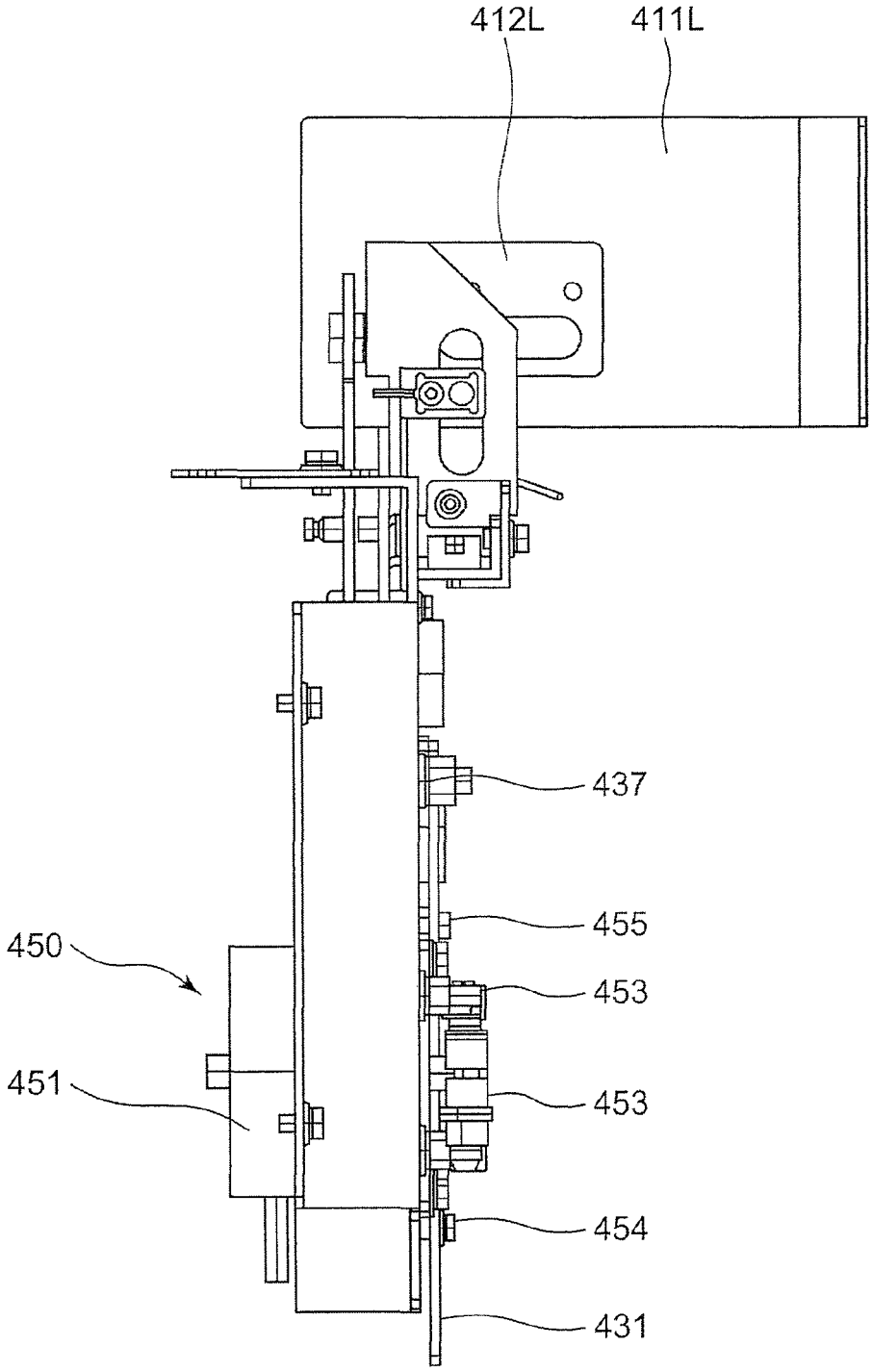
FIG. 43 is a side view of the arranger.

FIG. 38 is a perspective view of the paper sheet bundle wrapping apparatus 1 shown in FIG. 37 viewed from X1 direction. FIG. 39 is a perspective view of the arranger 400 shown in FIG. 38 viewed from X2 direction. FIG. 40 is a top view of the arranger 400 explaining operation of the arranger 400. FIG. 41 is a front view of the arranger 40. FIG. 42 is a back view of the arranger 400.

The arranger 400 has a position arranging unit 410 which arranges a position of the bundle S of 1000 paper sheets conveyed by the conveyor unit 300, an actuator 450, and a driving force transmitting means.

The position arranging unit 410 includes a position arranging guide 411 (a collective term of position arranging guides 411R and 411L), a position arranging guide holder 412 (a collective term of position arranging guide holders 412R and 412L), a slider 422 (a collective term of sliders 422R and 422L), and slide rail 421 (a collective term of slide rails 421R and 421L).

The position arranging guide 411 has a function to guide the bundle S of 1000 paper sheets conveyed by the conveyor 300 in the center of the supplying inlet of the wrapping unit 80.

The position arranging guide 411 is attached to the position arranging guide holder 412.

The position arranging guide holder 412 is attached to the slider 422, and the slider 422 is attached the slide rail 421 slidably in the major axis direction of the slide rail. Thereby, the position arranging guide 411 moves with movement of the slider 422 when the slider 422 moves to the major axis direction of the slide rail 421 by the driving force from the outside.

The actuator 450 has a drive motor 451, a driving shaft 452, a drive bar 453, stoppers 454 and 455, etc.

The drive motor 451 is a motor which rotates in a forward direction and a reverse direction, and the drive bar 453 is supported by the driving shaft 452 which is a rotational shaft. When the drive motor 451 rotates in the forward direction or the reverse direction in a range of a predetermined angle, the drive bar 453 rotates in the range of the predetermined angle. A pulse motor is used for the drive motor 451, and a rotating range is set by a control means which is not illustrated.

The stoppers 454 and 455 become a stopper at the time of the drive bar 453 rotating. When the control means sets up a rotation angle greatly accidentally, the drive bar 453 may exceed a working range and damage surrounding parts. Therefore, the stoppers 454 and 455 prevent the drive bar 453 from exceeding the working range.

A grooved cam unit 430 as a driving force transmitting means changes the rotational power of the drive motor 451 into a straight-line motion by connecting the drive bar 453 with the cam plate 431 via the grooved cam shaft 436.

The cam plate 431 is a long plate and two penetration holes 432 and 433 are formed in a major direction. The cam plate 431 is supported pivotally to a base 401 by plate supporting shafts 434 and 435 which penetrate these two holes 432 and 433. However, since this cam plate 431 is supported pivotally movable in a direction of penetration hole 432, 433, the cam plate 431 moves in the direction of penetration hole 432, 433 when the drive bar 453 connected to the cam plate 431 rotates. In the embodiment, since the cam plate 431 is attached to the base 401 by the plate supporting shafts 434 and 435 removable in an up-and-down direction, and cam operation which changes the rotational movement of the drive bar 453 into the liner movement of the up-and-down direction is performed.

Cam grooves 438, 439 are formed between the cam plate 431 and the base 401, and an arranger arm 472 is supported pivotally to the cam plate 431 by an arranger shaft 437 which penetrates these cam grooves 438 and 439. Accordingly, when the drive bar 453 moves the cam plate 431, the arranger shaft 437 carries out a liner movement up and down in connection with the movement of the cam plate 431.

The arranger arm 472 has two arranger arms 472R and 472L of L shape.

The portion into which each arranger arm 472R, 472L bends is supported pivotally to the base 401 by arranger arm shaft 473R, 473L, and the arranger arm shaft 473R, 473L serves as a fulcrum when rotating. One end of the arranger arm 472R, 472L is supported pivotally by the cam plate 431 mentioned above, and the other end is connected with the position arranging guide holder 412R, 412L.

The position arranging guides 411R, 411L are being fixed to the position arranging guide holders 412R and 412L respectively. The position arranging guides 411R and 411L move with movement of the position arranging guide holders 412R and 412L, and arrange the bundle S of 1000 paper sheets in the center.

Operation of the arranger arm 472 (a collective term of the arranger arms 472R and 472L) and the position arranging guide 411 which were constituted as mentioned above is explained with reference to FIG. 40.

The bundle S of 1000 paper sheets is conveyed in the arrow W1 direction by the conveyor 310. When the bundle S of 1000 paper sheets reaches the arranger 400, the bundle S of 1000 paper sheets is detected by a detection sensor which is not illustrate. The bundle S of 1000 paper sheets detected is pushed out in the arrow W2 direction by a pusher which is not illustrated. When it is detected that the pushed-out bundle S of 1000 paper sheets arrived at a predetermined position, an arranger control unit which is not illustrated drives the drive motor 451.

When the drive motor 451 rotates the motor shaft 452 at right direction at a predetermined angle in FIG. 42, the drive motor 451 lowers the drive bar 453 and moves the grooved cam shaft 436 down at specified quantity.

As shown in FIG. 41, when the grooved cam shaft 436 moves downward, the arranger arm 472 is pulled downward. Since the arranger arm 472 receives torque focusing on the arranger arm shaft 473 by this pulling force, the position arranging guide holders 412R and 412L are energized in the direction which approaches mutually.

The energizing force of this position arranging guide holder 412 energizes the position arranging guide 411 attached to the position arranging guide holder 412 in a direction which approaches mutually. The position arranging guide 411 arrange the bundle S of 1000 paper sheets laid inside the position arranging guide 411 in the center.

After arranging the position of the bundle S of 1000 paper sheets, the drive motor 451 rotates reverse and raises the driving bar 453, and returns the position arranging guide 411 to an initial position via the arranger arm 472.

Thus, the bundle S of 1000 paper sheets which was arranged its position is supplied to the wrapping unit 80 and is shrink-wrapped. The bundle of 1000 paper sheets shrink-wrapped is discharged from the 1000-sheet bundle discharge unit 85.

As explained above, according to the embodiment 4, even when an area where the paper sheet processing apparatus 100 and the paper sheet bundle wrapping apparatus 1 are installed in straight shape is not secured, the paper sheet processing apparatus 100 and the paper sheet bundle wrapping apparatus 1 can be connected.

The paper sheet processing system of this example can be applied irrespective of the existence of the evacuation stacker, and can be applied also to the paper sheet processing system like the embodiment 1 or the embodiment 3.

The embodiment showed the arranger arm 472 of L shape which makes compact arm arrangement. However, the arranger arm is not limited to L shape.

By choosing the distance from the arranger arm shaft 473, suitable press to the bundle S of 1000 paper sheets can be added by leverage. These are set up to satisfy design, conditions, such as a size of the paper sheet bundle to process, and weight.

As explained above, according to the paper sheet processing system of the present invention, even when a large number of the bundles of 100 paper sheets containing the bundle of 100 paper sheets of a different category are supplied to the paper sheet bundle wrapping apparatus, the paper sheet bundle wrapping apparatus accumulates the bundles of 100 paper sheets according to the category and binds the bundles of 100 paper sheets together to forms the bundle of 1000 paper sheet. Therefore, the paper sheet processing system of the invention can raise the usage rate of the paper sheet bundle wrapping apparatus.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the systems described herein may be made without departing from the spirit of the inventions. The accompanying claims and their equivalents are intended to cover such forms or modifications as would fall within the scope and spirit of the inventions.

What is claimed is:

1. A paper sheet processing system comprising:

a paper sheet processing apparatus which includes:

a taking-in unit configured to take in one paper sheet supplied at a time;

a paper sheet discrimination unit configured to distinguish a category of the paper sheet taken in by the taking-in unit;

an accumulation part constituted so that the paper sheet may be accumulated according to the category based on the category which the paper sheet discrimination unit distinguished;

a first binding unit configured to bind a first number of the paper sheets accumulated together by a first band at a first banding position to form a first paper sheet bundle;

a discharging mechanism configured to discharge the first paper sheet bundle; and a first communications unit configured to transmit category information corresponding to the category of the paper sheet included in the first paper sheet bundle discharged by the discharging mechanism; and a paper sheet bundle wrapping apparatus which includes:

a first receiving unit configured to receive the first paper sheet bundle discharged from the paper sheet processing apparatus;

a second communications unit configured to receive the category information transmitted by the first communications unit;

an accumulation mechanism configured to accumulate the first paper sheet bundle received by the first receiving unit on a first accumulation tray or a second accumulation tray based on the category information received by the second communications unit;

a conveyance mechanism configured to convey a second number of the first paper sheet bundles accumulated to the first accumulation tray or the second accumulation tray, to a second binding unit;

the second binding unit configured to bind the second number of the first paper sheet bundles conveyed by the conveyance mechanism together by a second band and a third band to form a second paper sheet bundle;

a wrapping unit configured to wrap the second paper sheet bundle; and a control unit configured to control the first receiving unit, the accumulation mechanism, the conveyance mechanism, the second binding unit, and the wrapping unit;

wherein, the first receiving unit includes a plate to receive the first paper sheet bundle in the standing position of which side edge surface is used as a bottom;

the accumulation mechanism includes a slipping down part which the first paper sheet bundle slips down;

a shutter capable of opening and closing to hold temporarily the first paper sheet bundle which slips down the slipping down part;

a conveyor to lay the first paper sheet bundle slipped down by opening the shutter;

a holder to hold the upper end of the first paper sheet bundle so that the first paper sheet bundle laid on the conveyor may not fall; and category selecting unit includes a first accumulation conveyance part to accumulate the first paper sheet bundle laid on the conveyor in the standing position to the first accumulation tray, and a second accumulation conveyance part to convey the first paper sheet bundle laid on the conveyor to the first position by the conveyor and to accumulate the first paper sheet bundle to the second accumulation tray in the standing position;

wherein the conveyance mechanism includes:

a first transportation part to move the second number of the first paper sheet bundles in the standing position accumulated on the first accumulation tray to a second position;

a second transportation part to move the second number of the first paper sheet bundles in the standing position accumulated on the second accumulation tray to a third position;

a first delivery part to deliver collectively the second number of the first paper sheet bundles accumulated on said first accumulation tray moved to the second position by the first transportation part to a lift table;

a second delivery part to deliver collectively the second number of first paper sheet bundles accumulated on the second accumulation tray moved to the third position by the second transportation part to the lift table;

a lifter having the lift table to lift the lift table on which the second number of the first paper sheet bundles passed by the first delivery part or the second delivery part are laid; and a third transportation part to convey the second number of the first paper sheet bundles raised by the lifter to the second banding unit while arranging position of the second number of the first paper sheet bundles; and wherein the second binding unit includes:

a fourth transportation part to convey the second number of the first paper sheet bundles to the second banding position and the third banding position.

2. The paper sheet processing system according to claim 1, wherein the discharging mechanism includes:

a first lifter configured so that by raising one side edge surface of the first paper sheet bundle at a predetermined angle the first paper sheet bundle may be held in a standing position where the other side edge surface of the first paper sheet bundle is used as a bottom; and a pushing out unit configured to discharge the first paper sheet bundle supported in the standing position with its standing position.

3. The paper sheet processing system according to claim 1, wherein the category information is the information selected from normal ticket information, a damaged ticket information, and a front/back information of the paper sheet bundle.

4. The paper sheet processing system according to claim 1, wherein the holder is a side wall arranged at a side edge part of the conveyor, the side wall is arranged to incline a predetermined angle to the perpendicular direction to the conveyor.

5. The paper sheet processing system according to claim 1, wherein the first receiving unit has a plate, and the plate is arranged so that one end may become lower than other ends at the upper stream side where the first paper sheet bundle is accepted.

6. The paper sheet processing system according to claim 1, wherein the shutter has a plurality of rod-like members, the rod-like members project from the slipping down surface which constitutes the slipping down part when the shutter is closed, and the rod-like members retreat from the slipping down surface when the shutter is open, and the paper sheet bundle is placed on the rod-like members in a state that a side edge face is used as a bottom when the shutter is closed, and the paper sheet bundle slips down along said slipping down surface when the shutter is open.

7. The paper sheet processing system according to claim 1, wherein the second banding unit bands the second band and the third band so that either the second band or the third band may overlap the first band.

8. The paper sheet processing system according to claim 1, wherein the third transportation part includes:

a conveying table having a plurality of plates arranged along a first direction which the third transportation part conveys the second number of the first paper sheet bundles;

a fixed guide arranged along the first direction on the conveying table;

a movable guide arranged so as to counter the fixed guide;

a slide rail arranged so as to intersect perpendicularly with the fixed guide;

an arm attached with the movable guide and attached to the slide rail so as to move free on the slide rail;

an energizing means to energize the arm to the fixed guide side by fixed load;

a slider being movable free on the slide rail between the arm and the fixed guide, and having a stopper for stopping movement of the arm;

a guide opening and closing mechanism to move the slider along with said slide rail;

a slider detection sensor to detect the position of the slider;

a pushing out unit to push out the second number of the first paper sheet bundles to a carrying path formed between said fixed guide and the movable guide;

a paper sheet bundle detection sensor to detect the paper sheet bundle pushed out by the pushing out unit; and a second control unit, when the paper sheet bundle detection sensor detects the second number of the first paper sheet bundles pushed out by the pushing out unit, wherein the second control unit;

controls the pushing out unit so that the pushing out unit may stop pushing out;

controls the slider so that the slider may move on the shaft of the slide rail until the position of the slider is detected by the slider detection sensor;

the movable guide pushes the second number of the first paper sheet bundles to the fixed guide side with the fixed load by the energizing part; and further controls the pushing out unit so that the pushing out unit may push out the second number of the first paper sheet bundles pinched by the movable guide and the fixed guide further to downstream in the first direction.

9. The paper sheet processing system according to claim 8, wherein the fixed guide includes:

a first base, a plurality of first idle rollers arranged on the first base, a first endless belt hung on the first idle rollers of which the receiving section receives the second number of the first paper sheet bundles is opened at a predetermined angle, a first bend prevention guide arranged inside the first endless belt, and the movable guide includes a second base fixed to the arm, a plurality of second idle rollers arranged on the second base, a second endless belt hung about on the second idle roller of which the receiving section receives the second number of the first paper sheet bundles is opened at a predetermined angle, and a second bend prevention guide arranged inside the second endless belt.

10. The paper sheet processing system according to claim 8, wherein the guide opening and closing mechanism unit includes:

a third base, a motor attached to one end side of the third base, and the motor has a rotational shaft and is capable of rotating the rotational shaft a forward direction and a reverse direction, a first pulley attached to the rotational shaft, a second pulley attached to the other end side of the third base, and a timing belt hung on the first pulley and the second pulley, and the slider is attached to the timing belt, wherein the slider moves to the fixed guide side along the slide rail when the motor rotates the rotational shaft to the forward direction, and the slider returns to the original position when the motor rotates the rotational shaft to the reverse direction.

11. The paper sheet processing system according to claim 8, wherein the stopper does not contact the arm when the slider moves to the fixed guide side along the slide rail until the position of the slider is detected by the slider detection sensor.

12. The paper sheet processing system according to claim 8, wherein the fixed guide includes:

a first base, and a first plate fixed to the first base, wherein a receiving section of the first plate which receives the second number of the first paper sheet bundles is opened at a first angle, and a portion of the first plate in contact with the first paper sheet bundle is formed by low frictional resistance material, and the movable guide includes a second base, and a second plate fixed to the second base, wherein a receiving section of the second plate that receives the first paper sheet bundle of the second number is opened at a first angle, and a portion of the second plate in contacts with the first paper sheet bundle is formed by low frictional resistance material.

13. The paper sheet processing system according to claim 1, wherein the paper sheet wrapping apparatus further includes:

a detection unit to detect failure of the paper sheet wrapping apparatus, and an evacuation stacker which accumulates the first paper sheet bundle having a second receiving unit that receives the first paper sheet bundle, the second communications unit transmits failure information to the paper sheet processing apparatus when the detection unit detects the failure of the paper sheet wrapping apparatus, and the discharge mechanism is configured to discharge the first paper sheet bundle to the first receiving unit or the second receiving unit, wherein the discharge mechanism discharges the first paper sheet bundle to the first receiving unit when the first communications unit does not receive the failure information, and the discharge mechanism discharges the first paper sheet bundle to the second receiving unit when the first communications unit receives the failure information.

14. The paper sheet processing system according to claim 13, wherein the evacuation stacker includes:

the second receiving unit to receive the first paper sheet bundle in a standing position, a fall prevention guide to prevent the first paper sheet bundle received by the second receiving unit from falling to the backside, a backup to press the first paper sheet bundle supported by the fall prevention guide to the fail prevention guide with a constant force spring, and a backup sensor to detect that the backup is located within a predetermined region and outputs a detection result, and the control unit transmits the detection result outputted from the backup sensor to the first communications unit of the paper sheet processing apparatus via the second communications unit.

15. The paper sheet processing system according to claim 14, wherein the paper sheet processing apparatus stops processing of the paper sheet processing apparatus so that the first paper sheet bundle may not be discharged when the evacuation stacker is full.

16. The paper sheet processing system according to claim 13, wherein the paper sheet bundle wrapping apparatus further includes:

an on-line/off-line setting unit to set the paper sheet bundle wrapping apparatus as an on-line state which the paper sheet bundle wrapping apparatus connects with the paper sheet processing apparatus, or as an off-line state which the paper sheet bundle wrapping apparatus does not connect with the paper sheet processing apparatus, a slot into which the 1st paper sheet bundle is supplied manually, and a category setting unit to set up the category information of the first paper sheet bundle supplied to the slot when the paper sheet bundle wrapping apparatus is in the off-line state, and the paper sheet processing apparatus is further includes a first outlet and a second outlet.

17. The paper sheet processing system according to claim 16, wherein the slot is arranged in the upper part of the first receiving unit.

18. The paper sheet processing system according to claim 1, wherein the wrapping unit has a second paper sheet bundle receiving section to receive the second paper sheet bundle, the paper sheet bundle wrapping apparatus includes between the second binding unit and the wrapping unit, a conveyer to convey the second paper sheet bundle to the wrapping unit, and an arranger configured to arrange the second paper sheet bundle conveyed by the conveyor in the center of the second paper sheet bundle receiving section of the wrapping unit, and the second binder unit, the conveyer, the arranger and the wrapping unit are arranged in U shape.

* * * * *